US011397029B2

(12) United States Patent
Miller

(10) Patent No.: US 11,397,029 B2
(45) Date of Patent: Jul. 26, 2022

(54) ROTARY HEAT EXCHANGER

(71) Applicant: Nativus, Inc., Reno, NV (US)

(72) Inventor: Matthew C. Miller, Reno, NV (US)

(73) Assignee: Nativus, Inc., Reno, NV (US)

( * ) Notice: Subject to any disclaimer, the term of this patent is extended or adjusted under 35 U.S.C. 154(b) by 0 days.

(21) Appl. No.: 15/443,275

(22) Filed: Feb. 27, 2017

(65) Prior Publication Data

US 2017/0248347 A1 Aug. 31, 2017

Related U.S. Application Data

(60) Provisional application No. 62/301,494, filed on Feb. 29, 2016.

(51) Int. Cl.

| | |
|---|---|
| ***F25B 3/00*** | (2006.01) |
| ***F28F 5/04*** | (2006.01) |
| ***F28D 11/02*** | (2006.01) |
| ***F25D 17/06*** | (2006.01) |

(Continued)

(52) U.S. Cl.

CPC ..... *F25B 3/00* (2013.01); *F25D 17/06* (2013.01); *F28D 11/02* (2013.01); *F28F 5/04* (2013.01); *F25B 1/047* (2013.01); *F28D 2021/0068* (2013.01)

(58) Field of Classification Search

CPC .... F25B 3/00; F25B 1/04; F25B 1/047; F25B 1/053; F25B 31/026; F25B 2309/004; F25B 2309/005; F25B 2309/006; F25B 15/004; F28D 11/02; F28D 11/08; F28D 11/04; F28F 5/02; F28F 5/04

See application file for complete search history.

(56) References Cited

U.S. PATENT DOCUMENTS 1,109,223 A * 9/1914 Havenstrite ..... F25B 3/00 62/205
1,589,373 A * 6/1926 De Remer ..... F25B 3/00 159/24.2

(Continued)

FOREIGN PATENT DOCUMENTS

CH 576615 A5 * 6/1976 ..... F28D 11/04
CN 1642608 A 7/2005

(Continued)

OTHER PUBLICATIONS

Partial International Search Report dated May 24, 2017 for Application No. PCT/US2017/019501.

(Continued)

*Primary Examiner* — Miguel A Diaz

(74) *Attorney, Agent, or Firm* — Knobbe, Martens, Olson & Bear, LLP

(57) ABSTRACT

Rotary heat exchangers can include a ride-along compressor, at least a portion of which can be rotated along with the heat exchanger. By rotating at least a portion of the compressor along with the heat exchanger, a sealed fluid circuit containing a two-phase working fluid can be provided. A rotary heat pump or heat engine can include an evaporator and a condenser in the form of back-to-back centrifugal fans. The centrifugal fan blades or other portions of the evaporator and condenser may include internal cavities where the working fluid undergoes a phase change.

24 Claims, 55 Drawing Sheets

(51) Int. Cl.
*F28D 21/00* (2006.01)
*F25B 1/047* (2006.01)

(56) References Cited

U.S. PATENT DOCUMENTS 2,746,725 A * 5/1956 Reed ..... F28D 11/04 165/6
3,001,384 A * 9/1961 Hanson ..... F24F 5/001 62/499
3,025,684 A * 3/1962 McLain ..... F24F 1/02 62/499
3,189,262 A * 6/1965 Hanson ..... F04C 29/04 418/172
3,347,059 A * 10/1967 Laing ..... F24F 1/02 165/92
3,389,577 A * 6/1968 Kemp ..... F25B 1/053 62/499
3,397,739 A * 8/1968 Miller ..... F25B 3/00 165/122
3,769,796 A * 11/1973 Bechtold ..... F01K 11/04 122/11
3,773,106 A * 11/1973 Levy ..... F04D 29/287 165/299
3,834,179 A * 9/1974 Eskeli ..... F01D 1/32 62/401
3,863,454 A * 2/1975 Doerner ..... F01D 25/18 60/669
3,866,668 A * 2/1975 Doerner ..... F04D 17/161 165/110
3,877,515 A * 4/1975 Laing ..... F24F 12/002 165/104.25
3,888,304 A * 6/1975 Laing ..... F24F 12/002 165/104.33
3,895,491 A * 7/1975 Eskeli ..... F02C 1/105 60/650
3,896,635 A * 7/1975 Stewart ..... F25B 3/00 62/499
3,911,694 A * 10/1975 Doerner ..... F01K 7/00 62/499
3,962,874 A * 6/1976 Doerner ..... F01D 25/18 60/669
3,972,203 A 8/1976 Eskeli
3,981,627 A * 9/1976 Kantor ..... F25B 3/00 417/207
3,986,852 A * 10/1976 Doerner ..... F01K 11/04 62/467
3,989,101 A * 11/1976 Manfredi ..... F01N 3/0205 165/86
4,000,778 A * 1/1977 Laing ..... F25B 3/00 165/86
4,073,338 A * 2/1978 Fujikake ..... F28D 11/02 165/86
4,086,691 A * 5/1978 Smith, Jr. ..... D21F 5/02 165/76
4,209,998 A * 7/1980 Shaw ..... F04C 23/003 417/237
4,726,198 A * 2/1988 Ouwenga ..... F25B 3/00 62/499
5,901,568 A * 5/1999 Haga ..... F25B 3/00 62/324.6
8,578,733 B2 * 11/2013 Roisin ..... B60H 1/3223 62/506
9,772,122 B2 * 9/2017 Swett ..... F04D 29/584
10,041,701 B1 * 8/2018 Koplow ..... F25B 3/00
10,429,105 B1 * 10/2019 Kariya ..... F28F 5/00
11,018,535 B2 * 5/2021 Nigo ..... H01F 1/057
2002/0092316 A1 * 7/2002 Kidwell ..... F25B 3/00 62/499
2003/0145621 A1 * 8/2003 Kidwell ..... F25B 3/00 62/499
2006/0242985 A1 * 11/2006 Leek ..... B60H 1/3223 62/323.1
2008/0314069 A1 * 12/2008 Retolaza ..... F25B 15/004 62/476
2010/0180631 A1 * 7/2010 Roisin ..... B60H 1/3223 62/498
2012/0180992 A1 * 7/2012 Koplow ..... F28F 13/12 165/104.21
2013/0036762 A1 * 2/2013 Shaffer ..... F25B 1/04 62/498
2013/0327070 A1 * 12/2013 Rees ..... F25D 21/04 62/80
2015/0086394 A1 * 3/2015 Taguchi ..... F04D 25/06 417/366
2016/0003510 A1 * 1/2016 De Larminat ..... F01K 25/08 62/470
2016/0138612 A1 * 5/2016 Swett ..... F25B 1/053 62/498
2016/0138815 A1 * 5/2016 Swett ..... F25B 3/00 62/115
2016/0377327 A1 * 12/2016 Adler ..... F28D 11/04 62/499
2017/0248347 A1 * 8/2017 Miller ..... F28D 11/02
2018/0087509 A1 * 3/2018 Johnson ..... F04C 18/16
2018/0094869 A1 * 4/2018 Reshetnyak ..... F28F 9/001
2018/0156501 A1 * 6/2018 Vaidya ..... F04C 18/16

FOREIGN PATENT DOCUMENTS

CN 101018594 A 8/2007
DE 17 51 580 12/1971
GB 1422369 A * 1/1976 ..... F28D 11/04

OTHER PUBLICATIONS

International Search Report and Written Opinion dated Jul. 20, 2017 for Application No. PCT/US2017/019501.
Chinese Search Report dated Oct. 14, 2019, relating to Chinese Patent Application No. 201780026651.X.

* cited by examiner

Embodied single-stage vapor compression refrigeration cycle system diagram.

202,204,240,242.....Vapor
150.....Compressor
244,246,220.....Vapor
130.....Condenser Section
189.....Cold Air
130/170.....Fan
130.....Heat exchanger
190.....Warm Air
222,224,248,250,252,200....Liquid
113.....Expansion Valve
201.....Liquid + Vapor
110.....Evaporator Section
185.....Warm Air
110/170.....Fan
110.....Heat Exchanger
186.....Cold Air
170.....Motor
176.....Electrical Plug Pressure-Enthalpy Curve, Reverse Carnot Cycle Typical Organic Rankine Cycle (ORC) system diagram.

1.....Liquid Pump
2..... Liquid
3.....Evaporator Section
4.....Heat input
5.....N/A
6.....Heat Exchanger
7.....Waste heat
8.....Vapor
9.....Turbine
10.....Generator
11.....Electric Load
12.....Vapor
13.....Condenser Section
14.....Cold Air
15.....Fan
16.....Heat Exchanger
17.....Warm Air
18.....Liquid Pressure-Enthalpy Curve, Organic Rankine Cycle Denotes Fluid Path Denotes Fluid Path

ROTARY HEAT EXCHANGER

CROSS-REFERENCE TO RELATED APPLICATIONS

This application claims priority to U.S. Provisional Application No. 62/301,494, filed Feb. 29, 2016, the disclosure of which is hereby incorporated by reference in its entirety.

BACKGROUND

Field of the Invention

Innovations described herein relate to devices which can be operated as heat exchangers, and in particular to devices which can be operated as rotary heat exchangers.

Description of the Related Art

Rotary heat exchangers can utilize a rotating component as part of the heat exchanger, to move air and/or facilitate heat exchange separate air streams on either side of the heat exchanger.

SUMMARY

Some embodiments relate to a heat exchanger, including a first rotary heat exchanger, a second rotary heat exchanger configured to rotate in the same direction as the first rotary heat exchanger, and a fluid circuit extending through at least a portion of the first rotary heat exchanger and at least a portion of the second rotary heat exchanger and configured to permit passage of a working fluid between the first and second rotary heat exchangers.

The first rotary heat exchanger can include a first centrifugal fan and the second rotary heat exchanger can include a second centrifugal fan axially aligned with the first centrifugal fan and oriented in the opposite direction as the first centrifugal fan. The first and second centrifugal fans can include a plurality of fan blades.

The first heat exchanger can include a first plurality of thermal transfer components in thermal communication with the fluid circuit and the second heat exchanger can include a plurality of thermal transfer components in thermal communication with the fluid circuit. The first plurality of thermal transfer components can include generally planar structures oriented parallel to one another, and the second plurality of thermal transfer components can include generally planar structures oriented parallel to one another. The the plurality of fan blades of the first centrifugal fans can extend generally orthogonal to the planes of the first plurality of thermal transfer components, and the plurality of fan blades of the second centrifugal fan can extend generally orthogonal to the planes of the second plurality of thermal transfer components.

The first and second pluralities of thermal transfer components can include evaporator fins oriented generally normal to an axis of rotation of the heat exchanger. The fluid circuit can include a plurality of tubes extending through one of the first and second plurality of evaporator fins. The the plurality of tubes can include sections which extend generally parallel to an axis of rotation of the heat exchanger, where the sections which extend generally parallel to an axis of rotation of the heat exchanger extend through one of the first and second plurality of evaporator fins.

Each of the plurality of fan blades can include a fan blade cavity, an inlet in fluid communication with the fan blade cavity, and an outlet in fluid communication with the cavity, where the fluid circuit includes fan blade cavities. The plurality of fan blades can be configured to induce a state change in a working fluid during operation of the heat exchanger, such that at least a portion of a working fluid entering the cavity through the inlet of a fan blade in a first state will exit the outlet of the fan blade in a second state. The heat exchanger can include a fluid distribution baseplate disposed between the first centrifugal fan and the second centrifugal fan, the fluid distribution baseplate including a first plurality of distribution channels, each of the first plurality of distribution channels in fluid communication with the inlet of at least one of the fan blades of the first centrifugal fan, and a second plurality of distribution channels, each of the second plurality of fluid distribution channels in fluid communication with the outlet of at least one the fan blades of the first centrifugal fan, where the fluid circuit includes the first and second pluralities of distribution channels.

The heat exchanger can include a compressor disposed along the fluid circuit and configured to rotate along with the first centrifugal fan and the second centrifugal fan. The compressor can be a single-screw compressor. The first rotary heat exchanger and the second rotary heat exchanger can be configured to rotate at the same speed.

Some embodiments relate to a rotary heat exchanger, including a fluid distribution baseplate including a first baseplate surface, a second baseplate surface opposite the first baseplate surface, a plurality of fluid distribution channels disposed within the fluid distribution baseplate, and a central baseplate aperture, a first plurality of centrifugal fan blades secured relative to the first baseplate surface, each of the first plurality of centrifugal fan blades including at least one fluid conduit extending into the centrifugal fan blade from the side of the centrifugal fan blade adjacent the first baseplate surface, a second plurality of centrifugal fan blades secured relative to the second baseplate surface, each of the second plurality of centrifugal fan blades including at least one fluid conduit extending into the centrifugal fan blade from the side of the centrifugal fan blade adjacent the second baseplate surface, and a compressor extending through the central baseplate aperture and configured to rotate along with the fluid distribution baseplate, the compressor disposed along a fluid circuit passing through the compressor, at least one of the first plurality of centrifugal fan blades, and at least one of the second plurality of centrifugal fan blades.

Each of the first plurality of centrifugal fan blades can include a fan blade inlet aperture in fluid communication with the at least one fluid conduit and a baseplate inlet aperture extending through the first baseplate surface, and a fan blade outlet aperture in fluid communication with the at least one fluid conduit and a baseplate outlet aperture extending through the first baseplate surface, the fan blade outlet aperture located radially outward of the fan blade inlet aperture. The at least one fluid conduit extending into the centrifugal fan blade can include a plurality of cylindrical passages separated by support struts, the support struts including a plurality of apertures extending therethrough to place adjacent cylindrical passages of the plurality of cylindrical passages in fluid communication with one another.

The fan blades can have a substantially elliptical cross-sectional shape. The first plurality of fan blades can be configured to function as an evaporator, and the second plurality of fan blades can be configured to function as a condenser.

Some embodiments relate to a rotary heat exchanger apparatus, including a first heat exchanger disposed on the a first side of a baseplate, a second heat exchanger disposed on a second side of the baseplate and configured to rotate with the first heat exchanger, and a sealed fluid circuit extending through portions of the baseplate and the first and second heat exchangers, the sealed fluid circuit having a working fluid disposed within.

The apparatus can also include a compressor, where the compressor is disposed along the sealed fluid circuit, and a motor configured to drive the compressor, where the first heat exchanger is configured to operate as an evaporator, and where the second heat exchanger is configured to operate as a condenser. The heat exchanger apparatus can be configured to transfer heat energy using a Reverse Carnot cycle. The motor can be an AC motor.

The apparatus can additionally include a turbine, where the turbine is disposed along the sealed fluid circuit, and a DC generator configured to be driven by the turbine to generate power, where the first heat exchanger is configured to operate as a condenser, and where the second heat exchanger is configured to operate as an evaporator. Portions of the second heat exchanger can be disposed radially outward of corresponding portions of the first heat exchanger. The turbine can include a single-screw turbine. The heat exchanger can be configured to generate power via an Organic Rankine cycle.

Some embodiments relate to a heat exchanger, including a first rotary heat exchanger, a second rotary heat exchanger configured to rotate in the same direction as the first rotary heat exchanger, a fluid circuit extending through at least a portion of the first rotary heat exchanger and at least a portion of the second rotary heat exchanger and configured to permit passage of a working fluid between the first and second rotary heat exchangers, and a support member supporting the first and second rotary heat exchangers and configured to separate a first airstream from a second airstream, the support member exposing the first rotary heat exchanger to a first airstream and exposing the second rotary heat exchanger to a second airstream.

The support member can include a cowling which can be moved to selectively expose the first rotary heat exchanger to one of the first or second airstream. The cowling can be moved between a first position in which the first rotary heat exchanger is exposed to the first airstream and the second rotary heat exchanger is exposed to the second airstream, and a second position in which the first rotary heat exchanger is exposed to the second airstream and the second rotary heat exchanger is exposed to the first airstream. The support member can be configured to be installed in a window.

Some embodiments relate to a power generator configured to generate power using an Organic Rankine cycle, the power generator including a rotary compressor including a first plurality of centrifugal fan blades, a rotary evaporator including a second plurality of centrifugal fan blades and configured to rotate in the same direction as the rotary compressor, a working fluid circuit extending through at least a portion of the rotary compressor and at least a portion of the rotary evaporator, and a turbine in fluid communication with the working fluid circuit, at least a portion of the turbine configured to rotate along with the rotary compressor and the rotary evaporator.

The first plurality of centrifugal fan blades can include fewer centrifugal fan blades than the second plurality of centrifugal fan blades. The first plurality of centrifugal fan blades can be smaller than the second plurality of centrifugal fan blades. The rotary compressor can be axially aligned with the rotary evaporator, and portions of the rotary compressor can be located radially inward of corresponding portions of the rotary evaporator.

Some embodiments relate to a solar power generation system, including a rotary heat exchanger, including a rotary compressor including a first plurality of centrifugal fan blades, a rotary evaporator including a second plurality of centrifugal fan blades and configured to rotate in the same direction as the rotary compressor, and a working fluid circuit extending through at least a portion of the rotary compressor and at least a portion of the rotary heat exchanger, and a turbine in fluid communication with the working fluid circuit, and a solar collector configured to concentrate sunlight on the rotary heat exchanger.

Some embodiments relate to an atmospheric condensation device, including a first rotary heat exchanger including a first plurality of centrifugal fan blades, the first plurality of centrifugal fan blades including a hydrophobic coating, a second rotary heat exchanger including a second plurality of centrifugal fan blades and configured to rotate in the same direction as the first rotary heat exchanger, and a fluid circuit extending through at least a portion of the first rotary heat exchanger and at least a portion of the second rotary heat exchanger and configured to permit passage of a working fluid between the first and second rotary heat exchangers.

BRIEF DESCRIPTION OF THE DRAWINGS

Like reference numbers and designations in the various drawings indicate like elements. Note that the relative dimensions of the figures may not be drawn to scale.

DETAILED DESCRIPTION OF THE PREFERRED EMBODIMENT

A ride-along compressor can be used in conjunction with a rotary heat exchanger to provide a sealed fluid circuit. Although certain embodiments are described herein as a heat pump, similar structures can be used in a wide variety of other applications.

Figure 1A:
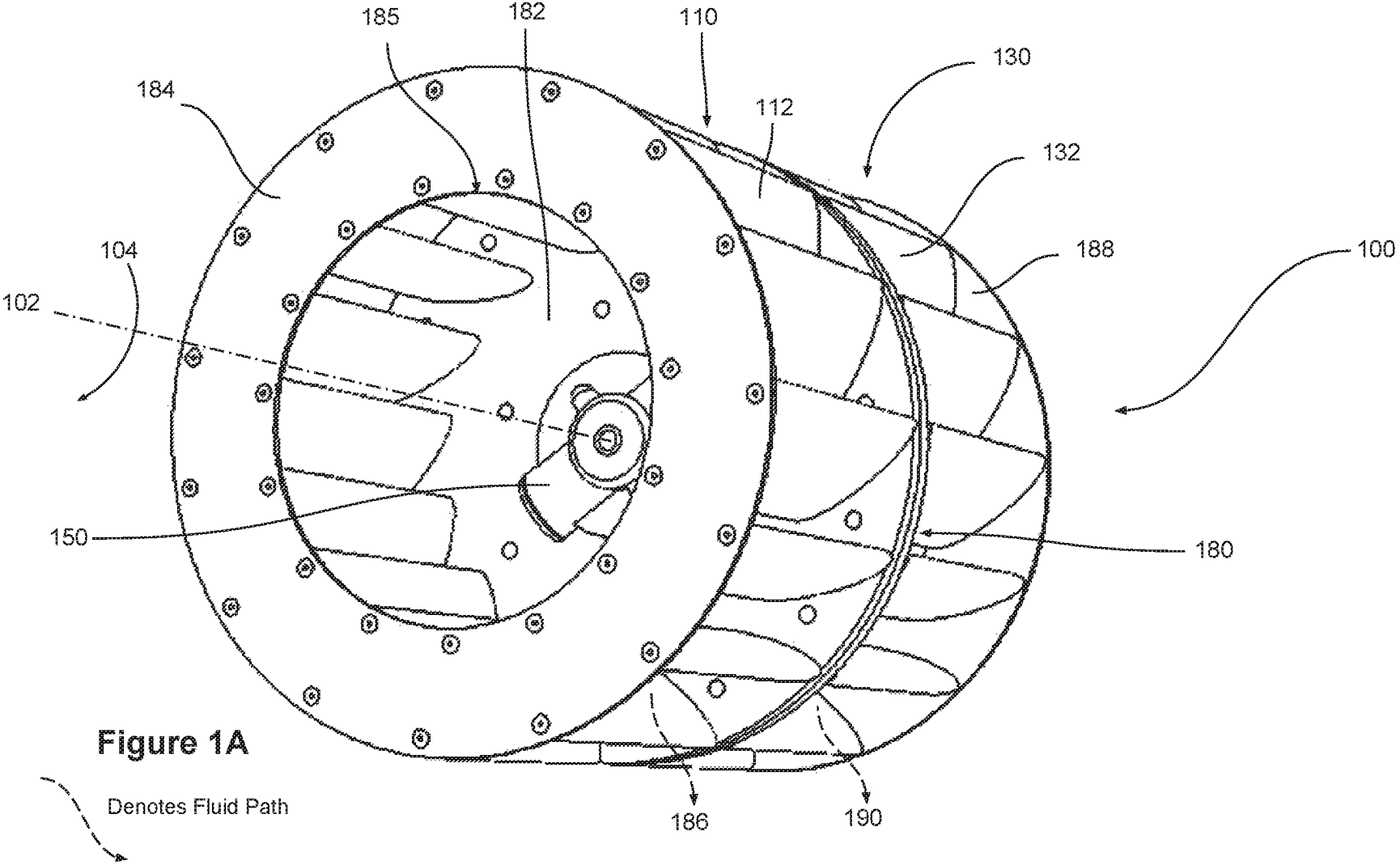
FIG. 1A is a perspective view of a rotary heat exchanger including two centrifugal fans oriented in opposite directions.
Figure 1B:
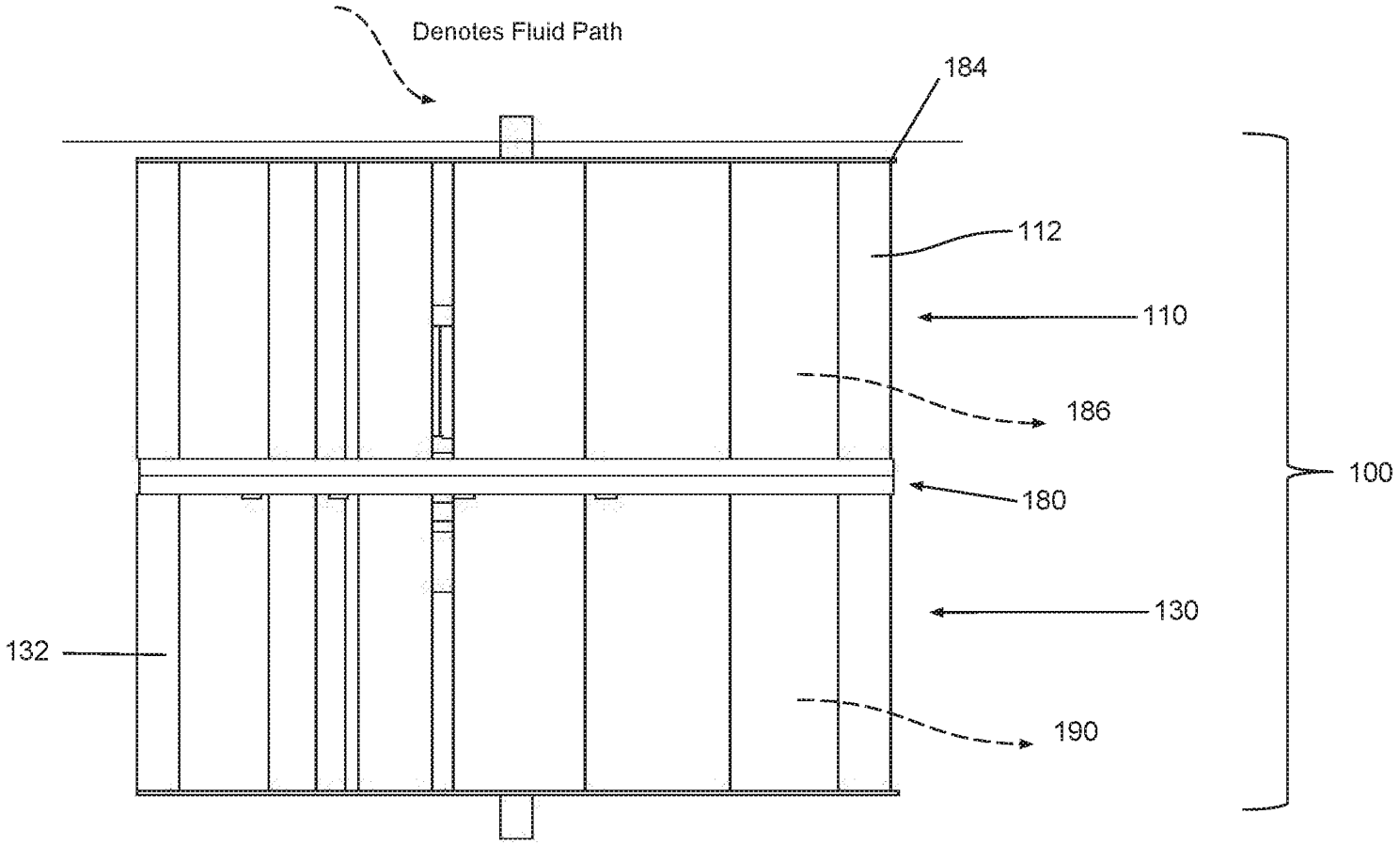
FIG. 1B is a side view of the rotary heat exchanger of FIG. 1A.

FIG. 1A is a perspective view of a rotary heat exchanger 100 including two centrifugal fans oriented in opposite directions. FIG. 1B is a side view of the rotary heat exchanger of FIG. 1A. The heat exchanger 100 includes an evaporator 110 on a first side of a baseplate 180, and a condenser 130 on a second side of the baseplate 180. A compressor 150 extends through a central aperture in the baseplate 180. In contrast to a heat exchanger system which utilizes separate radiator and fan structures, the fan blades of illustrated embodiment serve as both heat exchange surfaces and components of the fan. The centrifugal fan blades are in a constantly accelerating frame of reference with respect to the air they are moving, and therefore experience a turbulent heat exchange. The heat exchange fluid internal to the fan blades also experience turbulent effects improving their heat exchange potential. By not providing separate fan and heat exchanger structures, the heat exchange structure need not be disposed in the path of the airflow from the fan. The removal of a separate airflow-inhibiting structure can provide improved efficiency for the same amount of fan power. The radial disposition of the fan blades allows for a multi-parallel path into and out of the heat exchanger, increasing its capacity.

The evaporator 110 includes a plurality of evaporator fan blades 112 extending outward from a first surface 182 of the baseplate 180, such that the evaporator 110 functions as a centrifugal fan. The evaporator fan blades 112 extend between the first surface 182 of baseplate 180 and the facing surface of evaporator endplate 184. In the illustrated embodiment, the evaporator fan blades 112 of the evaporator 110 are elliptic cylinders, and the cross-sectional size of the evaporator fan blades 112 remains constant over the height of the fan blades.

In one embodiment, the rotary heat exchanger 100 is configured to rotate in a clockwise direction 104 (from the perspective of FIG. 1A) about axis of rotation 102. Air is pulled in along the axis of rotation 102 through the source air inlet 185 in the evaporator endplate 184 and then induced radially outward from the evaporator 110 by the evaporator fan blades 112. A stator shaft (not shown in FIG. 1A) extending along the axis of rotation 102 supports the rotary heat exchanger 100 and the connection between the stator shaft and components of the heat exchanger 100 permits rotation of the heat exchanger during operation.

The condenser 130 similarly functions as a centrifugal fan, with air drawn in along axis of rotation 102 through a sink inlet 189 in condenser endplate 188, and then pushed out by the condenser fan blades 132 radially outward from the axis of rotation 102. In the illustrated embodiment, the condenser fan blades 132 are also elliptic cylinders, and are similar in size and shape to the evaporator fan blades 112. However, in other embodiments, design parameters such as the the size, shape, positioning, and number of the condenser fan blades 112 relative to the the evaporator fan blades 132 can be modified. For instance, the capacity of the system can be altered by changing the size, quantity, length, and inclination of the fan blades on either the condenser or evaporator side of the system.

Figure 2:
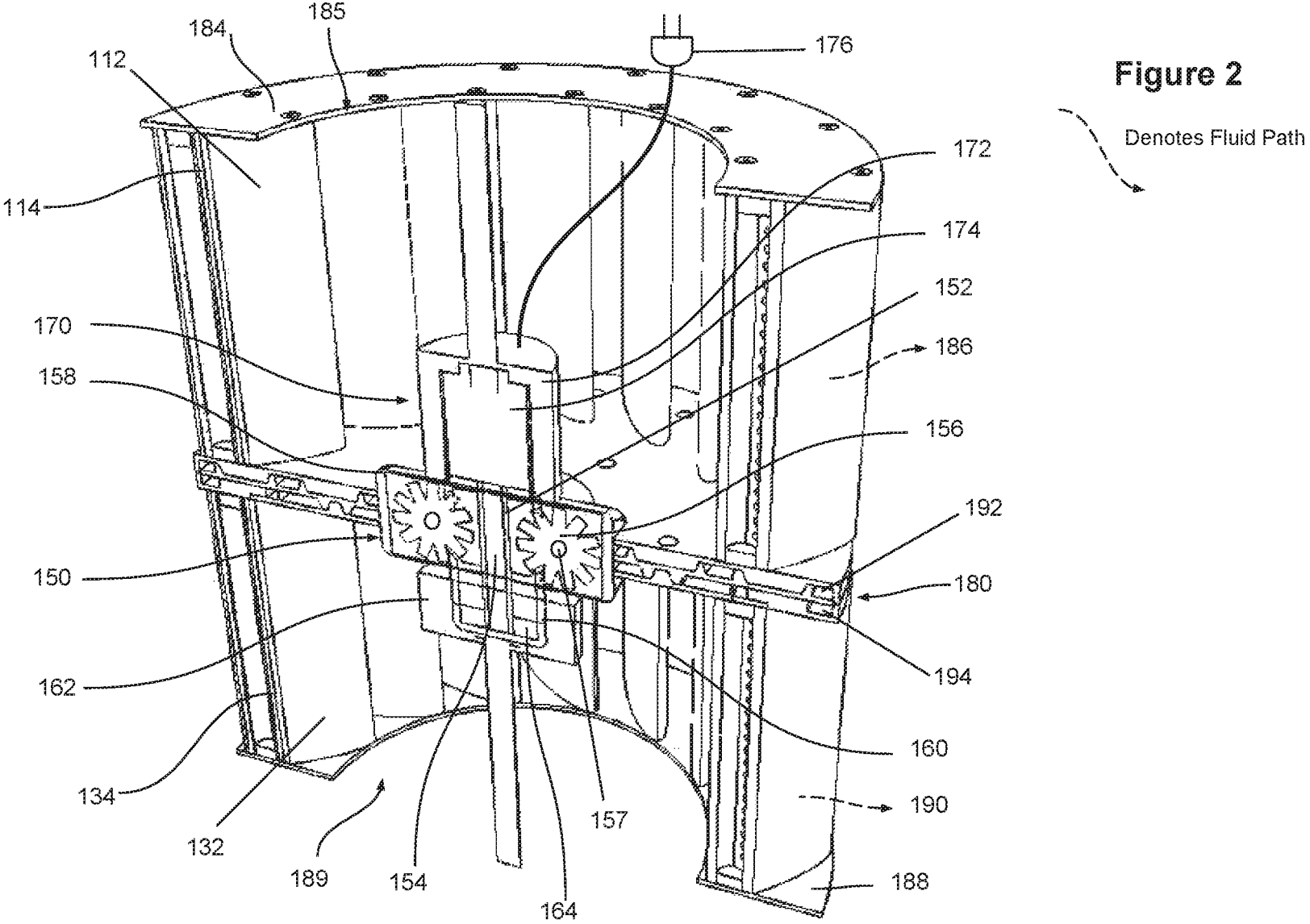
FIG. 2 is a perspective cross-sectional view of the rotary heat exchanger of FIG. 1A, along a plane 2-2 of FIG. 1B, bisecting and parallel with the stator shaft.

FIG. 2 is a perspective cross-sectional view of the rotary heat exchanger of FIG. 1A, along a plane 2-2 of FIG. 1B, bisecting and parallel with the stator shaft. The compressor 150 can be a single-screw compressor or other appropriate compressor, and may include a main screw gear rotor which acts as a stator, referred to herein as a main screw stator 152. The main screw stator 152 is connected to a main stator shaft 154. Two planetary gate rotors 156 supported by planetary rotor shafts 157 are configured to rotate around the main screw stator 152 when the compressor 150 is driven. Casing 158 serves as a rotor, and is secured relative to the baseplate 180, such that movement of the casing 158 induces rotation of the heat exchanger 100 and operation of the evaporator 110 and condenser 130 as centrifugal fans.

In some embodiments, other types of vapor compressors may be used, which may be hub-mounted in a similar fashion. These other compressor types may include, but are not limited to, twin-screw compressors, scroll compressors, or other non-positive displacement type compressors such as a turbine. In some embodiments, the compressor may be stationary and dislocated from the rotary heat exchanger, instead of being a ride-along or hub-mounted compressor. In such embodiments, fluid may be transferred to and from the rotating portions of the heat exchanger through a rotating union or other suitable structure for providing fluid communication between a first component rotating relative to a second component. In some particular embodiments, this rotating union could be of a double passage type, or two single-passage rotary unions could be used to transfer working fluid, such as return and supply vapor, to a compressor of any type.

A magnetic linkage 160 is made between an external stator 162 and an internal magnetic stator 164 which can be an extension of or rigidly coupled to the main stator shaft 154 or the main screw stator 152. A portion of the casing 158 extends between the external stator 162 and the internal magnetic stator 164, and is permitted to rotate freely during operation of the compressor 150, as the magnetic linkage 160 does not require a direct mechanical connection between the external stator 162 and the internal magnetic stator 164. Other embodiments include passing stator shaft 154 seen later in FIG. 15 through a rotating or sliding seal to a fixed or mechanically-grounded support in order to hold the stator parts of the system stationary. In such embodiments, a magnetic stator linkage 160 may not be necessary.

A motor 170, such as an AC or DC motor, includes a stator 172 and a rotor 174. The motor 170 can be disposed on the opposite side of the main screw stator 152 as the magnetic linkage 160, and can be driven to rotate the casing 158 along with the remainder of the rotary heat exchanger 100 relative to the main screw stator 152. In an operation in which the rotary heat exchanger is used as part of a heating, ventilating, and air conditioning (HVAC) system, the motor 170 can be an AC motor, and can be operated in the range of 1,000 to 3,000 rpm, although higher or lower speeds may be used in other embodiments. For other purposes, such as when the heat exchanger 100 is being operated as a power generator converting heat energy to electric energy, a DC generator may be used, and can be operated at higher speeds, such as speeds in the range of 4,000 to 5,000 rpm.

Other embodiments may include an offset motor that drives the rotary heat exchanger in the same fashion, but is not mounted along axis 102 shown in FIG. 1. Offset motors in such alternate embodiments could be linked to the heat exchanger through a drive belt, gears, magnetic, hydraulic, pneumatic or any other suitable linkage type.

It can also be seen in FIG. 2 that the evaporator blades 112 include at least one interior cavity 114, and that the condenser blades 132 similarly include at least one interior cavity 134. The interior cavities 114 and 134 of the evaporator blades 112 and the condenser blades 132 form a part of a fluid circuit extending through various components of the heat exchanger 100. The interior cavities 114 of the evaporator blades 112 are in fluid communication with at least one of a plurality of evaporator distribution channels 192 in the baseplate 180. Similarly, the interior cavities 134 of the condenser blades 132 are in fluid communication with at least one of a plurality of condenser distribution channels 194 in the baseplate 180. In the illustrated embodiment, the baseplate may include at least three component plates, as described below in greater detail with respect to FIGS. 5A through 8B, with the facing surfaces of one adjacent pair of component plates at least partially defining the evaporator distribution channels 192 and the facing surfaces of another adjacent pair of component plates at least partially defining the condenser distribution channels 194.

Figure 12:
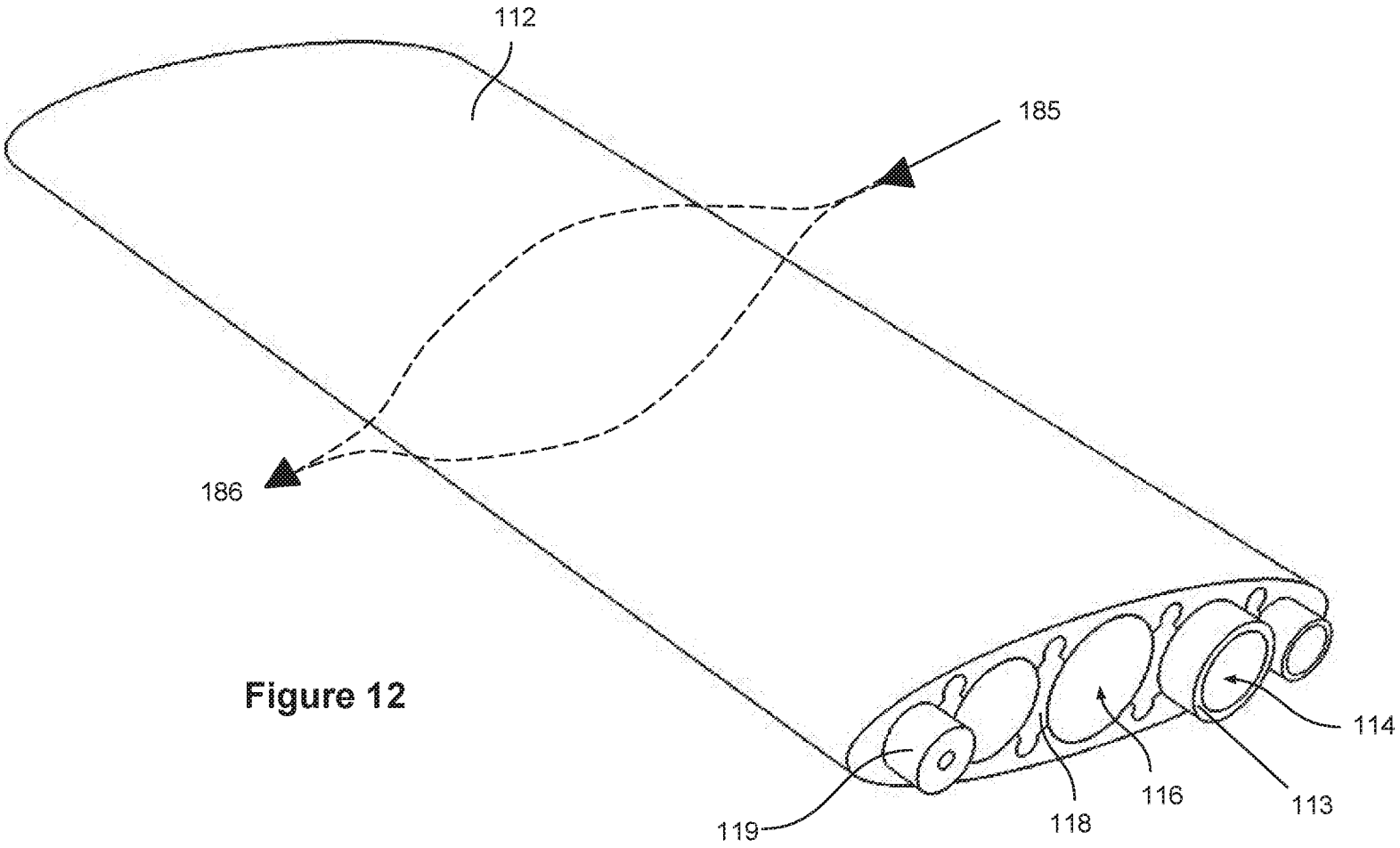
FIG. 12 is a perspective view of a second configuration of a fan blade of the rotary heat exchanger of FIG. 1A, illustrating air flow over the fan blade.

The fluid circuit extending throughout the rotary heat exchanger 100 also passes through the compressor 150, and an expansion valve shown in FIG. 12. Because a portion of the compressor 150 rotates along with the evaporator 110 and condenser 130 of the heat exchanger 100, the fluid circuit may be completely sealed despite the rotation of the heat exchanger. The sealed fluid circuit can eliminate the need for sealed rotary unions or other fluid connections at points of relative motion between two components, which can often be points of wear and/or failure.

The fluid circuit may be filled with a two-phase working fluid which will undergo phase changes in the evaporator 110 and the condenser 130, and which can be used to transfer heat from the evaporator 110 to the condenser 130. Examples of suitable working fluids include, but are not limited to R-134a, R-550a, and R-513a, although a wide variety of other working fluids may also be used.

Figure 3:
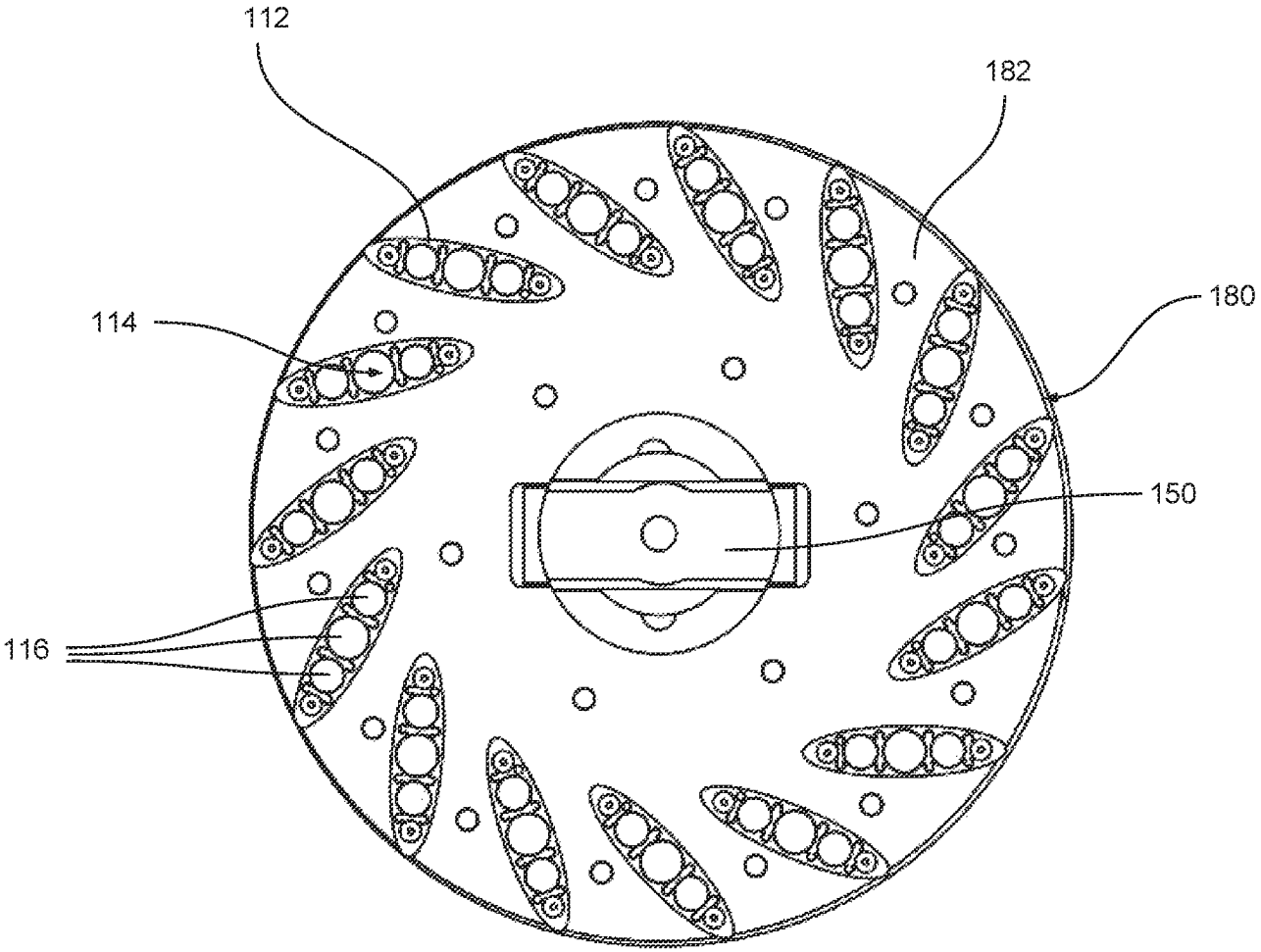
FIG. 3 is a top cross-sectional view of the rotary heat exchanger of FIG. 1A, taken along a plane 3-3 of FIG. 1B, orthogonal to the stator shaft.

FIG. 3 is a top cross-sectional view of the rotary heat exchanger of FIG. 1A, taken along a plane 3-3 of FIG. 1B, orthogonal to the stator shaft. In particular, it can be seen that the interior cavities 114 of the evaporator blades 112 in the illustrated embodiment include a plurality of cylindrical bores 116 separated by perforated struts 118. The perforated struts 118 provide rigidity to the hollow structure of the evaporator blades 112 while permitting the cylindrical bores to remain in fluid communication with one another. As discussed in greater detail below, the ends of certain of the cylindrical bores 116 may be plugged, leaving others open to serve as inlet and outlet apertures into the interior cavities 114 of the evaporator blades 112.

Figure 22A:
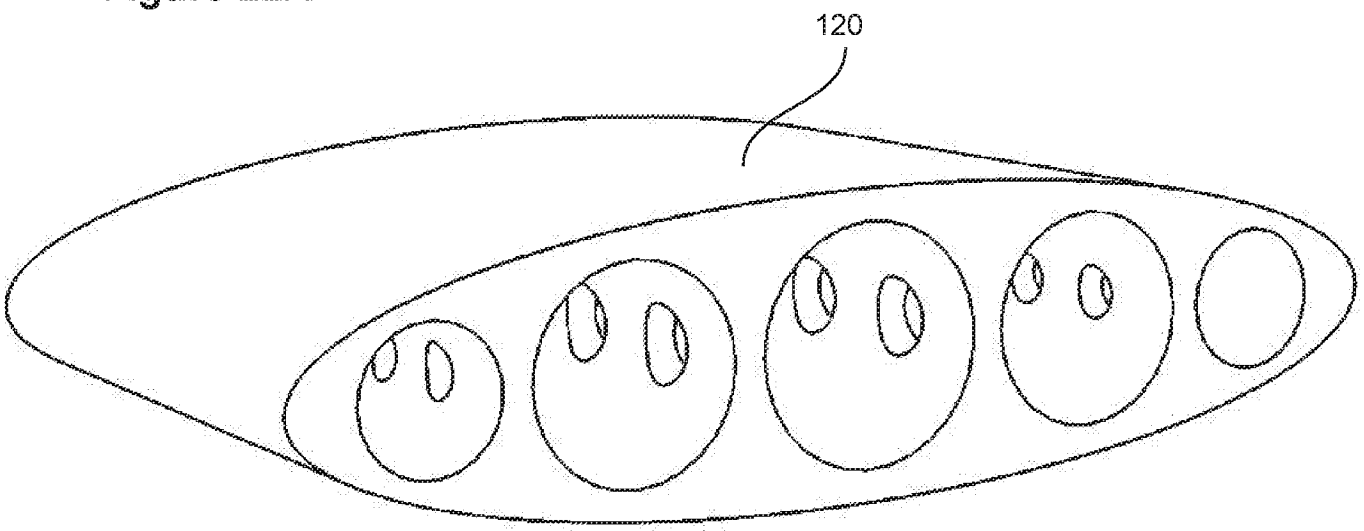
FIG. 22A is a perspective view of a single-piece, hollow evaporator-side or condenser-side fan blade heat exchanger.
Figure 22B:
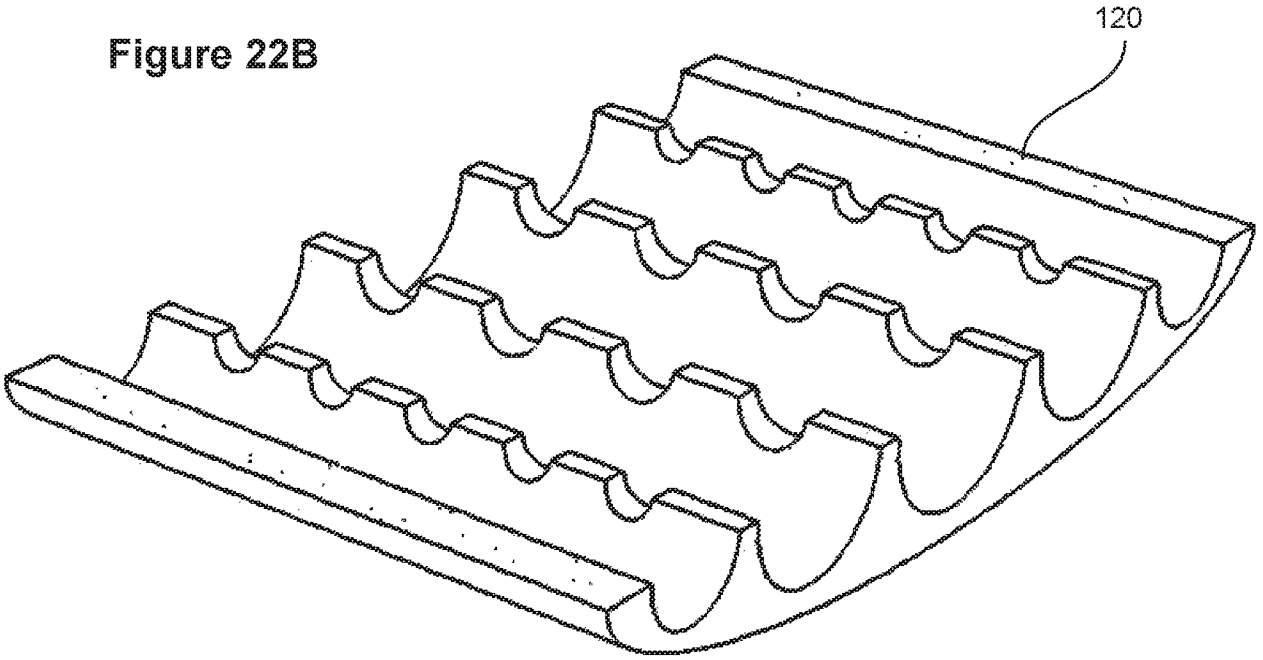
FIG. 22B is a perspective cross-sectional view of a single-piece, hollow evaporator-side or condenser-side fan blade heat exchanger.

In alternative embodiments include different methods of manufacture of the wing and/or any internal support structures may be used, including a single-piece single-piece evaporator or condenser fan blade such as a blade shown in FIG. 22A-22B. In such embodiments, the fluid conduits along condenser wing vapor path 222 shown in FIG. 11A or evaporator wing liquid/vapor path 202 shown in FIG. 14A may be drilled or punched in a unitary wing structure. In some embodiments, the wing could contain no distinct internal support structures. In another embodiment, one or more internal wing support structures could be formed or installed perpendicular to the support structures of the embodiment of FIG. 3, along or parallel to a chord extending across the widest part of the fan blade cross-section.

Figure 4:
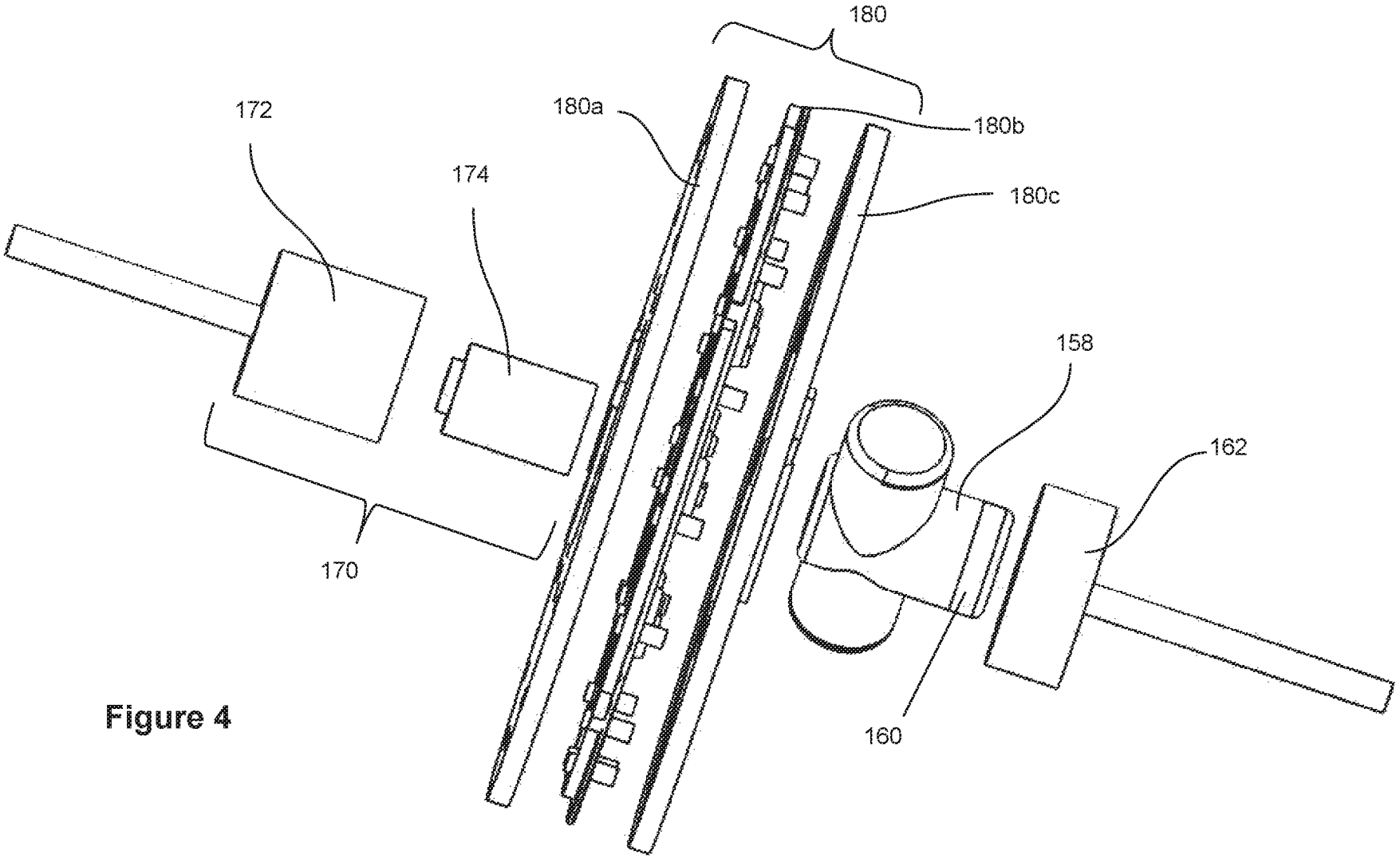
FIG. 4 is an exploded assembly view of the baseplate, motor, compressor and associated components of the rotary heat exchanger of FIG. 1A.

FIG. 4 is an exploded assembly view of the baseplate, motor, compressor and associated components of the rotary heat exchanger of FIG. 1A. In the illustrated embodiment, the baseplate 180 includes three plates joined together: an evaporator-side component plate 180*a*, a central component plate 180*b*, and a condenser-side component plate 180*c*. The condenser-side component plate 180*c* and the evaporator-side component plate 180*a* include a plurality of apertures extending therethrough (see FIGS. 5A-8B) which are configured to be aligned with the inputs and outputs of the fan blades adjacent the condenser-side component plate 180*c* and the evaporator-side component plate 180*a*, respectively. Certain embodiments of the apertures will place the interior cavities of the fan blades in fluid communication with a distribution channel on the same side of the central component plate 180*b* as those fan blades. In addition, apertures in central component plate 180*b* can place the interior cavities of fan blades in fluid communication with distribution channels on the opposite side of the central component plate 180*b* as those fan blades.

When assembled, the widest portion of the compressor casing 158 will extend through central apertures in the evaporator-side component plate 180*a*, the central component plate 180*b*, and the condenser-side component plate 180*c*. The rotor 174 of motor 170 can be secured relative to the casing 158, such that rotation of the rotor 174 induces movement of the casing 158 relative to the main screw stator 152 (not shown). The magnetic linkage 160 permits rotation of the casing 158 relative to the external stator 162 and the stator shaft extending therefrom. At least because the cross-sectional shape of the widest part of casing 158 is non-circular in the plane of the baseplate 180, the rotation of the casing 158 induces rotation of the baseplate 180 and the evaporator 110 and condenser 130 (see FIG. 1A) supported by the baseplate 180, while the stator 172 of the motor 170 and the stator linkage 160 remain static.

Figure 5A:
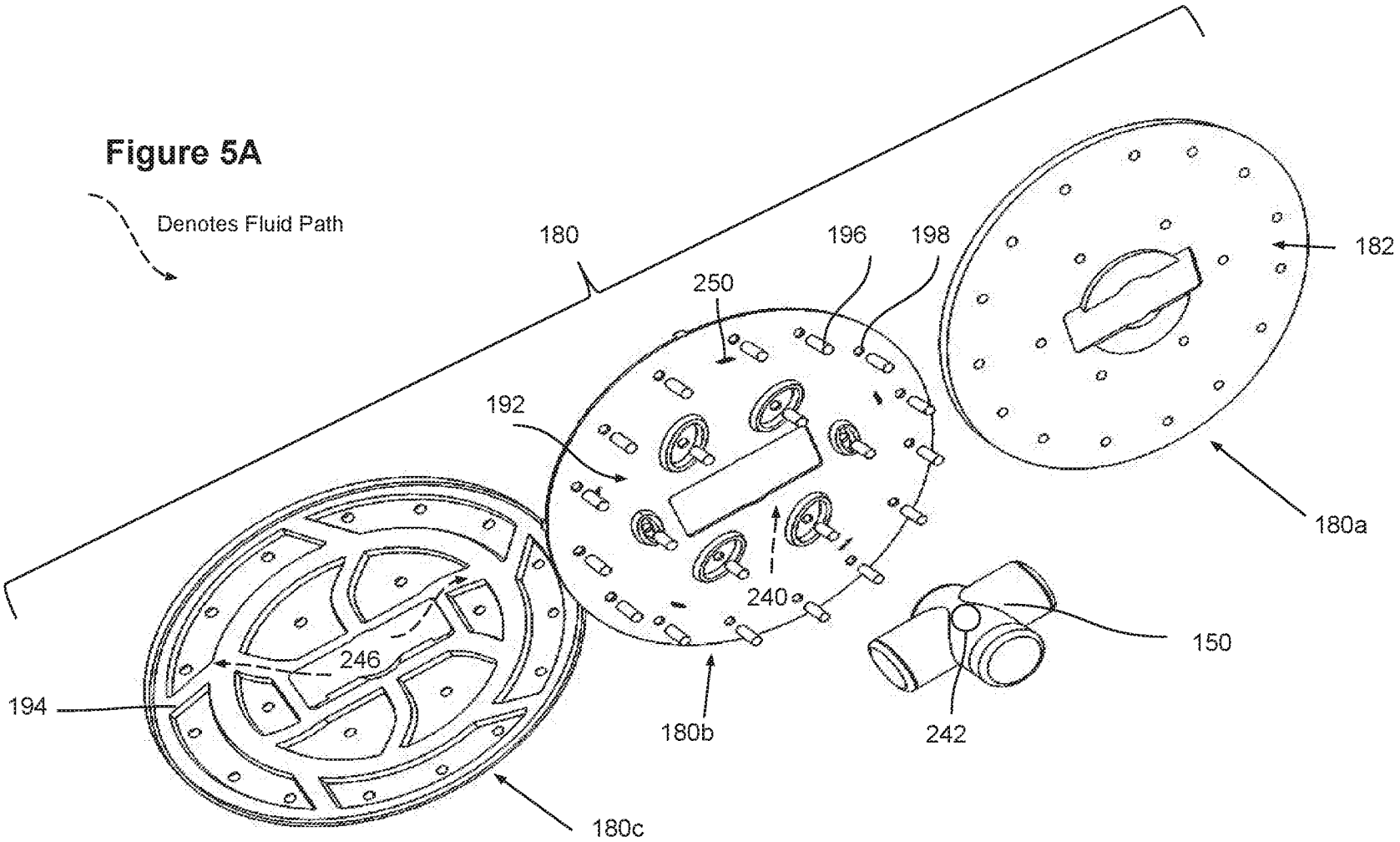
FIG. 5A is an exploded assembly view of the components of the fluid distribution baseplate of FIG. 1A.

FIG. 5A is an exploded assembly view of the components of the fluid distribution baseplate of FIG. 1A, showing an evaporator-side component plate 180*a*, a central component plate 180*b*, and a condenser-side component plate 180*c*, viewed from the evaporator-side. Baseplate 180 will be joined together by a plurality of plate joining pins 196 passing through a plurality of plate joining holes 198. In other embodiments, other joining techniques could be used to join the three part baseplate together, including welding, bonding, brazing, threads, or other joining methods. Other embodiments may include a one-piece baseplate with internal fluid conduits made by other methods such as 3d printing, casting, molding, or other methods. The compressor casing return port 242, in compressor 150, will be in fluid communication with plate vapor return path 240. Plate vapor return path 240 acts as a conduit for fluid transfer between evaporator-side wing conduit 117 shown later in FIG. 13, and the suction side of the compressor, casing return port 242. Plate vapor return path 240 is contained entirely between central component plate 180*b* and evaporator component plate 180*a*. Multiple fluid paths 240 combined with make up a plurality of vapor distribution channels 192. In similar fashion, plate vapor supply path 246 transits a plurality of condenser distribution channels 194. Plate liquid supply port 250 allows for the transfer of liquid-phase fluid through central component plate 180*b*, from the condenser-side to the evaporator-side of the system. Other fluid distribution conduits and paths are possible in other embodiments that satisfy the same general fluid flow requirements of the system.

Figure 5B:
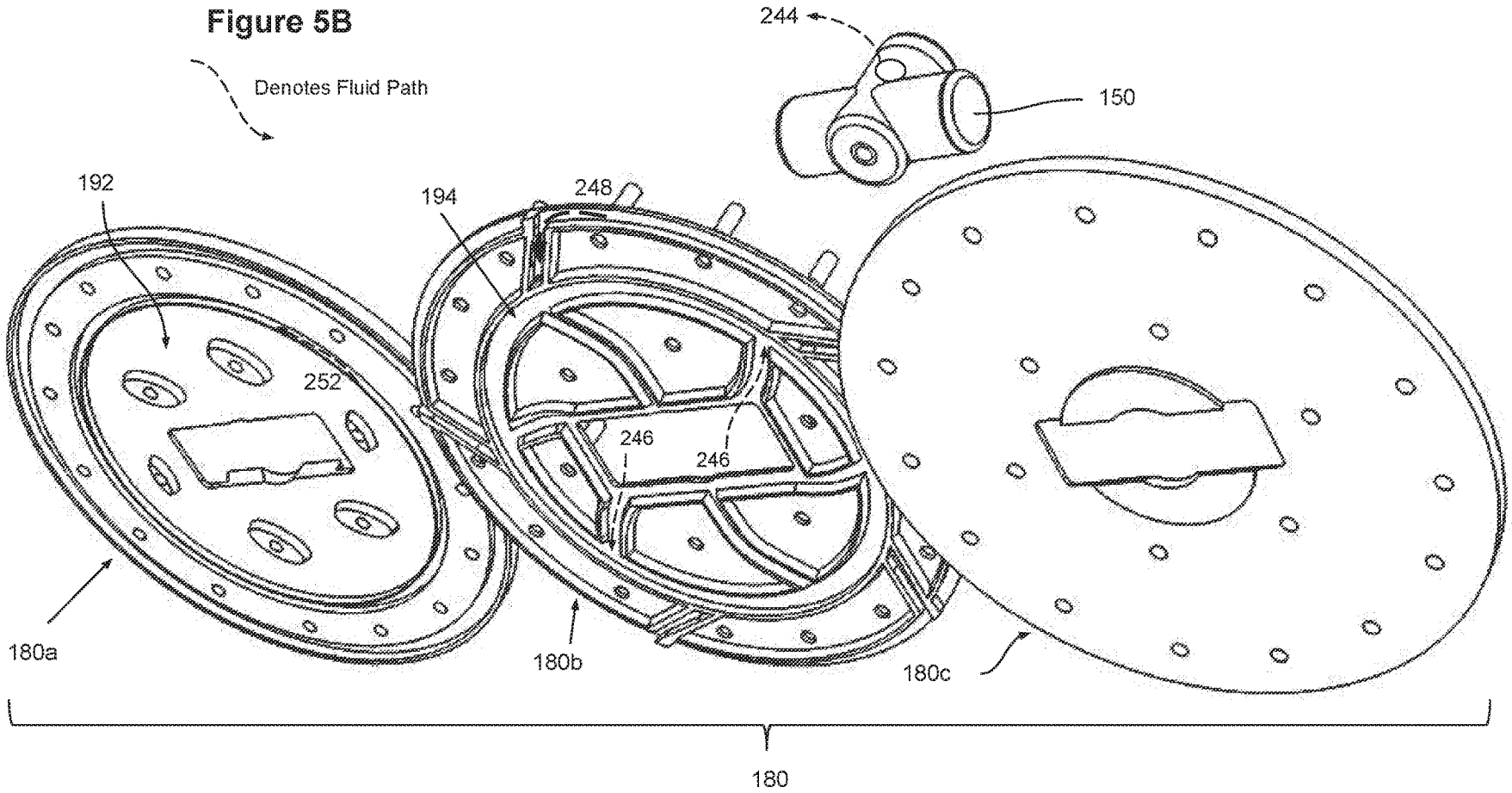
FIG. 5B is another exploded assembly view of the components of FIG. 5A.
Figure 6A:
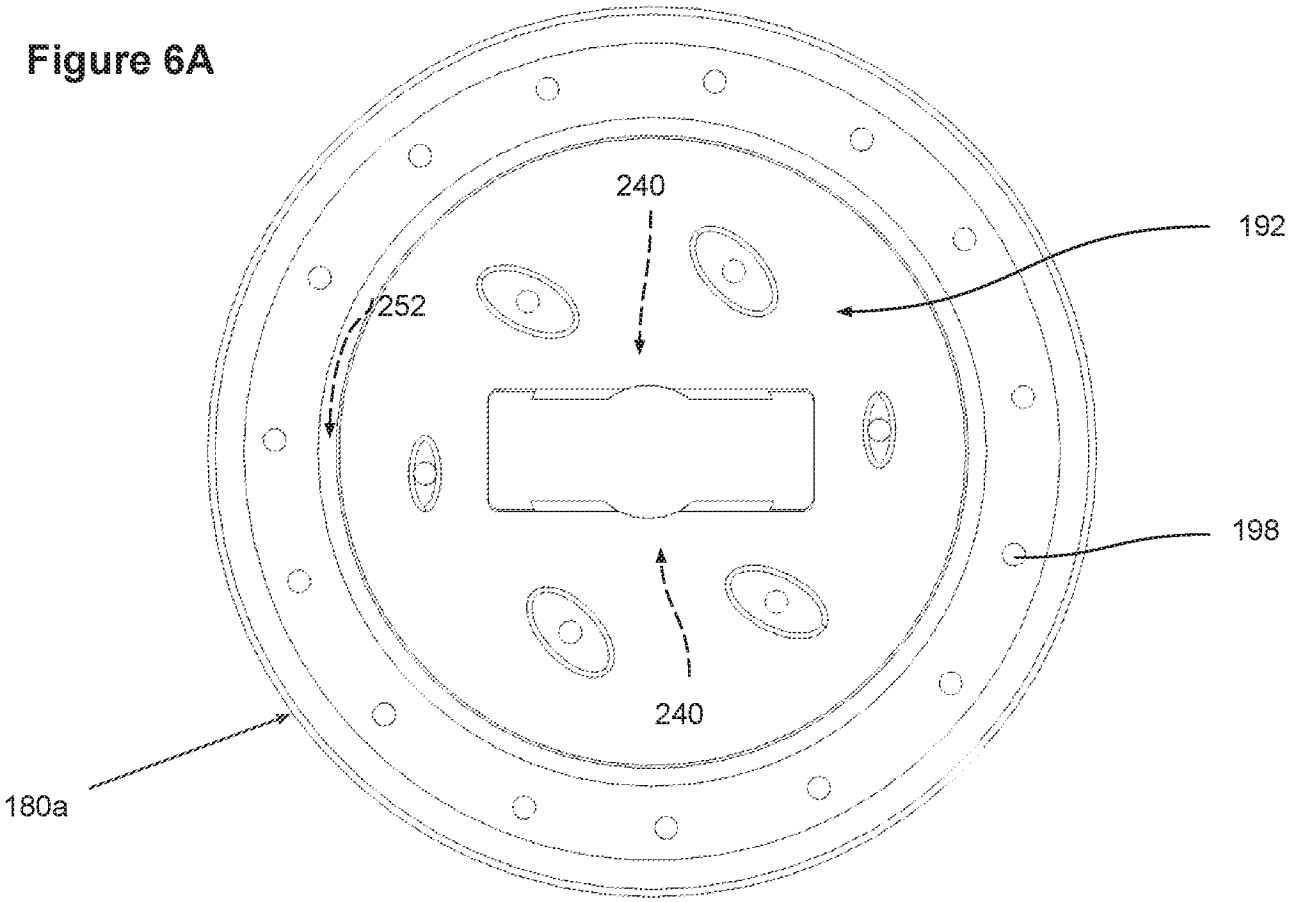
FIG. 6A is a top plan view of the upper baseplate component of FIG. 5A.
Figure 6B:
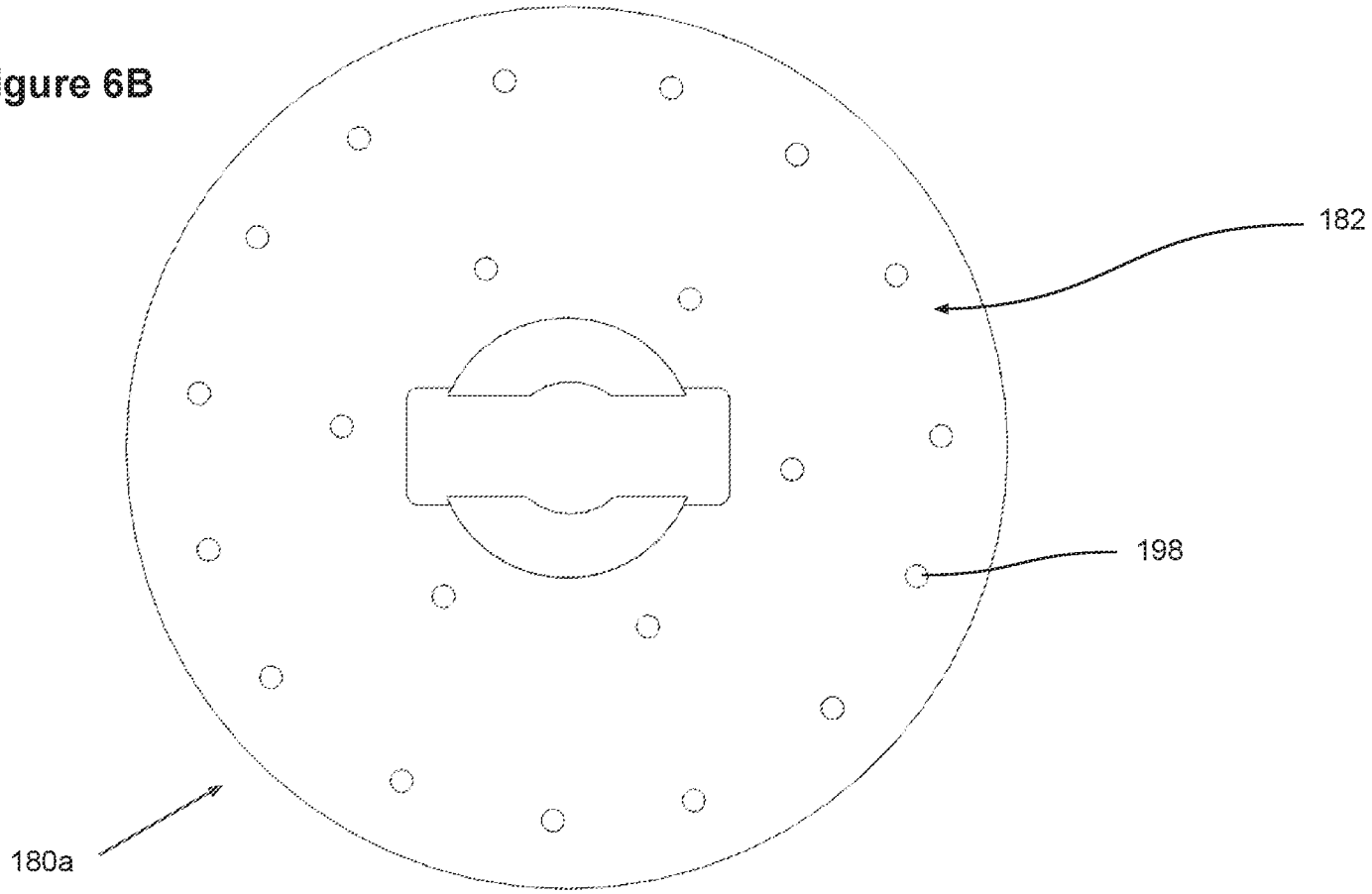
FIG. 6B is a bottom plan view of the upper baseplate component.
Figure 7A:
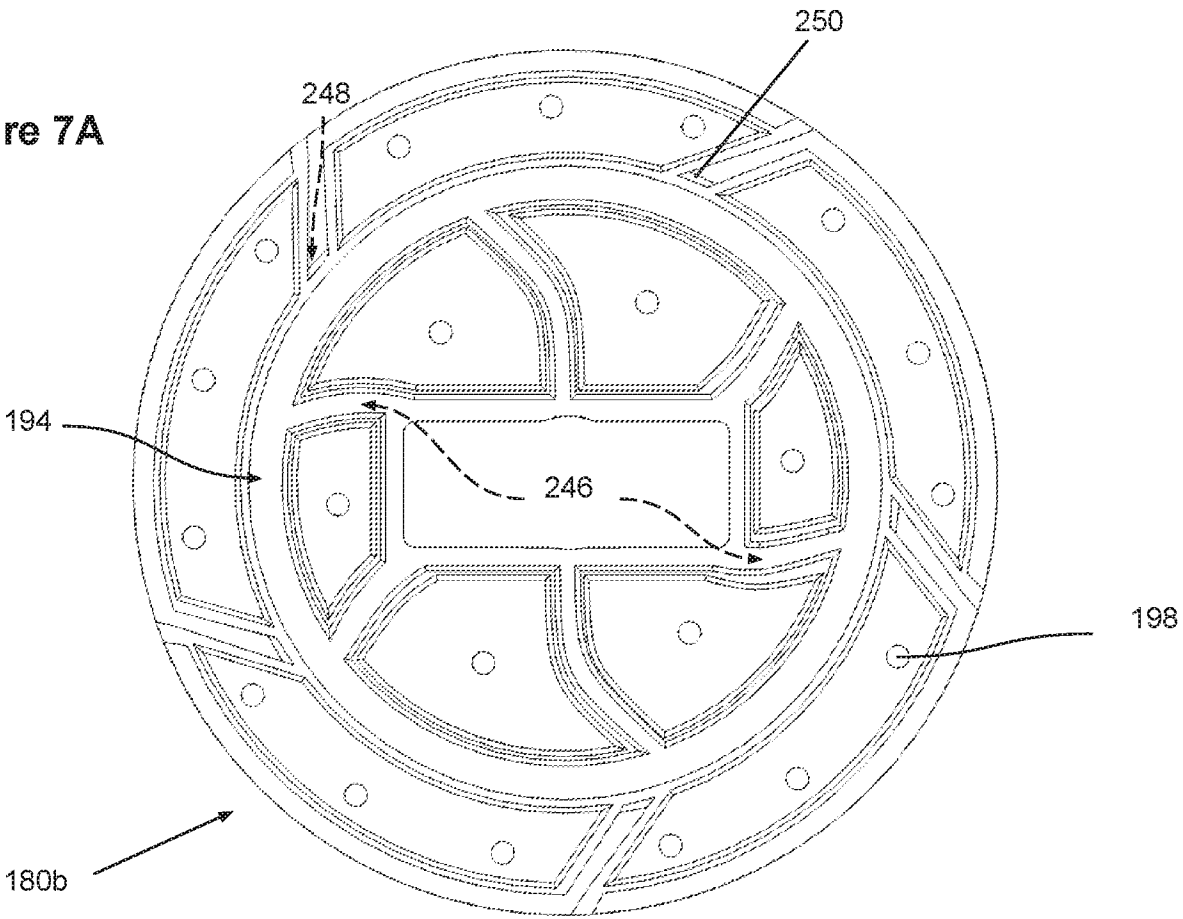
FIG. 7A is a top plan view of the middle baseplate component of FIG. 5A.
Figure 7B:
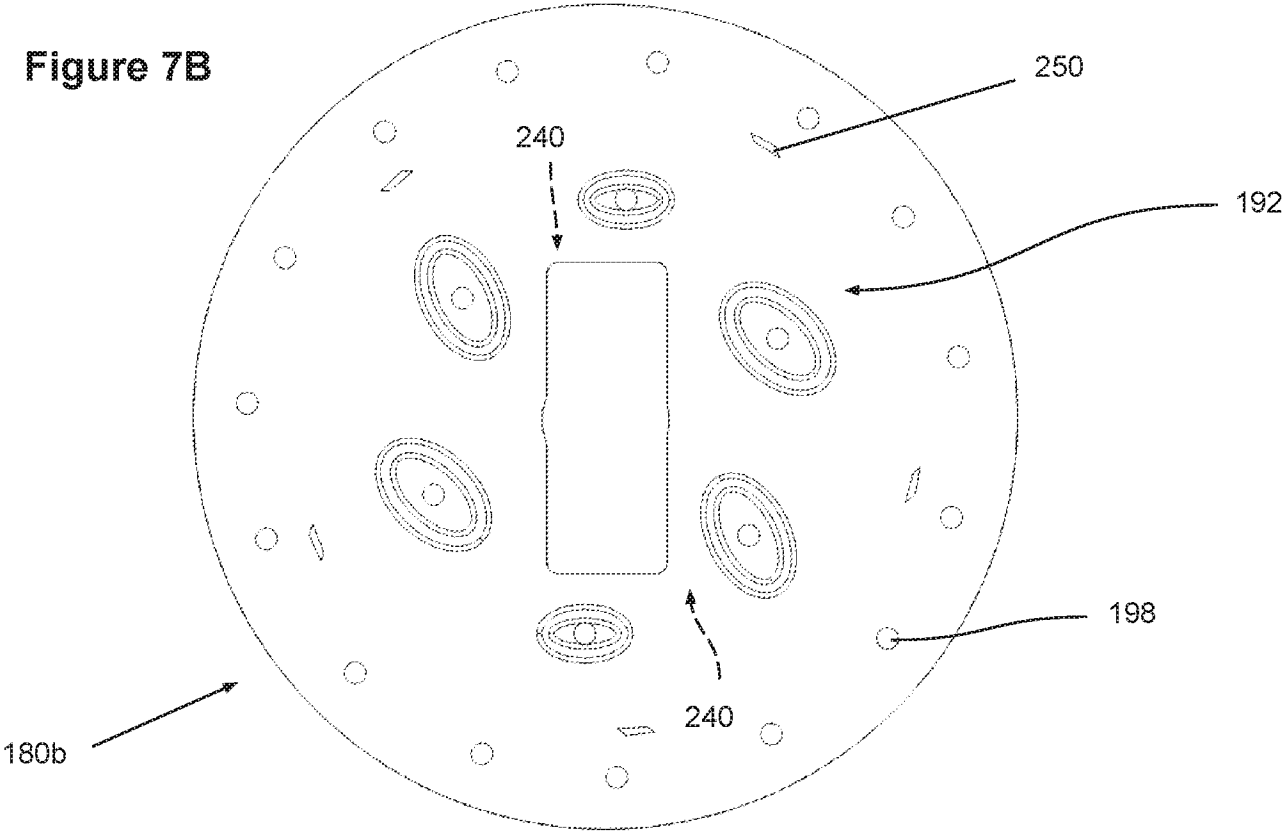
FIG. 7B is a bottom plan view of the middle baseplate component.
Figure 8A:
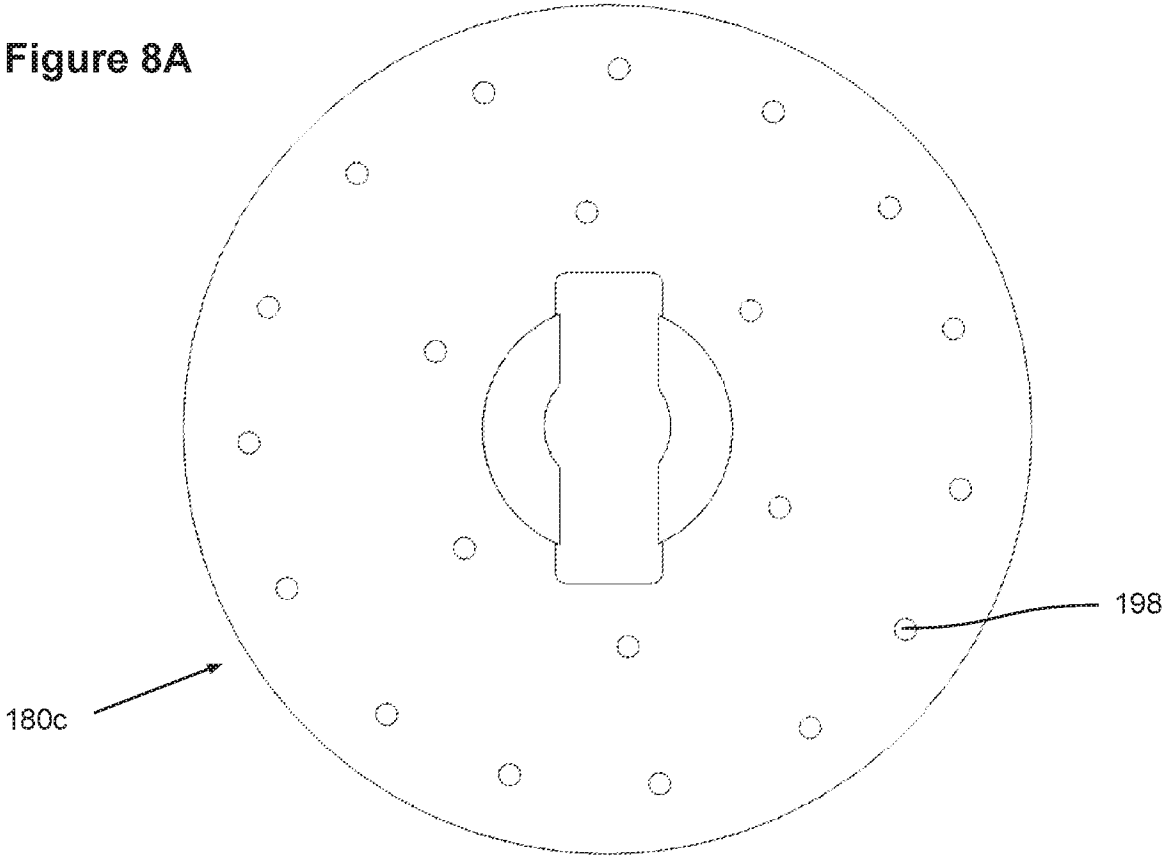
FIG. 8A is a top plan view of the lower baseplate component of FIG. 5A.
Figure 8B:
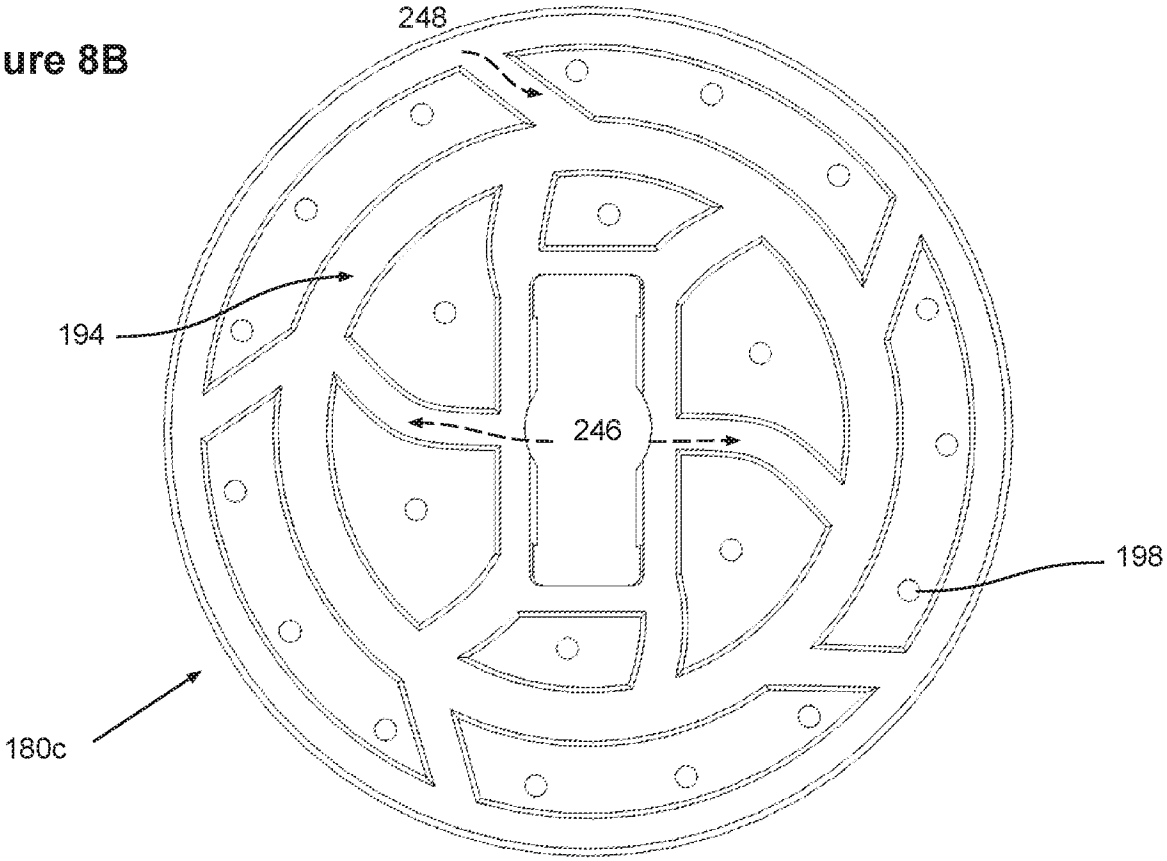
FIG. 8B is a bottom plan view of the middle baseplate component.

FIG. 5B is another exploded assembly view of the components of FIG. 1A, showing condenser-side component plate 180*a*, a central component plate 180*b*, and a condenser-side component plate 180*c* viewed from the condenser-side. Compressor casing supply port 244, in compressor 150, will be in fluid communication with plate vapor supply paths 246. Plate vapor supply path 246 is contained entirely between central component plate 180*b* and condenser component plate 180*c* and allows for fluid communication between compressor casing supply port 244 and condenser-side wing conduit 117 shown later in FIG. 10. Plate liquid supply path 248 allows liquid-phase working fluid to flow through plate liquid supply port 250 and into plate liquid supply channel 252 on the evaporator side of the system. A plurality of evaporator distribution channels 192 allow for gas-phase working fluid to flow from the evaporator-side heat exchanger 110 into the compressor 150 through compressor casing return port 242.

Figure 9:
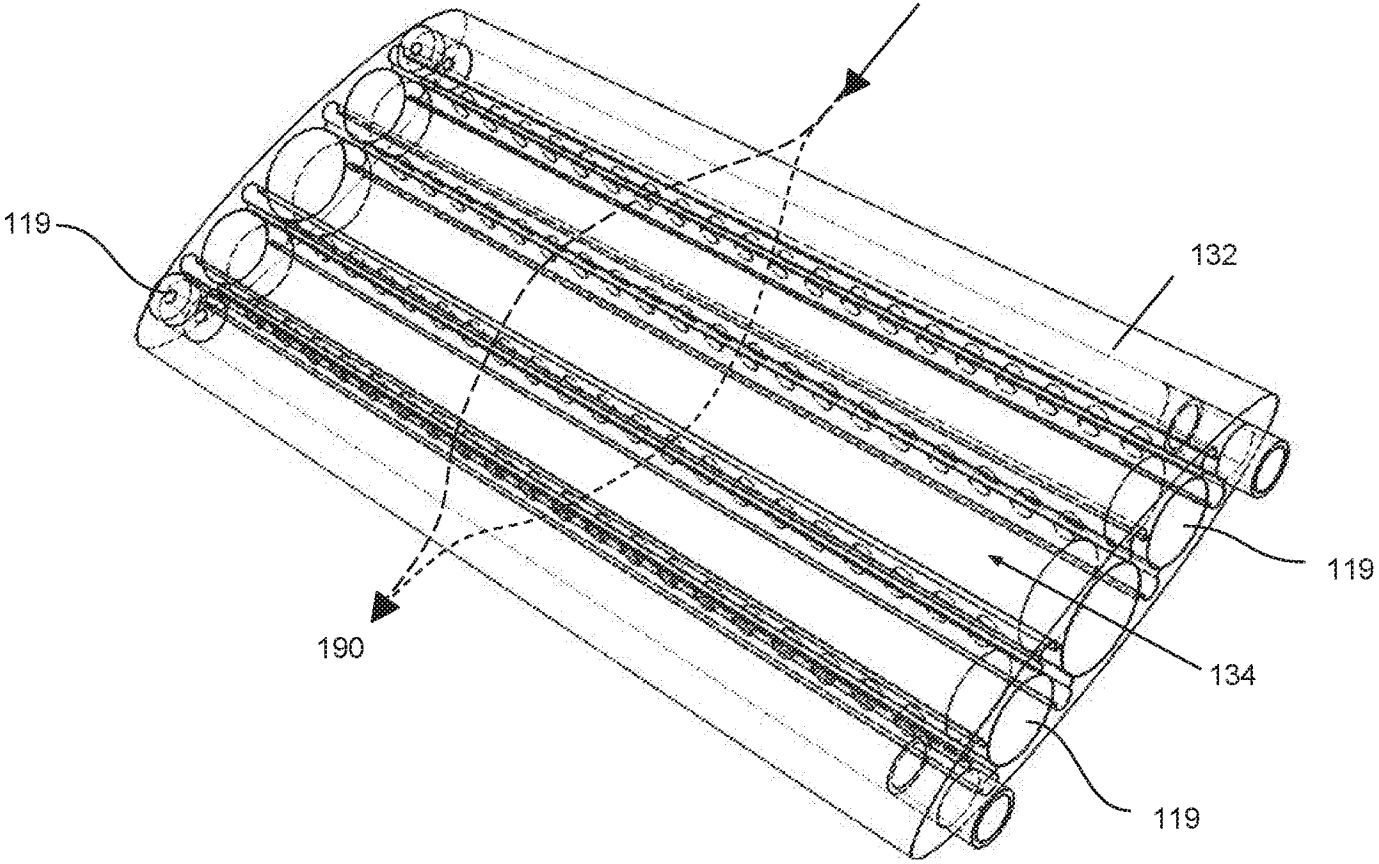
FIG. 9 is a perspective view of a first configuration of a fan blade of the rotary heat exchanger of FIG. 1A, illustrating air flow over the fan blade.

FIG. 9 is a perspective view of a first configuration of a condenser fan blade 132 of the rotary heat exchanger 130 of FIG. 1A, illustrating inlet air flow 189 and outlet air flow 190 over the fan blade 132. Given the five different internal cavities 134, many different configurations are possible between wing mounts 119 and wing conduits 117 and wing plugs 115. Wing mount 119 generates a clamping force between the baseplates 180*a*, 180*b*, and 180*c* and also holds the wing itself into the baseplate, and may contain additionally either a wing conduit 117 or a wing plug 115. This construction is beneficial in that by using the wing mount 119 as the female nut for the joining of the plates together instead of using an additional nut to provide the clamping force of the plate and an additional method to secure the wing to the plate itself. Wing conduit 117 may pass through a plate joining hole 198 and thus resist centrifugal forces, acting as a sort of wing mount, although containing no plate joining pins 196. Air-side heat exchange takes place on the surface of condenser fan blade 132, as air passes over the wing from fluid path 189 to 190. The fan blade 132 includes an internal cavity 134 including plurality of cylindrical bores 136. Each cylindrical bore 136 is separated from the adjacent cylindrical bores 136 via perforated struts 118 (see FIG. 10), which permit fluid communication between adjacent cylindrical bores 136. In the illustrated embodiment, the fan blade 132 includes five cylindrical bores 136, which are cylindrical in shape with increasing cross-sectional diameters nearer the thicker center portion of the blade. In other embodiments, other numbers, shapes, and sizes of internal cavities may also be used. In other embodiments, the wing may be secured to the plate using a bolt separate from the plate joining pins 196, or by another joining method including brazing, welding, bonding, flaring, riveting, or any other method. Another embodiment includes securing the wings to the plate by method of flaring fluid conduit 117 after it is installed in the plate, effectively sealing the fluid conduit to fluid pressure and mechanically securing it to the plate. Sealing the fluid conduit 117, seen in FIG. 10, with respect to pressure to the baseplate 180 can be accomplished using an O-ring, a compression fitting, a flaring of the conduit itself as described above, brazing, bonding, shrink-fitting, or any other applicable method of pressure sealing.

Figure 10:
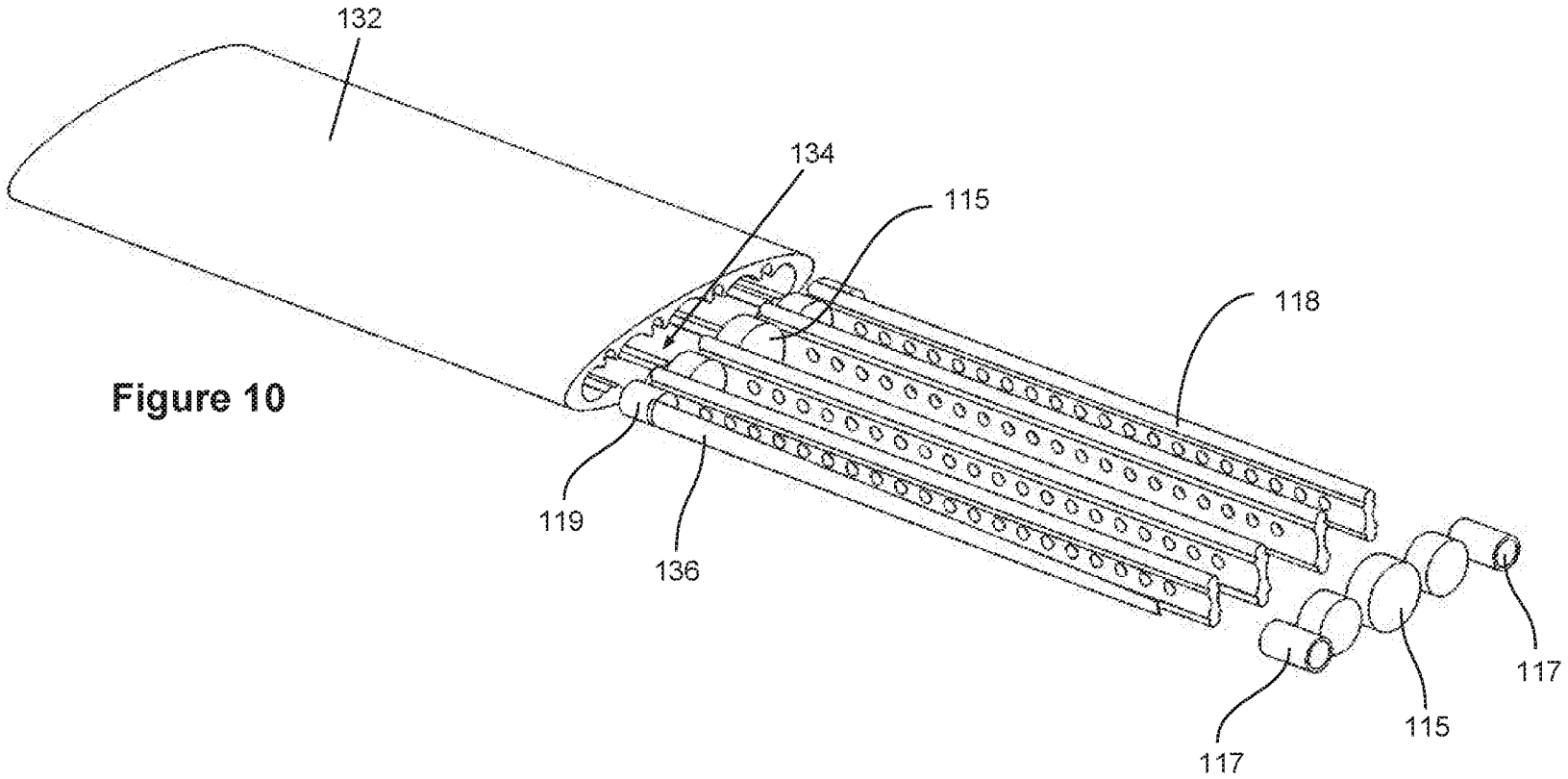
FIG. 10 is a perspective exploded assembly view of the fan blade of FIG. 9.

FIG. 10 is an exploded view of a condenser-side hollow fan blade 132, showing perforated struts 118. Also visible are wing plugs 115, wing mounts 119, and wing conduits 117. Perforated struts 118 can be slid into condenser-side hollow fan blade 132 in order to structurally support the resultant pressure vessel. Perforated struts 118 may be bonded, brazed, welded, or otherwise joined to the fan blade 132, or may simply be mated with corresponding slots in the fan blade 132 with no additional joining method. An angled surface provided by condenser ramp 136 aids liquid fluid transport out of the wing through wing conduit 117 toward fluid path 248 via centrifugal acceleration. In an alternate embodiment, the condenser fan blades or the cylindrical bores may be canted relative to the plane of the supporting baseplate to provide an angled surface for returning liquid fluid along path 224, instead of using a discrete condenser ramp 136, so that the trailing edge of the blade is inclined in the same direction as condenser ramp 136.

As discussed above, this embodiment combines a heat exchange apparatus and a fan apparatus into the same component. With heat exchange taking place on the surface of the fan blades, there is no need for an additional heat exchanger, which would inhibit the air flow. Fan blade heat exchangers also reduce fouling, thus increasing the efficacy of the heat exchanger.

Figure 11A:
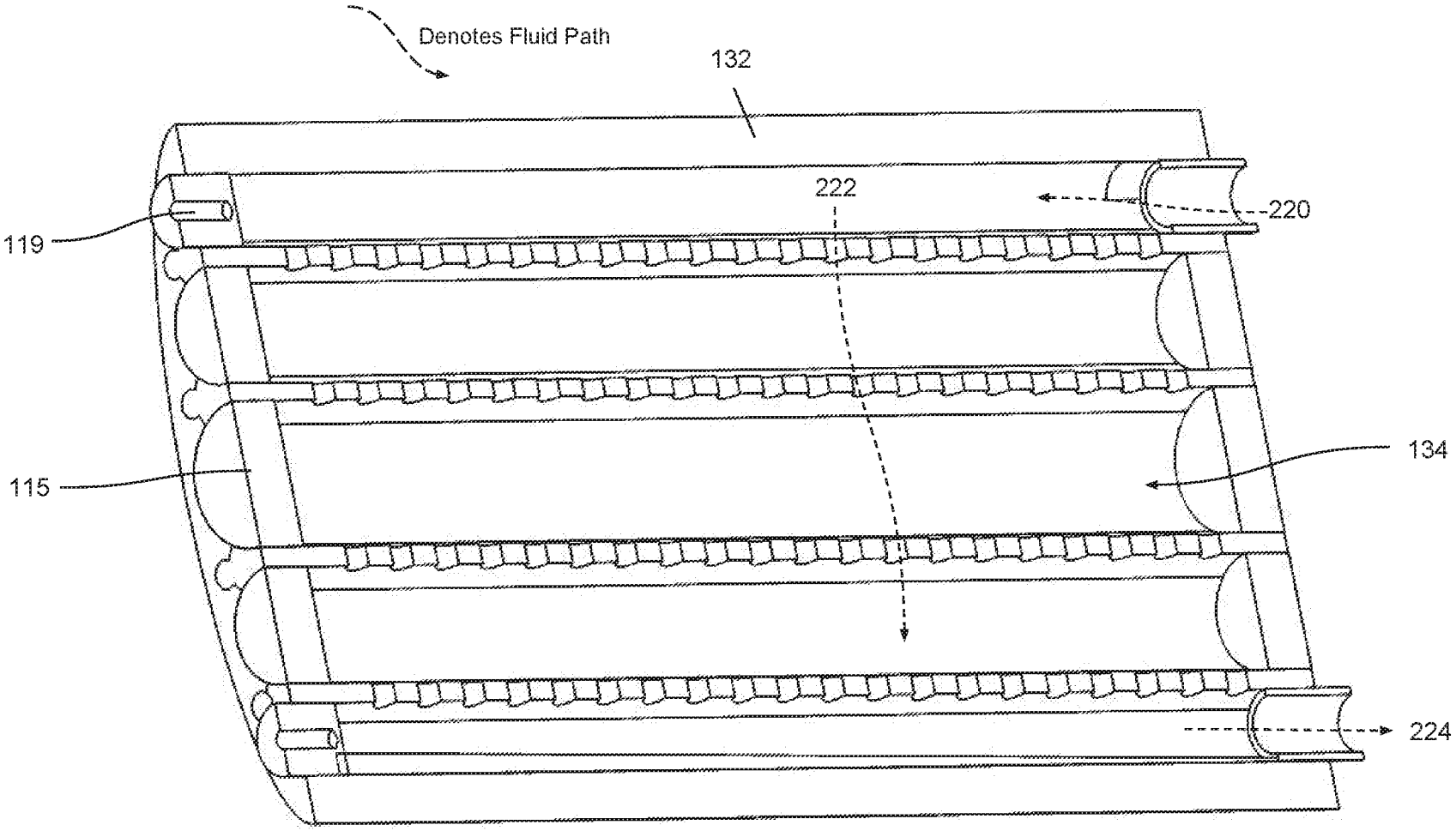
FIG. 11A is a cross-sectional view of the fan blade of FIG. 9, illustrating the flow of working fluid within the interior of the fan blade.
Figure 11B:
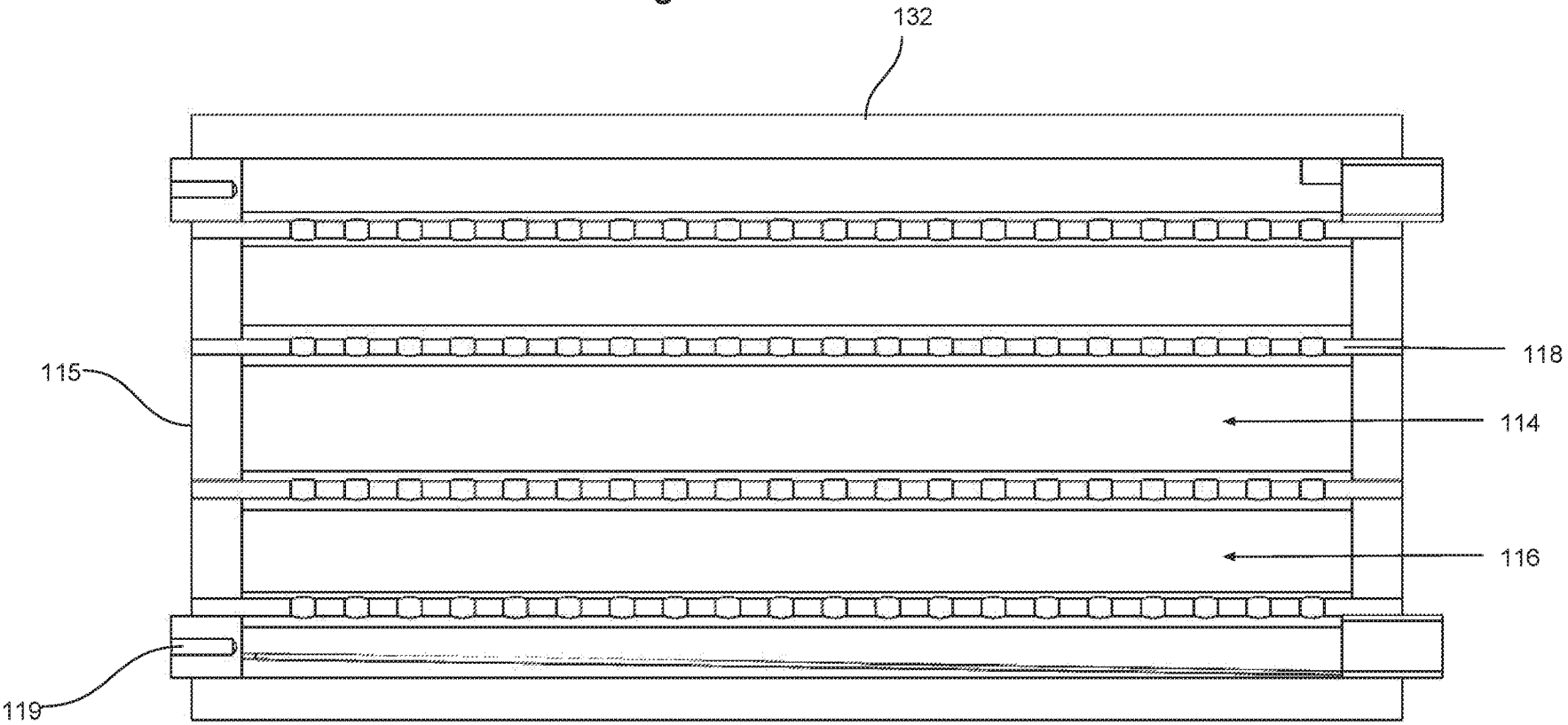
FIG. 11B is a top plan view of the cross-section of FIG. 11A.

FIG. 11A is a hollow condenser-side fan blade 132 and heat exchanger section view showing internal perforated struts 118 with fluid conduits. FIG. 11B is a cross-section plan view of FIG. 9. Also visible in FIG. 11A are baseplate and end plate wing mounts 119, wing plugs 115, and wing conduits 117. As heat exchanger is rotated and air flow is induced across condenser-side fan blade 132, heat exchange occurs between the air and the fan blade 132. Vapor fluid entering the wing through fluid path 220 will fill the wing across fluid path 222. Heat exchange will occur between the working fluid along fluid path 222 and hollow condenser-side fan blade 132, causing the vapor to condense into liquid. Working fluid in liquid form will then flow along path 222 due to centrifugal sorting and contact condenser ramp 136. Centrifugal force will aid liquid flow along condenser ramp 136 and toward fluid path 248, such that the liquid working fluid exits the condenser-side fan blade 132 at fluid path 224 and intersecting plate fluid supply path 248.

FIG. 12 is a perspective view of a first configuration of a evaporator fan blade 112 of the rotary heat exchanger 110 of FIG. 1A, illustrating inlet air flow 185 and outlet airflow 186 over the fan blade 112. Given the multiple cylindrical bores 116 which make up the internal cavity 114 of the fan blade 112, many different configurations are possible by using a combination of wing mounts 119, wing conduits 117, and wing plugs 115 disposed at the ends of the cylindrical bores 113 Wing mount 119 generates a clamping force between the baseplates 180*a*, 180*b*, and 180*c* and holds the wing itself into the baseplate, and may additionally contain either a wing conduit 117 or a wing plug 115. Wing conduit 117 may pass through a plate joining hole 198 and thus resist centrifugal forces, acting as a sort of wing mount, although containing no plate joining pins 196. Air-side heat exchange takes place on the surface of evaporator fan blade 112, as air passes over the wing from fluid path 185 to 186. In the cavity 114, may be mounted an expansion valve 113. The evaporator fan blades may differ from the condenser fan blades in the configuration of the fluid conduits and mounts to the baseplate.

Figure 13:
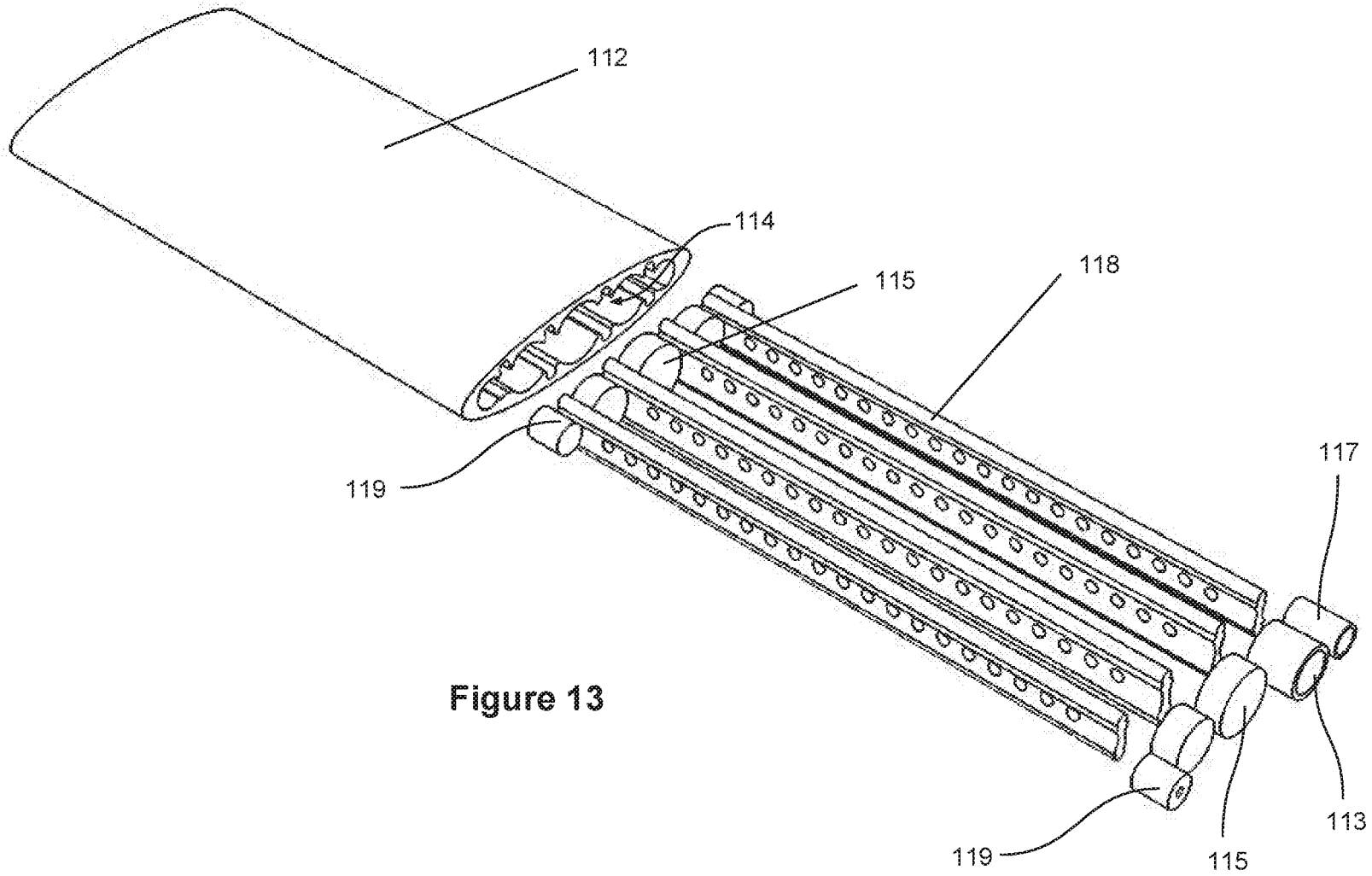
FIG. 13 is a perspective exploded assembly view of the fan blade of FIG. 12.

FIG. 13 is an evaporator-side hollow fan blade 112, exploded view, showing perforated struts 118. Also visible are wing plugs 115, wing mounts 119, and wing conduits 117. Perforated struts 118 are slid into evaporator-side hollow fan blade 112 to structurally support the resultant pressure vessel. Perforated struts 118 may either be bonded, brazed, or welded, or simply mated with no additional joining method.

Figure 14A:
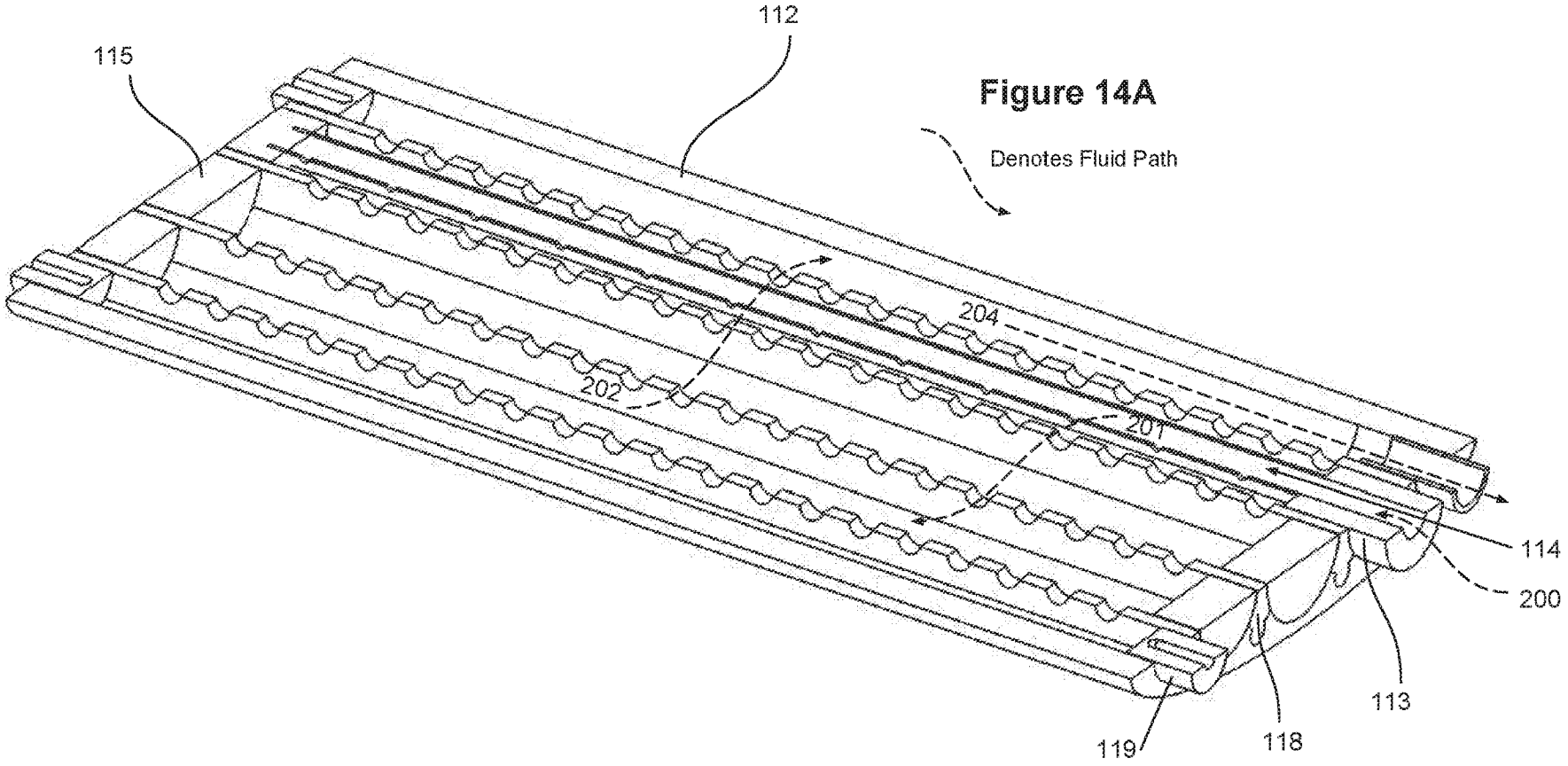
FIG. 14A is a cross-sectional view of the fan blade of FIG. 12, illustrating the flow of working fluid within the interior of the fan blade.
Figure 14B:
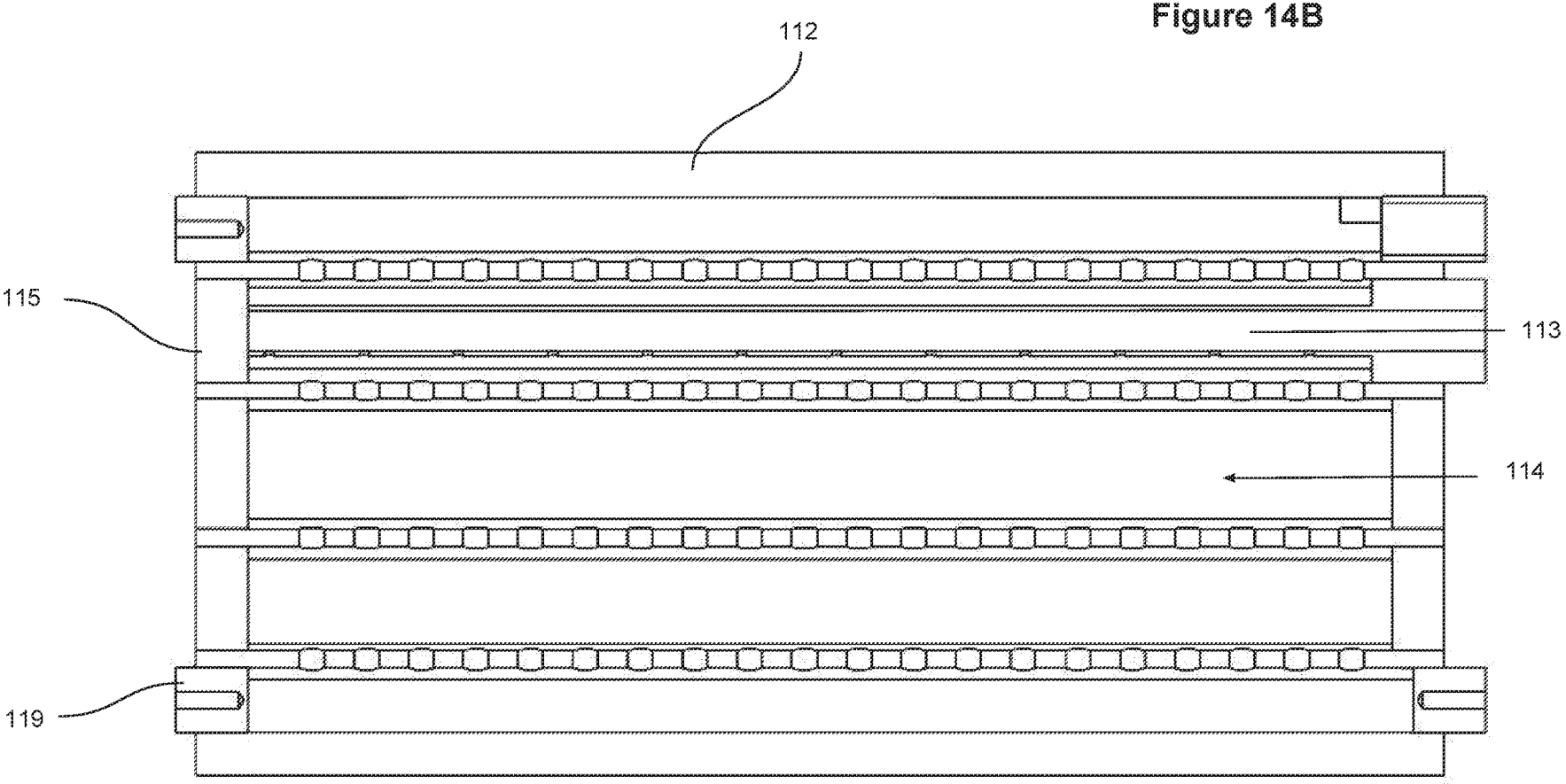
FIG. 14B is a top plan view of the cross-section of FIG. 14A.

FIG. 14A is a hollow evaporator-side fan blade 112 and heat exchanger section view showing internal perforated struts 118 with fluid conduits. Also visible, baseplate and end plate wing mounts 119, wing plugs 115, and wing conduits 117. FIG. 14B is a cross-section plan view of FIG. 12. As heat exchanger is rotated and air flow is induced across evaporator-side fan blade 112, heat exchange occurs. Liquid working fluid entering the wing through fluid path 200 and expansion valve 113 transit radially outward along fluid path 201 due to centrifugal acceleration. As heat exchange occurs between fluid along path 201, the working fluid undergoes a phase change and boiling occurs. Working fluid vapor then transits the wing along fluid path 202 due to the difference in density between the vapor and liquid phase of the working fluid while under centrifugal acceleration, hereafter called centrifugal sorting. Centrifugal sorting will separate the liquid and vapor phase of the working fluid due to the difference in density between the two phases. Vapor exits the evaporator-side fan blade 112 along fluid path 204 through wing conduit 117 and toward vapor path 240. Liquid is supplied to liquid fluid path 200 through common plate liquid supply channel 252.

Figure 15:
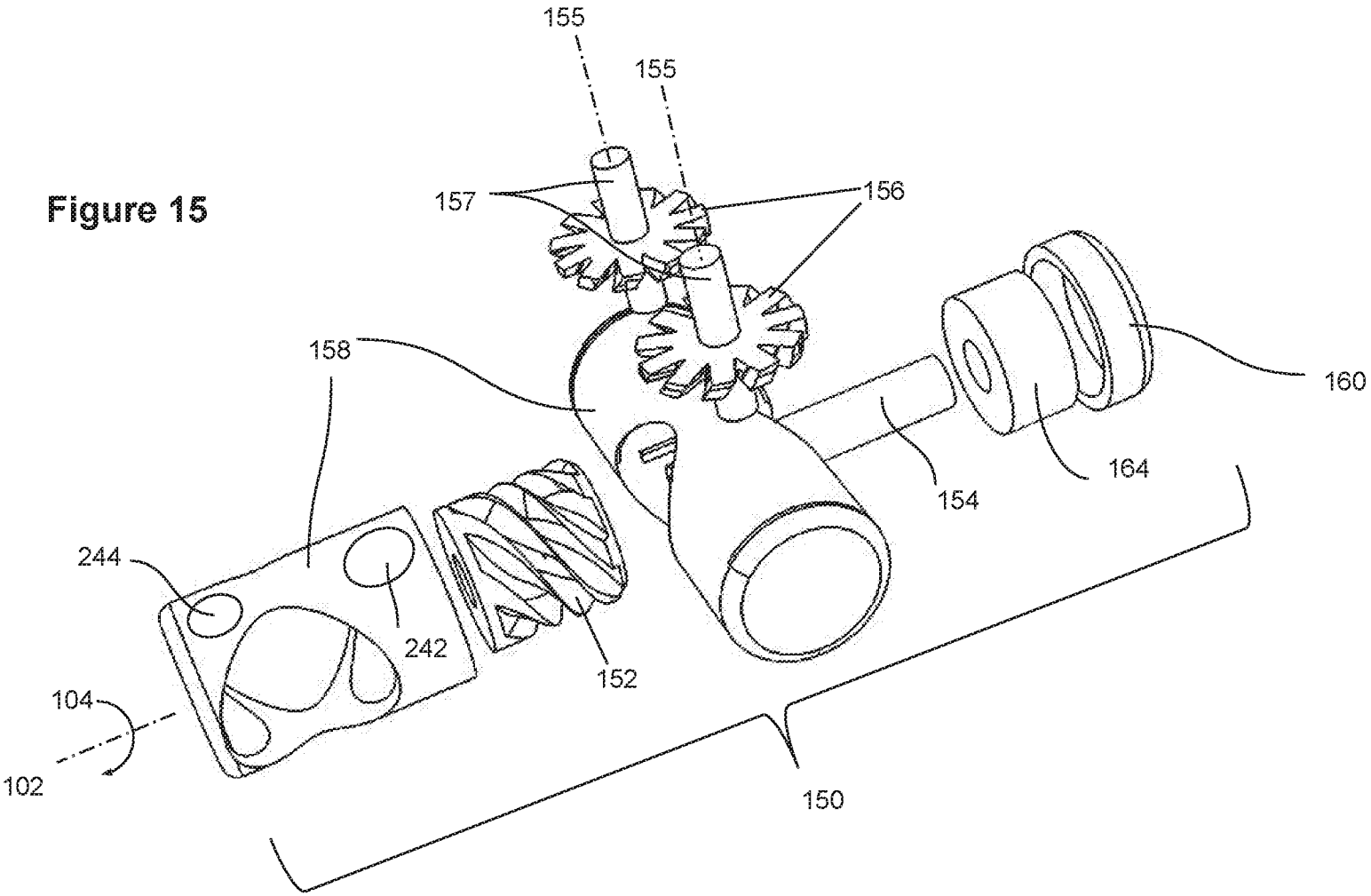
FIG. 15 is an exploded assembly view of the compressor of the rotary heat exchanger of FIG. 1A.

FIG. 15 shows a single-screw type vapor compressor. The relative motion between the casing 158 and the internal components create compression chambers and compress a given volume of gas in a shrinking chamber for discharge. In some embodiments, the casing of a fluid pump is stationary with respect to the ground, while the internal mechanisms create suction and discharge through their rotation or operation. However, this operation relies on the relative rotation of the stator and rotating sets of components, and does not require that specific components be held stationary. In the illustrated embodiment, the components which are sometimes described as stationary instead rotate relative to the components which are sometimes described as rotation, in order to create suction and discharge. Specifically, the compressor casing 158 which is rigidly mounted in baseplate 180 is rotating from an external point of view as the heat exchanger rotates. Planetary rotor shafts 157 mounted inside compressor casing 158 and able to rotate about planetary rotor shaft axis of rotation 155 via bearings, orbit in a planetary manner around main screw stator 152 and axis of rotation 102. Planetary idler gate rotors 156 are driven in their orbital motion through direct contact with main screw stator 152 flutes.

The stationary components of the illustrated embodiment include main screw gear stator 152 which is held stationary by a direct connection to main stator shaft 154, which is in turn held stationary through a direct connection to internal magnetic stator 164. Internal magnetic stator 164 is held stationary by the external magnetic stator 162 through magnetic linkage. External magnetic stator 162 is mechanically grounded. The relative motion between aforementioned stationary, rotating, and orbiting components creates suction at compressor casing return port 242 and pressurized vapor at compressor casing supply port 244.

The volume defined by the flutes of the main screw stator 152 begins large at the suction end of the compressor. As they are rotated relative to the gate rotors 156, the low pressure vapor is compressed into higher pressure vapor due to the decrease in volume defined by the smaller flutes of the main screw stator 152 towards the discharge end of the compressor.

Figure 19:
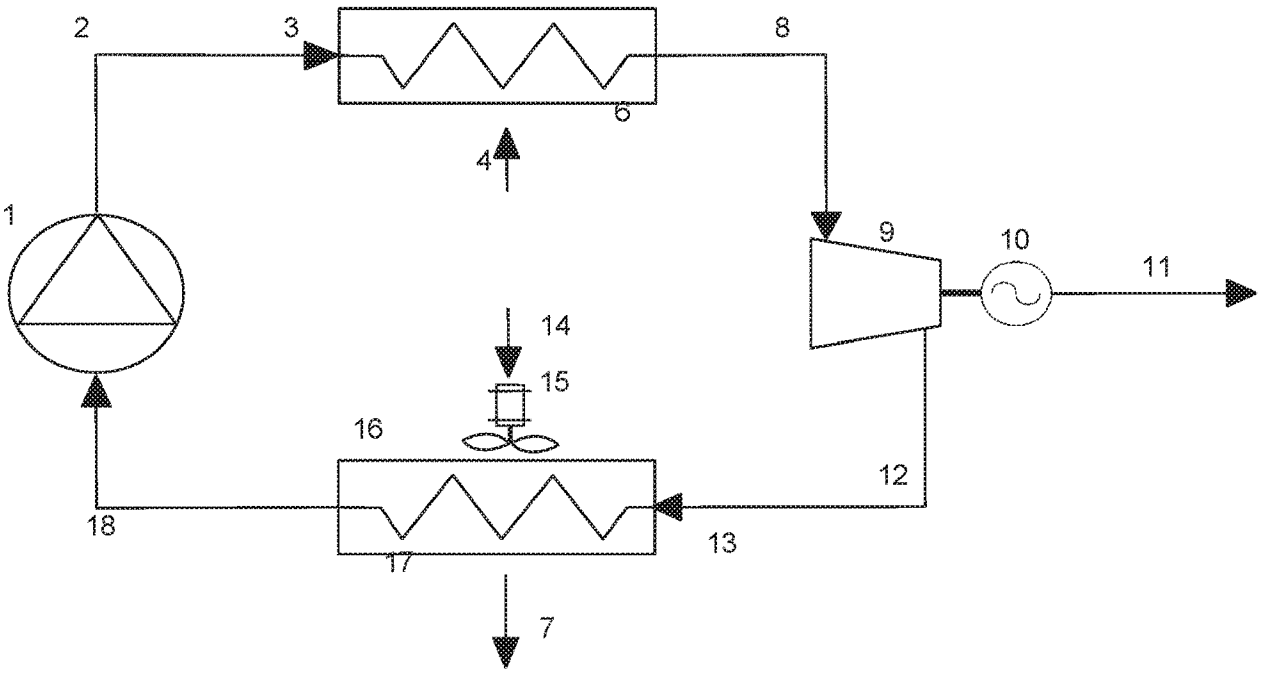
FIG. 19 is a schematic diagram illustrating a Organic Rankine Cycle (ORC).

In other embodiments, the compressor shown in FIG. 15 can instead act as a turbine, converting pressurized vapor into kinetic rotational energy by expansion of said vapor operating an ORC (Organic Rankine Cycle) as shown in FIG. 19 later. In such an embodiment, high-pressure vapor would enter compressor casing supply port 244 and exit as an expanded, lower-pressure vapor through compressor casing return port 242. Vapor compression is generated through the relative motion between the main screw stator 152 and the gate rotors 156.

Figure 16:
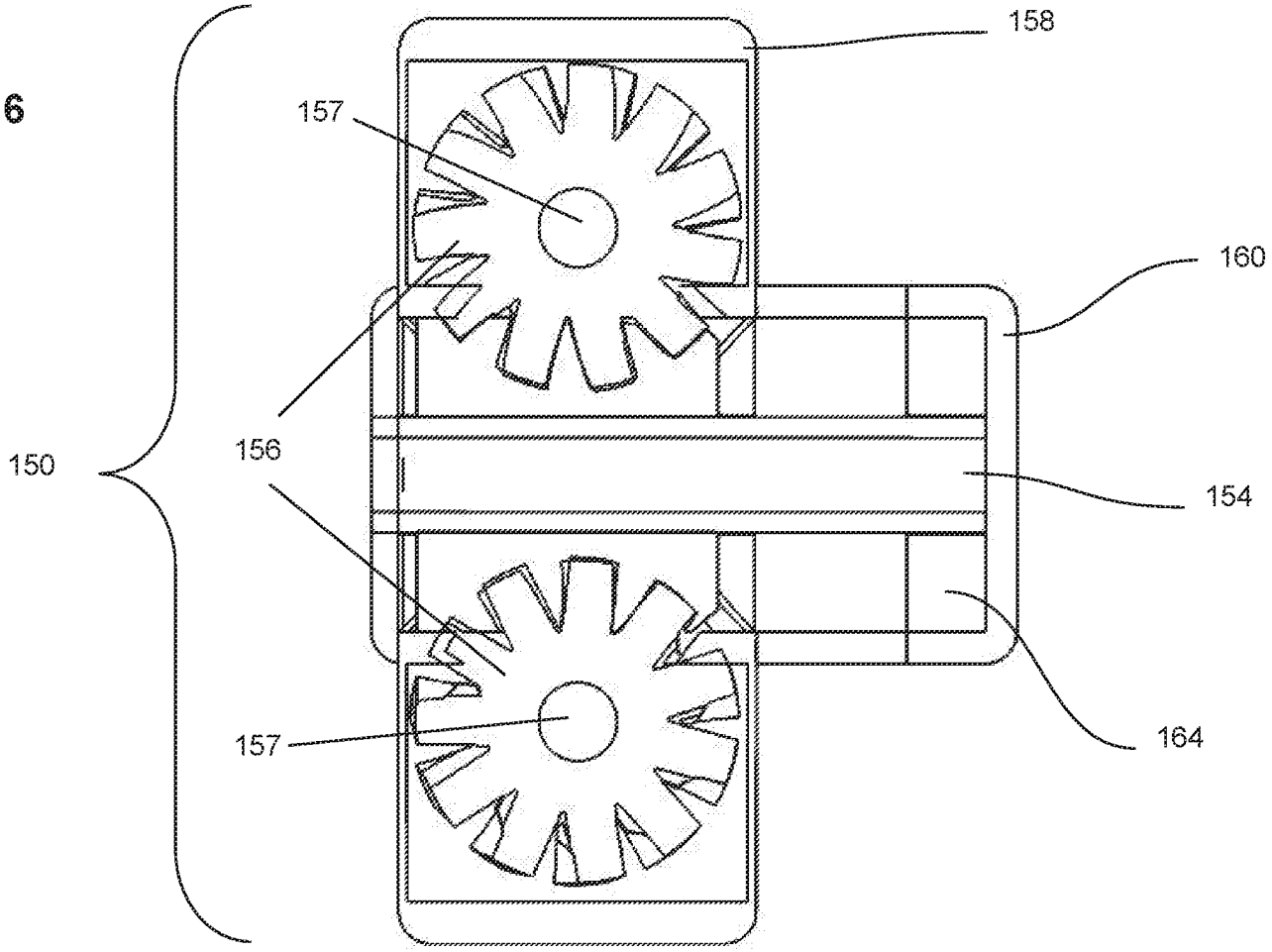
FIG. 16 is a top cross-section of the compressor of FIG. 15, along a plane orthogonal to the rotor shafts of the dual planetary gate rotors.

FIG. 16 is an assembled cross-section plan view of FIG. 15. Shown are planetary gate rotors 156 in direct contact and meshed with main screw stator 152.

Figure 17:
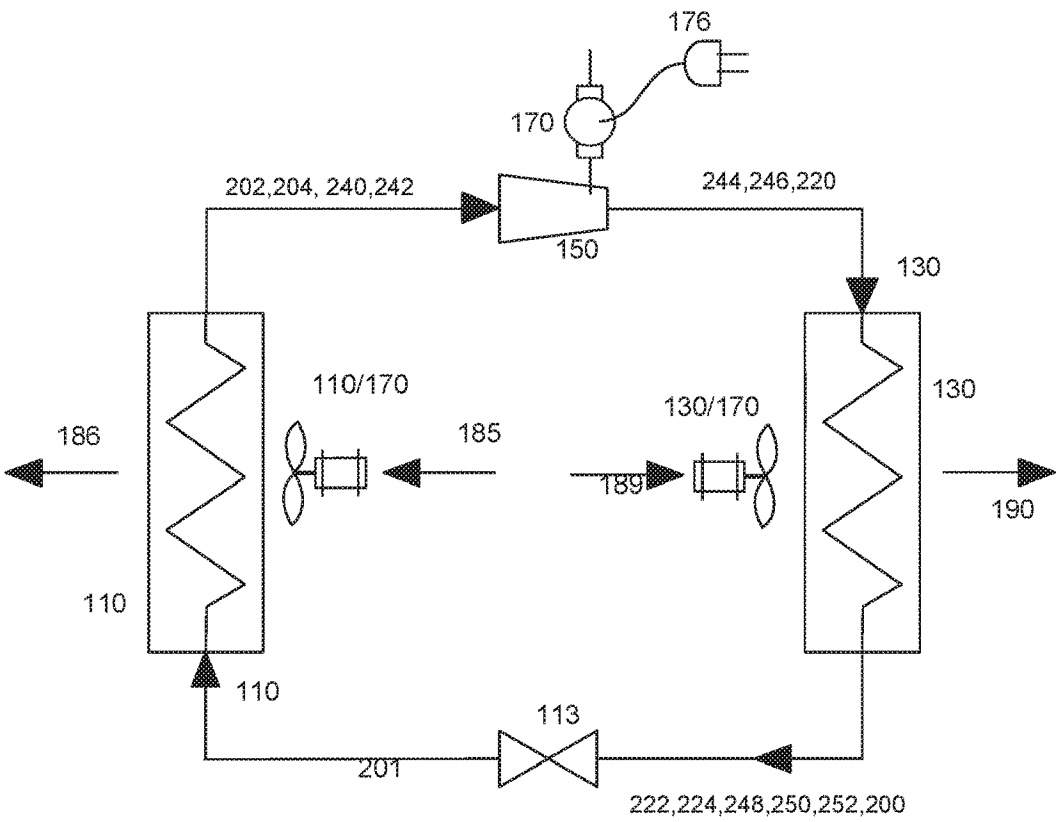
FIG. 17 is a schematic diagram illustrating a vapor compression refrigeration system.
Figure 18:
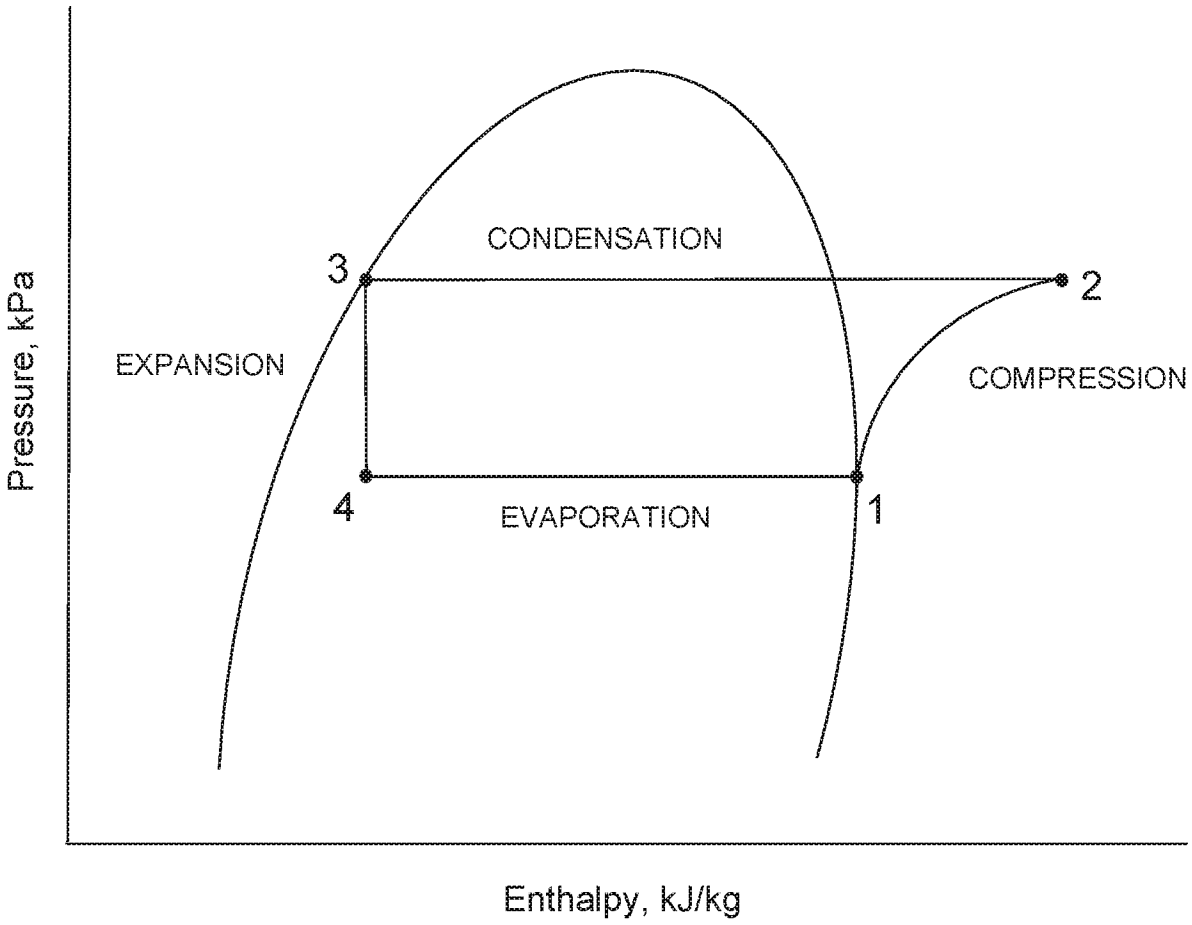
FIG. 18 is a pressure-enthalpy diagram illustrating a Reverse Carnot cycle.

FIG. 17 schematically illustrates a single-stage vapor compression refrigeration cycle system diagram showing a single-stage vapor compression refrigeration cycle. In an embodiment in which the rotary heat exchanger of FIG. 1 operates this single-stage vapor compression refrigeration cycle, the cycle begins with vapor generated in the evaporator fan blade 112 along evaporator wing vapor path 202 and exits the evaporator wing 112 along evaporator wing vapor outlet path 204. The vapor enters the plate vapor return path 240 and subsequently the compressor casing return port 242. Upon entering the compressor 150, vapor is compressed and exits the compressor through compressor casing supply port 244 shown in FIG. 15. The pressurized vapor continues along plate vapor supply path 246 toward the condenser wing vapor supply port 220 shown in FIG. 11A.

The compressed wing vapor then enters the condenser 130 side of the system. Heat is rejected from the condenser 130 side of the system through the condenser air supply 190 shown in FIG. 9. This heat rejection removes heat from the condenser as previously mentioned and shown in FIG. 11A. The high pressure vapor entering along condenser wing vapor fluid path 220 and continuing along condenser wing vapor path 222 experiences heat rejection, condensing the vapor. Through centrifugal sorting and centrifugal acceleration, the condensed liquid is aided along condenser wing vapor path 222 toward condenser ramp 136. Centrifugal acceleration forces condensed liquid down condenser ramp 136 and along condenser liquid supply path 224 out of the wing and toward plate liquid supply path 248 shown in FIG. 5B. Liquid fluid passes through plate liquid supply port 250 aided by higher pressure on condenser side of the system. Liquid continues along plate liquid supply channel 252 shown in FIG. 5A toward evaporator wing liquid supply path 200 shown in FIG. 14A.

Liquid enters the evaporator wing heat exchanger 112 along evaporator liquid supply path 200 and flows through expansion valve 113 shown in FIG. 13 and FIG. 14A. Liquid enters evaporator fan blades 112 through the evaporator wing liquid supply path 200 shown in FIG. 14A. Liquid fluid continues along evaporator liquid wing path 201 and is pulled radially outward due to centrifugal acceleration. As heat is added to the system through source air inlet path 185 shown in FIG. 12, and heat enters the evaporator fan blades 112, liquid is boiled and becomes vapor and transits along evaporator wing vapor inlet path 202 due to centrifugal sorting. Cold air is subsequently rejected along evaporator air outlet path 186 shown in FIG. 12. Evaporator vapor transits from evaporator wing vapor path 202 and continues out of the wing through evaporator wing vapor outlet path 204 toward the plate vapor return path 240, thus completing the thermodynamic cycle illustrated in FIG. 17.

FIG. 22A is a perspective view of a single-piece, hollow evaporator-side or condenser-side fan blade heat exchanger 120, showing a plurality of channels and perforated struts. These fan blades differ from previously stated embodiments in that their single-piece construction which may be advantageous for simplicity sake. This may be advantageous as joining assembly of the support struts and the outer wing is not necessary. This embodiment would require perforation of the support struts while they are part of the wing, possibly requiring a specially designed punch, machining, or boring process.

FIG. 22B is a perspective cross-sectional view of a single-piece, hollow evaporator-side or condenser-side fan blade heat exchanger 120, showing a plurality of channels and perforated struts.

Figure 20:
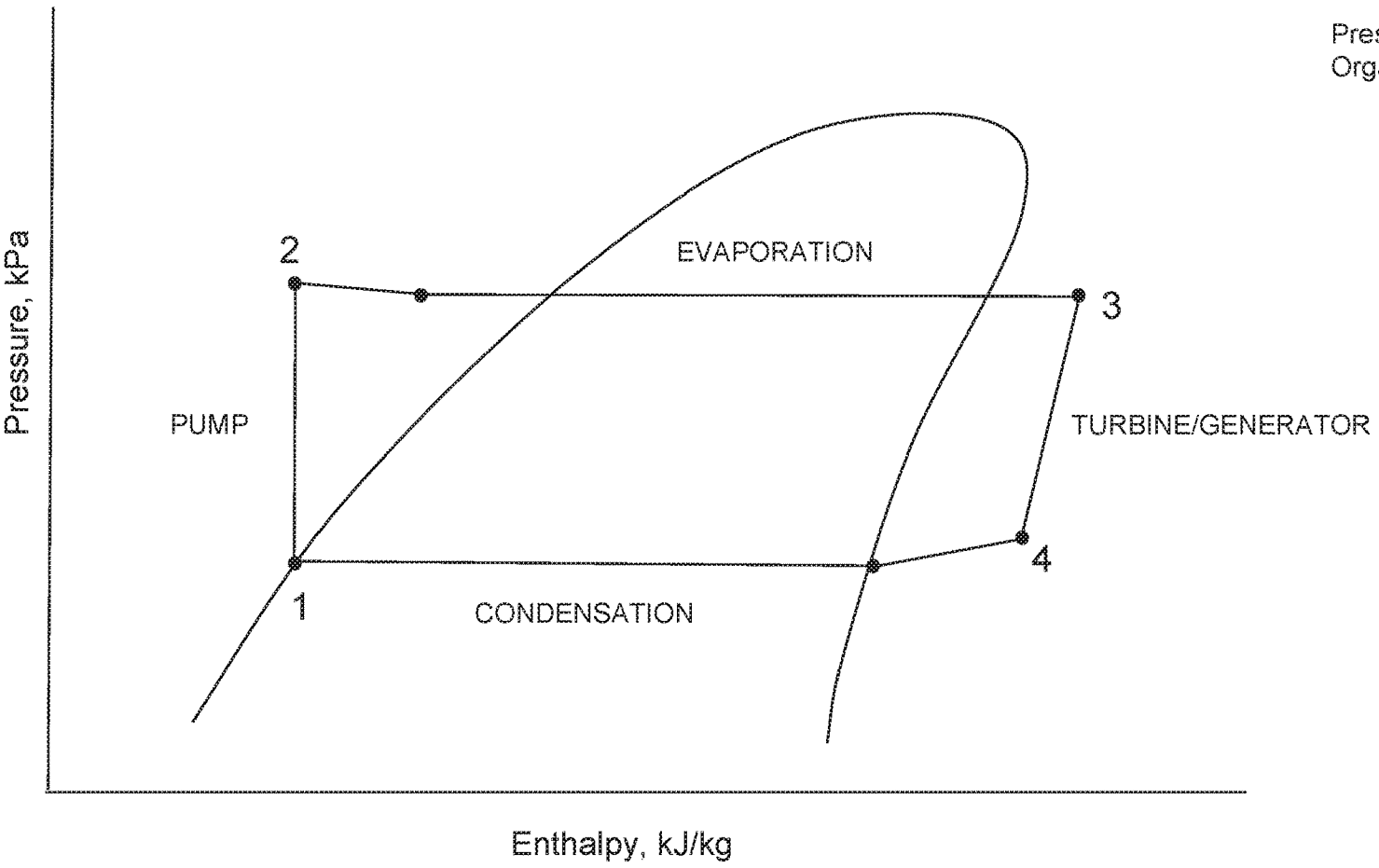
FIG. 20 is a pressure-enthalpy diagram illustrating an Organic Rankine Cycle (ORC).

Although described herein as a heat exchanger, structures similar to the heat exchanger 100 can be used in a variety of other applications. For example, in some embodiments, a similar device may be operated as a condensation unit to condense atmospheric water vapor into liquid water for collection and use. In other embodiments, a similar device as seen in FIG. 19 and FIG. 20 may be operated as a rotary heat engine to generate power using a thermal input through the Organic Rankine Cycle.

In such alternative embodiments, structural changes can be made to the design shown in FIG. 1A to tailor the structure towards a different use. For example, as discussed above, some embodiments utilize a similar structure as a rotary heat engine, with the evaporator side being exposed to heat to induce rotation of the heat exchanger, driving a generator to convert the heat energy into electrical power. Such embodiments may operate on an Organic Rankine Cycle (ORC). In embodiments in which the device is used as a heat engine, the structure of the evaporator fan blades may be substantially different from the structure of the condenser fan blades. For example, the evaporator blades may be taller than the condenser blades, and may be disposed radially-outward of the condenser blades. In some embodiments, the number of condenser blades and evaporator blades may be different.

Figure 21:
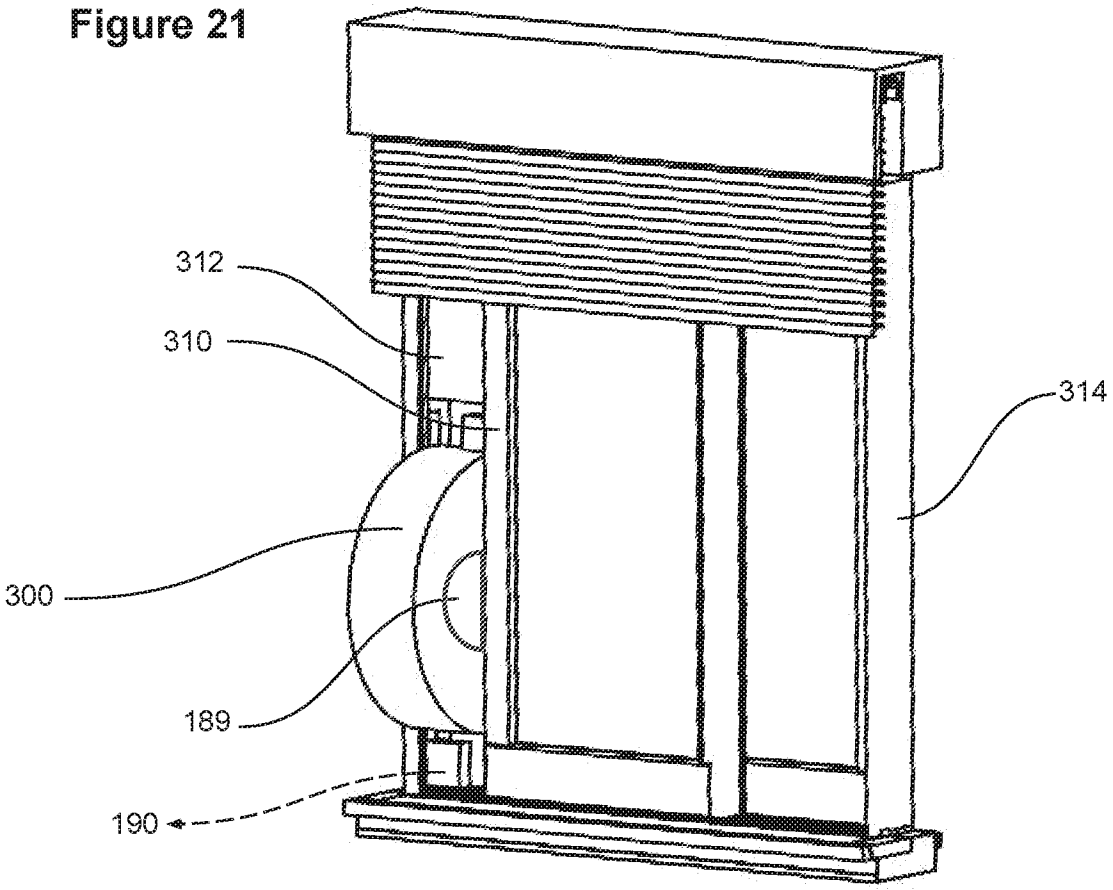
FIG. 21 is a perspective view of a heating/cooling apparatus utilizing a rotary heat exchanger such as the rotary heat exchanger of FIG. 1A.

The rotary heat exchanger may be located within an enclosure that aids the flow of air through the heat exchanger, as is commonly seen with a centrifugal fan. This cowling (or enclosure) will allow for the separation of the source and sink air streams 185, 186, 189 and 190. This cowling 300, seen in FIG. 21 may contain air inlet 189 or 185 ports as well as air outlet ports 186 or 190. The cowling 300 containing the rotary heat exchanger may be supported by a cowling window mount 310 as seen in FIG. 21, which may include or may be further supported by a window divider 312 to allow secure placement within an opened window 314. It is possible to locate the heat exchanger and cowling in any opening or passageway that separates the source and sink air streams. Although depicted in a vertical orientation in FIG. 21, other embodiments include other orientations other than vertical. The cowling and rotary heat exchanger composite units can be rotated 180 degrees around axis of rotation 102 shown in FIG. 1 in order to change the heat exchanger from heating mode to cooling mode and vice versa, by exposing the evaporator side to the other of the source or sink air stream.

In heating mode, the heat exchanger would be heating an inside space, such as a room in a house. The condenser section 130 would be in air communication with the air inside the house, cycling it through condenser sink inlet 189 and across the condenser fan blades 132 where the airstream would warm. The heated air would be ejected from the heat exchanger along condenser air outlet path 190 and enter the room again through the air cowling 300 seen in FIG. 21. Still in heating mode, the evaporator side of the system 110 is in air communication with an outside airstream, such as the outside air. Air transiting the evaporator heat exchanger would be cooled and rejected back to the outside air. By simply rotating the air cowling 300 180 degrees around axis 102, the same air streams are diverted across the opposite heat exchanger, thus changing the device from a heater into a cooler.

In some embodiments, a rotary heat engine may be used in conjunction with a solar collector to concentrate solar energy on the evaporator blades. Other heat sources may also be used to heat the evaporator side of the heat engine. The high pressure working fluid on the evaporator side is forced through the compressor, inducing rotation of the casing and planetary gate rotors relative to the main screw stator as the compressor functions as a turbine. This rotation of the casing induces movement of the rotor of an electric generator relative to the stator, such that the electric generator can generate electric power. This embodiment may or may not include a source air inlet given the thermal input to the system in order to lessen the heat rejection of the source side of the system due to air flow. The air flow across the evaporator side of the system would be stopped if the source inlet was capped, having the advantage of energy savings in not moving an air stream that does not need to be moved.

Figure 23A:
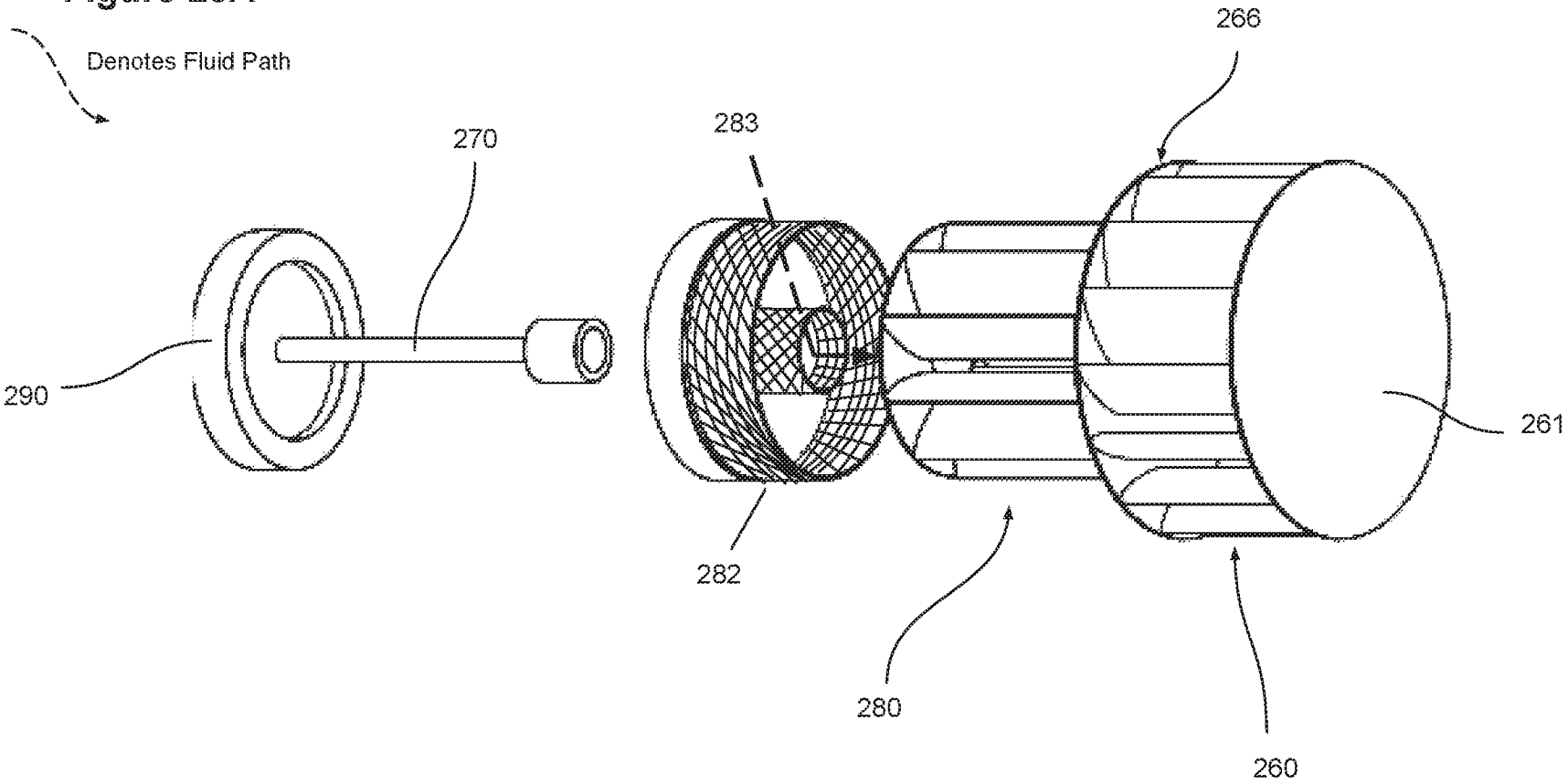
FIG. 23A is a perspective view of a rotary heat exchanger including two centrifugal fans oriented in opposite directions in a configuration specific to the operation of the Organic Rankine Cycle.

FIG. 23A is a perspective view of a rotary heat exchanger including two centrifugal fans oriented in opposite directions in a configuration specific to the operation of the Organic Rankine Cycle seen in FIGS. 19 and 20. The device operates in a similar manner to the device in FIG. 1A in that heat exchange takes place between an inner two-phase working fluid and an external heat source and heat sink. In this instance, the heat source entering the evaporator side heat exchanger 260 could be in the form of concentrated sunlight. It is also possible that the evaporator side air inlet 262 would be restricted by reducing the size of, or removing altogether the aperture in the evaporator end plate 261. This would have the effect of restricting the airflow across the evaporator in order to force heat energy through the evaporator and not waste it into an unneeded air stream. The evaporator side of the system 260 has a greater number of shorter fan blades than the condenser side of the system 280. The evaporator side of the system 260 also contains its heat exchanger fan blades at a greater radius than the condenser side of the system 280. The condenser air inlet screen 282 is rigidly attached to and rotates with the condenser heat exchanger side of the system 280 along with the baseplate 266 and the evaporator side of the system 260. Air enters the condenser through fluid along fluid path 283 and exits the condenser after passing through the heat exchanger radially as before. There is no air cowling on either side of the system to direct air as this is not necessary. The stator support 270 is stationary with respect to the ground and is linked to the base plate 266 and the condenser air inlet through bearings, allowing them to rotate relative to each other. The generator stator 290 is rigidly attached to the stator support 270.

Figure 23B:
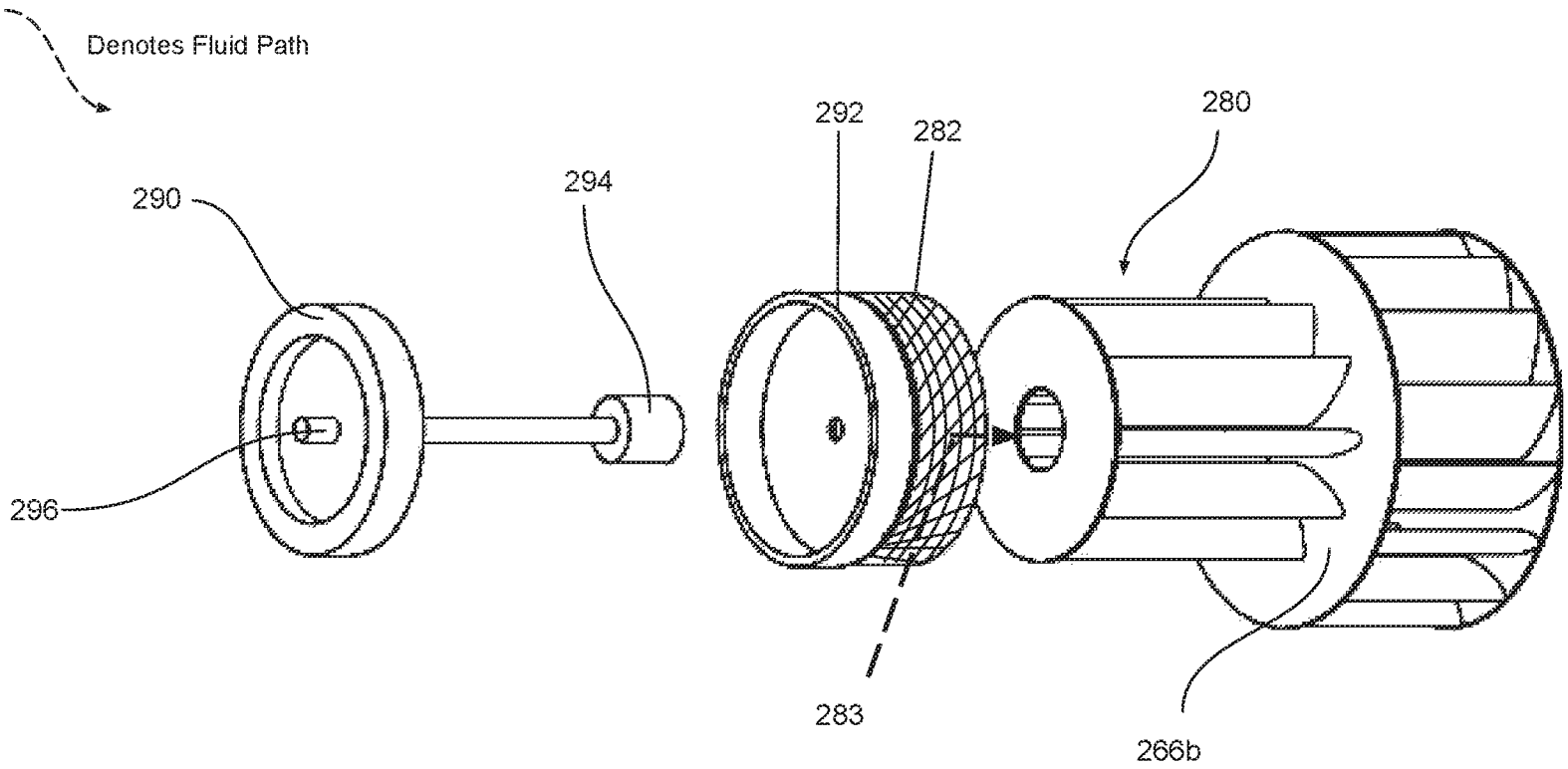
FIG. 23B is an alternate view of the rotary heat exchanger FIG. 23A.

FIG. 23B is an alternate view of the rotary heat exchanger FIG. 23A. The ORC generator rotor 292 is rigidly attached to, and rotates along with, the condenser side of the system 280 through a rigid perforated connection with the ORC condenser air inlet 282. The ORC stator outer magnetic linkage 294 creates a stator force on the inner magnetic stator 164 in the ORC turbine 268 seen in FIG. 24.

Figure 24:
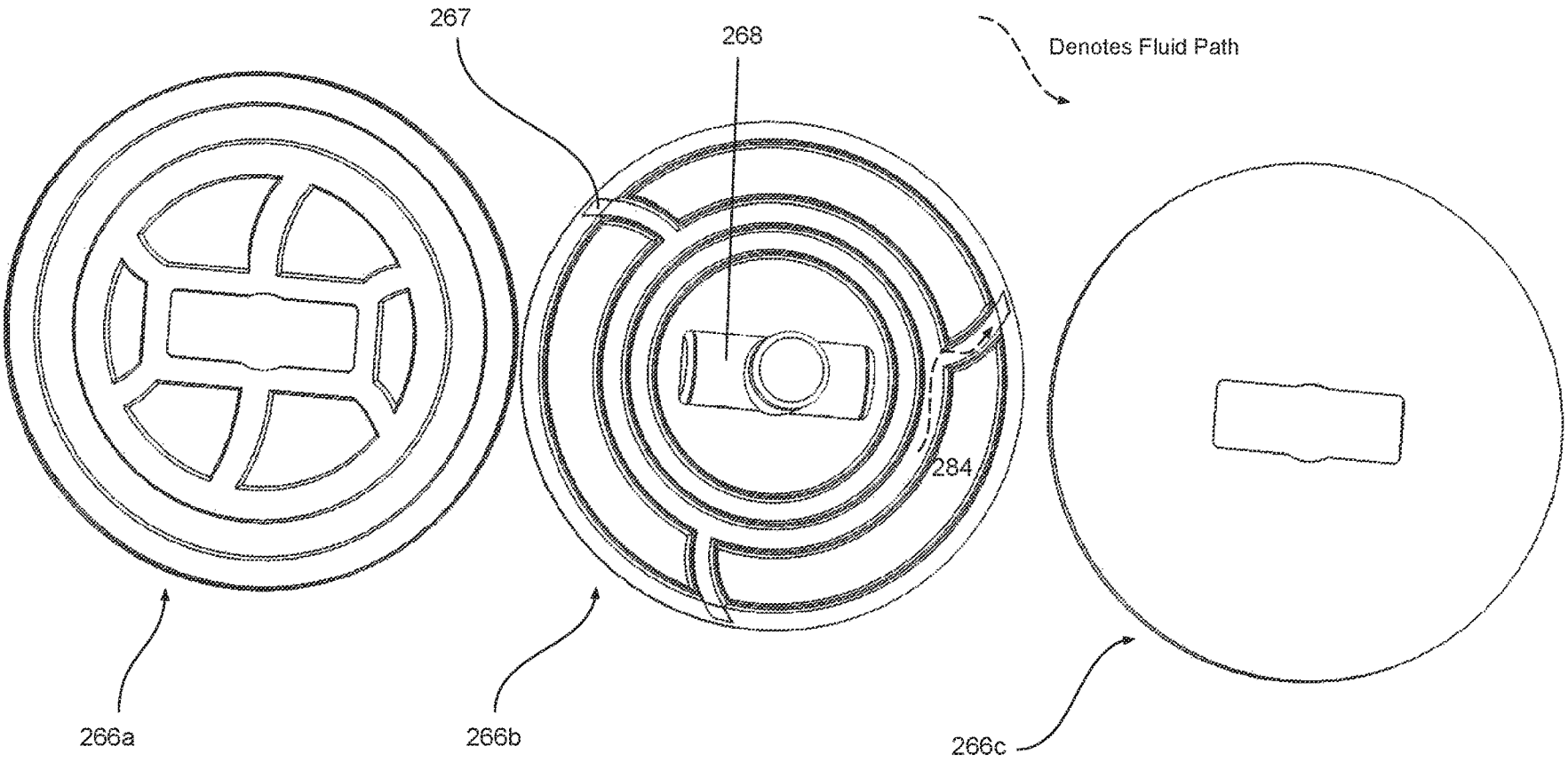
FIG. 24 is an exploded assembly view of the baseplate and turbine and associated components of the rotary heat exchanger of FIG. 23A.

FIG. 24 is an exploded assembly view of the baseplate and turbine and associated components of the rotary heat exchanger of FIG. 23A. Unique to the ORC embodiment of this rotary heat exchanger device is the need to create pumping force from the low pressure, condenser side of the system, to the high pressure, evaporator side of the system. This pumping force causes the pressure increase between points 1 and 2 in FIG. 20. This pumping force is created by disposing a column of liquid along a path which is at least partially radially-aligned and subjecting that column to centrifugal forces along ORC liquid supply fluid path 284 via rotation of the rotary heat exchanger. In some embodiments, the fluid path may be radially aligned along a line which intersects the axis of rotation of the rotary heat exchanger, while in other embodiments, the fluid path may be along a line which does not interest the axis of rotation of the rotary heat exchanger, such that a projection of the fluid path is radially aligned.

Liquid working fluid will pass through a plurality of orifices 267 in plate **266*b* in order to pass from the low pressure condenser side of the system to the high pressure evaporator side of the system. Orifices 267 may include a diaphragm style check valve to limit the flow of fluid opposite the direction of fluid path 284, which may be especially necessary during system start-up when heat exchanger rotation may not be sufficient enough to produce the centrifugal force on fluid column along path 284** to overcome evaporator pressure. Alternately, liquid pumping from the condenser to the evaporator could be accomplished through a pump that is either hub mounted to the rotating heat exchanger or is standalone, outside of the heat exchanger system with liquid exiting and entering the spinning device through a rotating union. A hub mounted liquid pump of this type would take advantage of the relative motion between the stator shaft and the rotating casing as described previously and similar to the operation of the compressor.

Figure 25A:
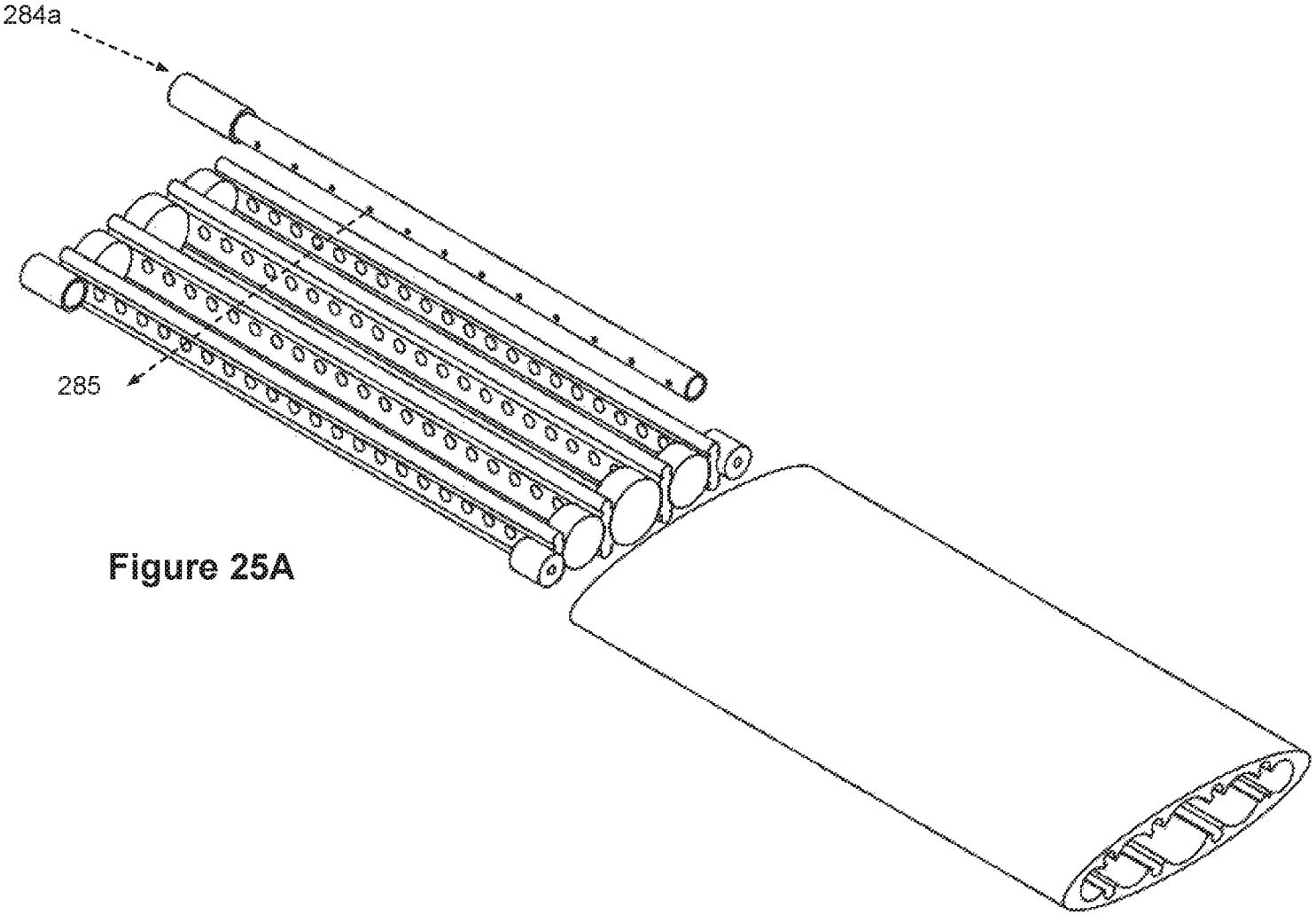
FIG. 25A is a perspective exploded assembly view of an evaporator fan blade of the rotary heat exchanger of FIG. 23A.

FIG. 25A is a perspective exploded assembly view of the evaporator fan blade of FIG. 23A. This fan heat exchanger blade is similar in construction to the fan blade in FIG. 13, but differs in the placement of the ORC inlet liquid supply fluid path **284*a*. The pressurized liquid will continue along the ORC Evaporator liquid and vapor fluid path 285**.

Figure 25B:
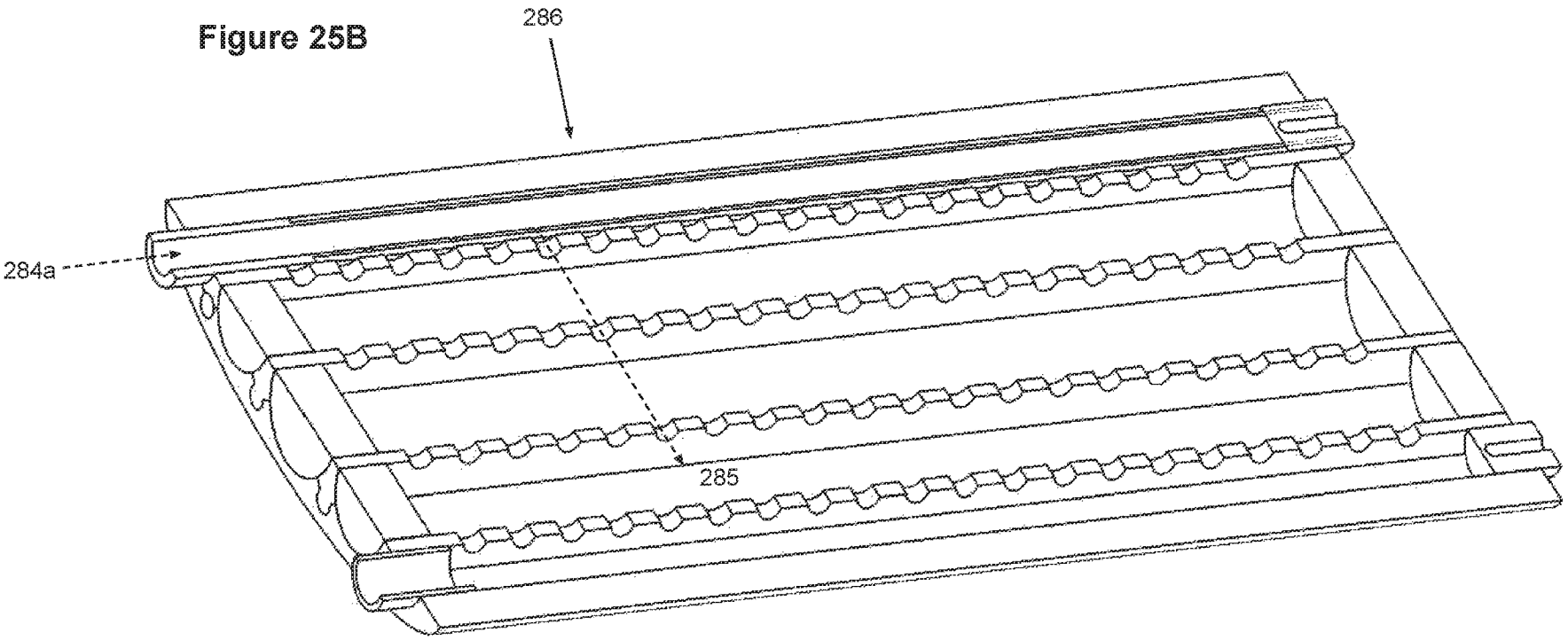
FIG. 25B is a perspective cross-sectional view of the evaporator fan blade of the rotary heat exchanger FIG. 23A.

FIG. 25B is a perspective cross-sectional view of a hollow evaporator-side fan blade heat exchanger of FIG. 23A.

In other embodiments, the fluid circuit may be a structure distinct from the fan blades or other air moving structure. In addition, separate thermal exchange components may be provided in order to enhance heat transfer to or from portions of the fluid circuit. In some embodiments, the thermal exchange components may take the form of one or more heat exchange fins or similar structures.

In some embodiments, these heat exchange components may be configured to be low-profile or low-drag components. In some embodiments, these heat exchange fins may be oriented generally normal to the axis of rotation of the centrifugal fans, in order to minimize the drag of the heat exchange fins or other components as the centrifugal fan rotates, increasing airflow over the surfaces of the heat exchange fins. In some other embodiments, the heat exchange fins may be canted at an angle to a plane normal to the axis of rotation of the centrifugal fans.

Figure 26A:
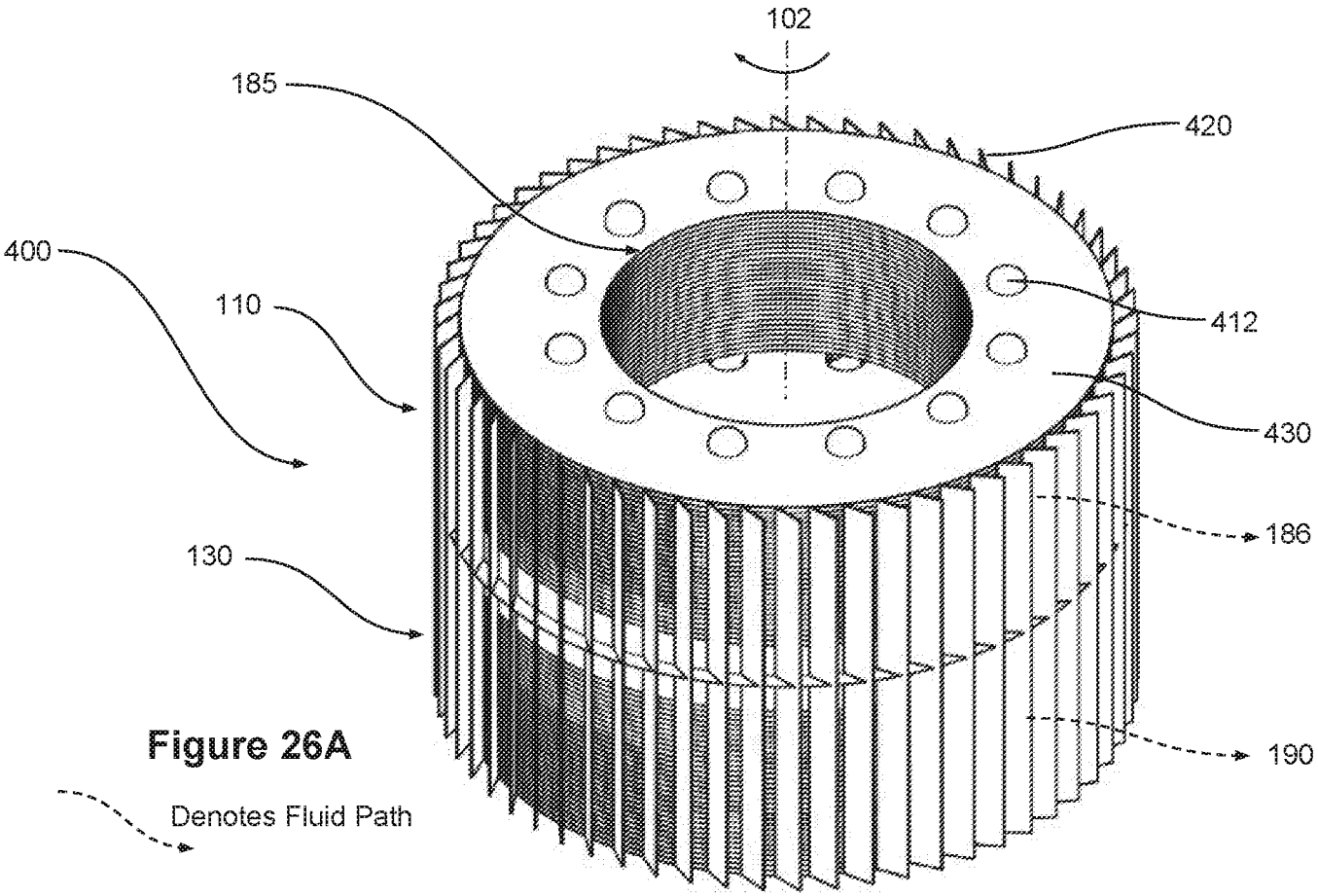
FIG. 26A is a top perspective view of an embodiment of a rotary heat exchanger in which the fluid circuit is separate from the fan blades.

FIG. 26A is a top perspective view of an alternative embodiment of a rotary heat exchanger in which the working fluid is routed through a heat exchange structure combined with centrifugal fan blades 420. Air is induced through source inlet 185 and over evaporator heat exchange fins 430 and along evaporator air outlet path 186 through rotation of the combined device around axis of rotation 102. The evaporator tubes 412 are hollow and contain a two-phase working fluid as before, and are in fluid communication with condenser tubes and a hub-mounted compressor as before (not shown in FIG. 26A).

In the illustrated embodiment, the thermal transfer components or heat exchange components are a series of generally planar ring-shaped fin structures, each fin structure in contact with multiple tubes of the working fluid circuit. The fin structures 430 are discrete structures separated from each other. In other embodiments, however, the thermal transfer components may include a spiral fin. In such an embodiment, the individual fin sections in contact with a given tube may be different levels of a ramp-like fin structure that winds past the tubes of the working fluid circuit multiple times. The fins or other heat exchange components need not be thin layers of solid material as shown, but may instead be hollow, and may form part of the working fluid circuit.

Figure 26B:
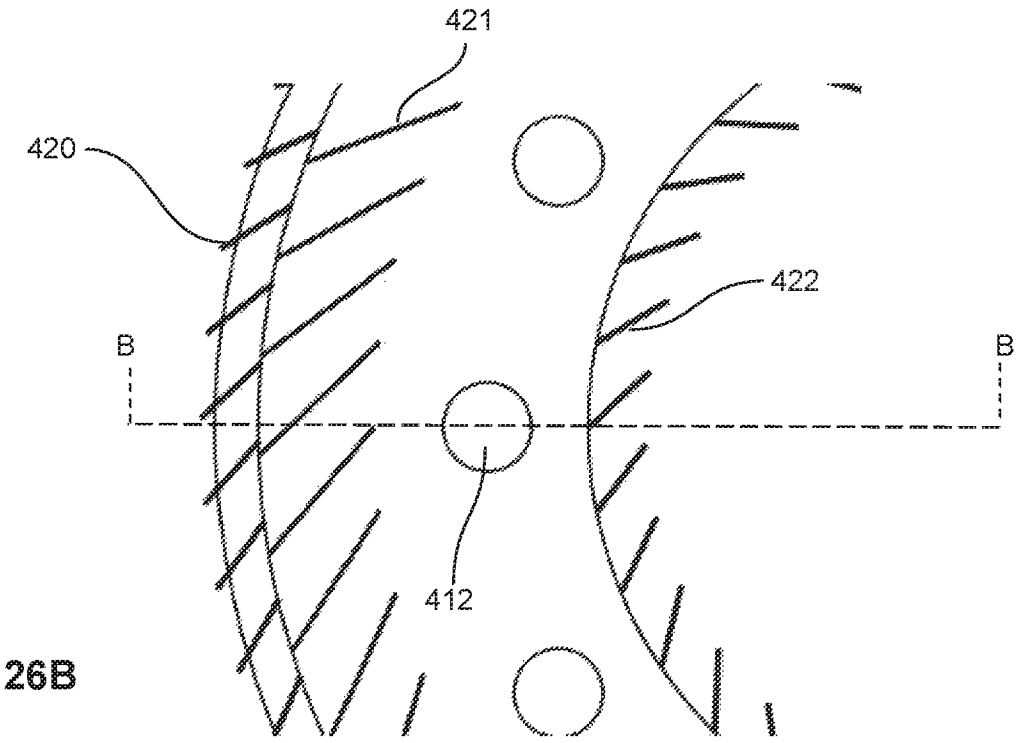
FIG. 26B is a top plan view of an embodiment of the rotary heat exchanger of FIG. 26A, additionally illustrating two additional locations for fan blade placement.

FIG. 26B is a top plan view of the rotary heat exchanger of FIG. 26A including two additional radial positions of possible outer diameter centrifugal fan blade 420 placement with medial diameter 421 and inner diameter 422 centrifugal fan blades as alternate possible placement positions. Although only one fan blade placement region may be necessary to induce adequate air flow over the heat exchanger, fan blades deposited over multiple radial regions are possible and would have similar effect. The fan blades depicted could be forward-curved or backwards-curved as drawn depending on direction of rotation. Forward and or backwards curved fan blades could be used separately or together to induct centrifugal air flow. The fan blades may not be contiguous structures extending the height of the condenser or evaporator, but may instead be a plurality of individual structures arranged in any suitable fashion to induce the desired airflow.

Figure 26C:
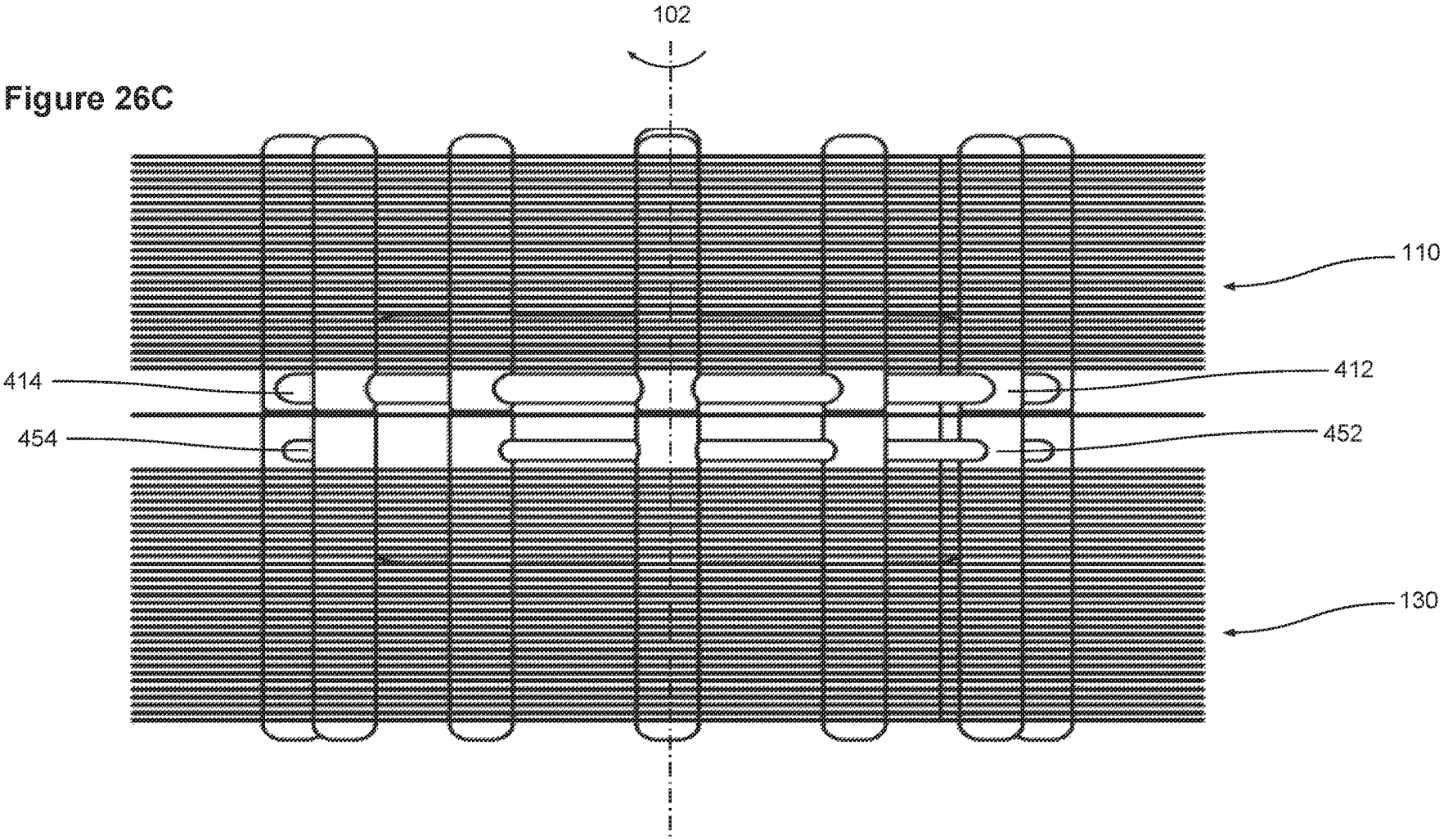
FIG. 26C is a side view of the rotary heat exchanger of FIG. 26A.
Figure 26D:
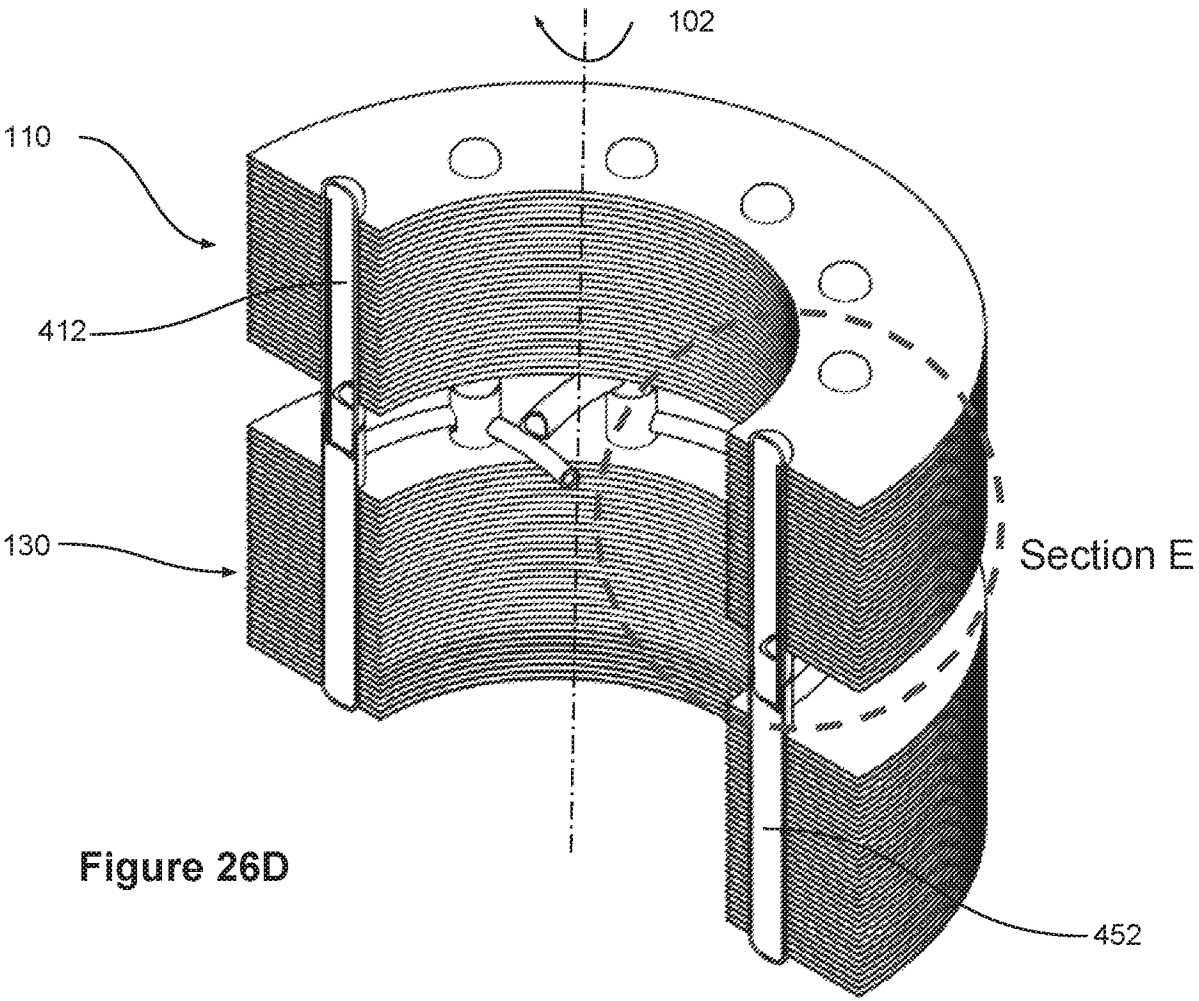
FIG. 26D is a perspective cross-section view of the rotary heat exchanger of FIG. 26B without the additional fan blade placement alternatives, taken along the line B-B of FIG. 26B.
Figure 26E:
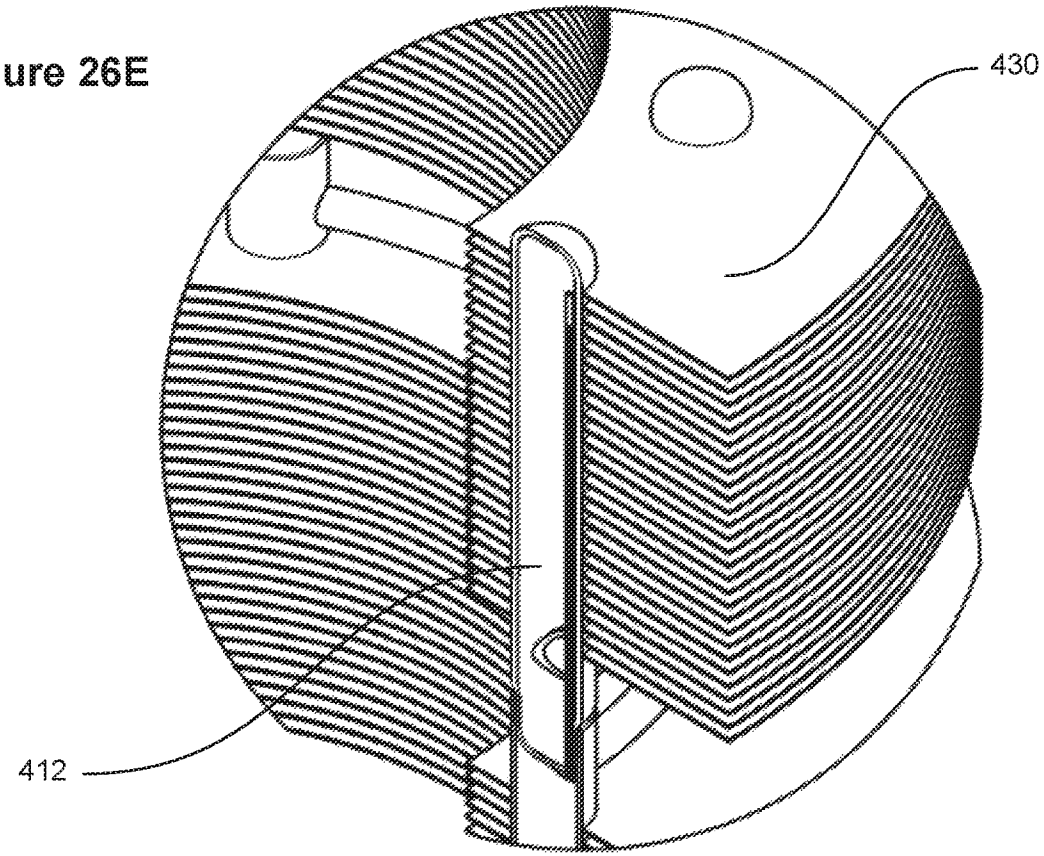
FIG. 26E is a detail perspective cross-section view of section E of FIG. 26D.

FIG. 26C is a side view of the rotary heat exchanger of FIG. 26A. FIG. 26D is a perspective cross-section view of the rotary heat exchanger of FIG. 26B, taken along the line B-B of FIG. 26B. FIG. 26E is a detail perspective cross-section view of section E of FIG. 26D. Evaporator 110 and condenser 130 sections are mounted back-to-back as before, and are rigidly mounted together combining a centrifugal fan 420, evaporator tubes 412 and condenser tubes 452 which are joined in fluid connection by evaporator pipes 414 and condenser pipes 454. In the illustrated embodiment, the evaporator tubes 412 and condenser tubes 452 extend generally parallel to the axis of rotation of the rotary heat exchanger, and the evaporator pipes 414 and condenser pipes 454 extend between evaporator tubes 412 and condenser tubes 452 respectively, with the evaporator pipes 414 generally in a plane normal to the axis of rotation of the rotary heat exchanger and the condenser pipes 454 similarly within a plane normal to the axis of rotation of the rotary heat exchanger.

Figure 27A:
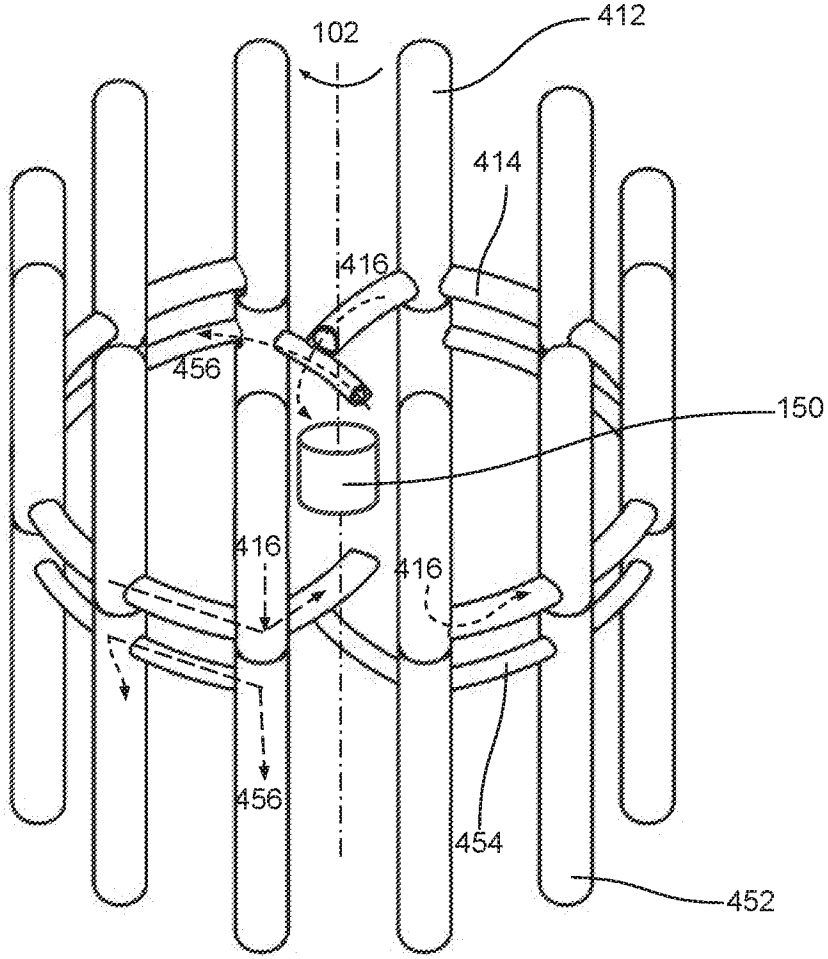
FIG. 27A is a perspective view of the working fluid routing system of the rotary heat exchanger of FIG. 26A.

FIG. 27A is a perspective view of the working fluid routing system of the rotary heat exchanger of FIG. 26A. Evaporator pipe 414 allows for gas to return from the evaporator tubes 412 to the central compressor 150 along evaporator path 416. Compressed gas leaves the compressor 150 via condenser pipes 454 into condenser tubes 452. The flow of working fluid through the evaporator and condenser is similar to the flow of working fluid through other embodiments described above, except that the working fluid is not routed through hollow fan blades in the working fluid routing system of FIG. 27A.

Figure 27B:
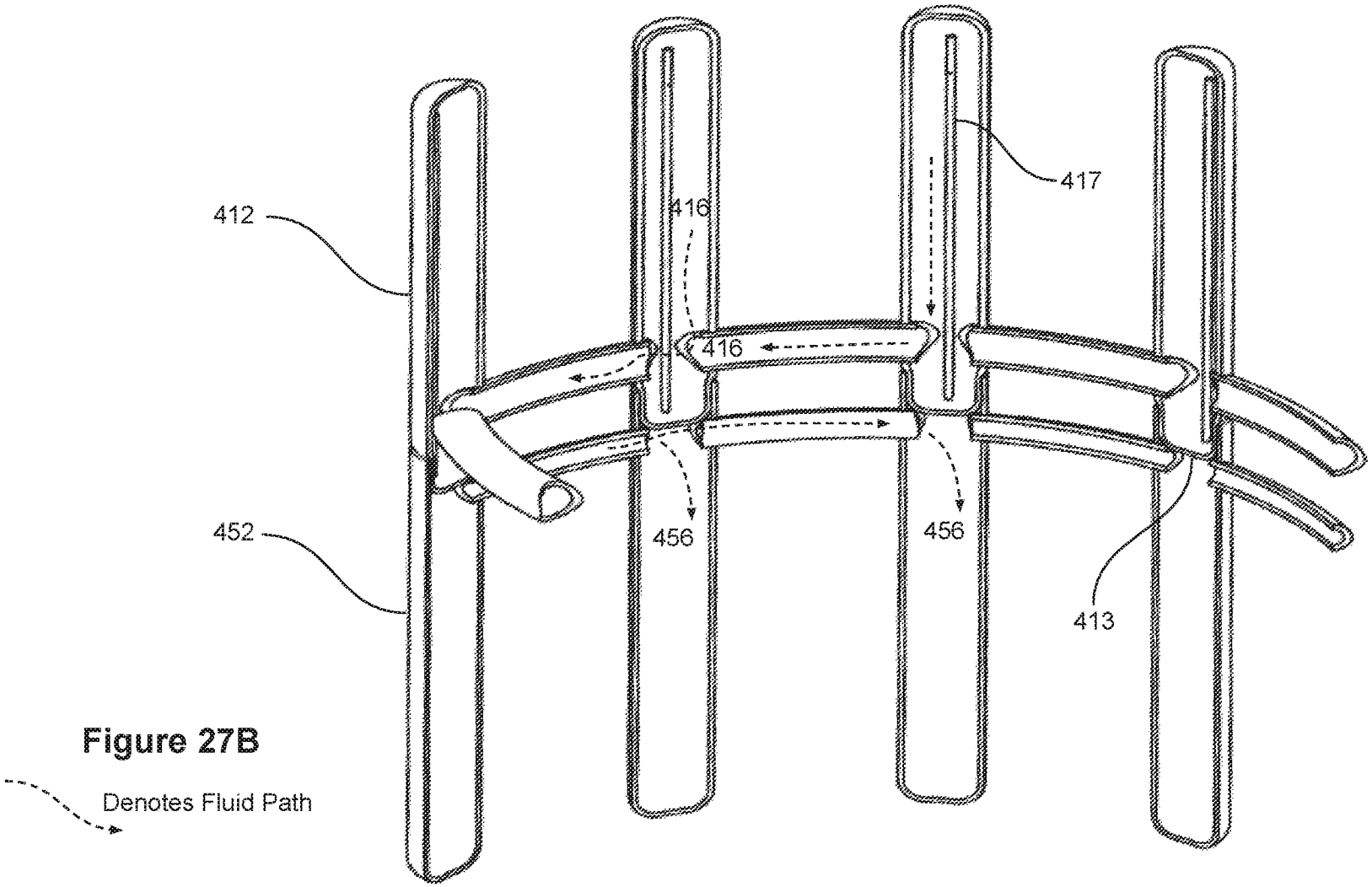
FIG. 27B is a radial section view of the working fluid routing system of FIG. 27A.
Figure 27C:
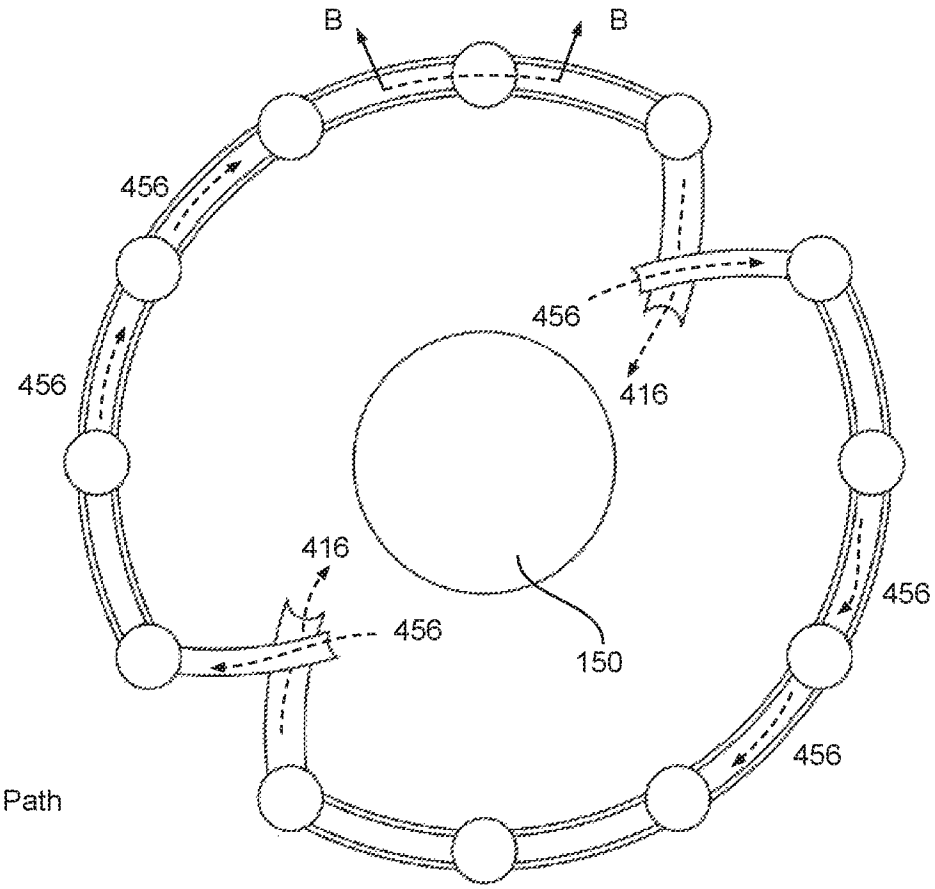
FIG. 27C is a top plan of the working fluid routing system of FIG. 27A, illustrating working fluid flow throughout the system and compressor.

FIG. 27B is a radial section view of the working fluid routing system of FIG. 27A. Evaporator cap 413 divides the evaporator and condenser sections. This cap 413 could include a thermal barrier to insulate the two sections. Thus, an evaporator pipe 414 and a condenser pipe 454 may form part of a single structure extending in a direction parallel to the axis of rotation of the rotary heat exchanger. The thermostatic expansion valve (TXV) 417 joins the condenser and the evaporator in fluid communication. FIG. 27C is a top plan of the working fluid routing system of FIG. 27A, illustrating working fluid flow throughout the system and compressor.

Figure 28A:
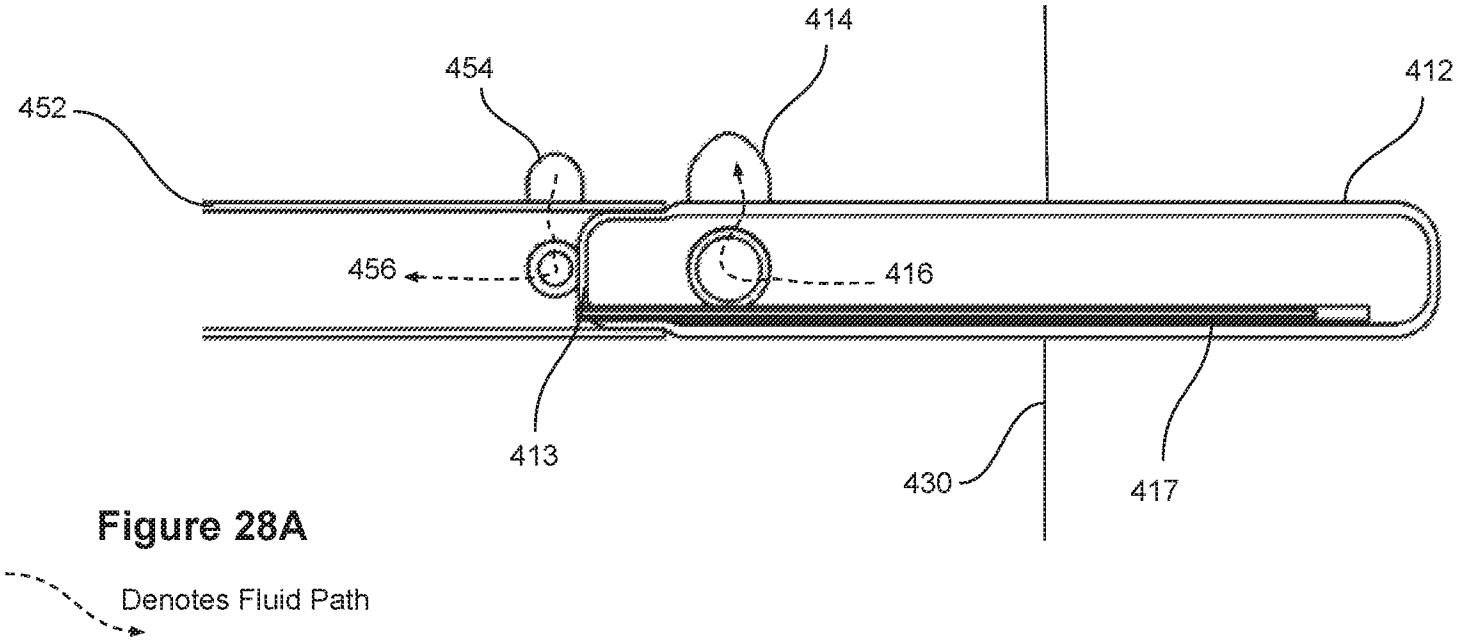
FIG. 28A is a cross-sectional view of a working fluid routing system such as the working fluid routing system of FIG. 27A, taken along the radial line B-B of FIG. 27C.

FIG. 28A is a cross-sectional view of a working fluid routing system such as the working fluid routing system of FIG. 27A, taken along the radial line B-B of FIG. 27C, illustrating a mechanism for placing the condenser section of the working fluid routing system in fluid communication with the evaporator section of the working fluid routing system.

Figure 28B:
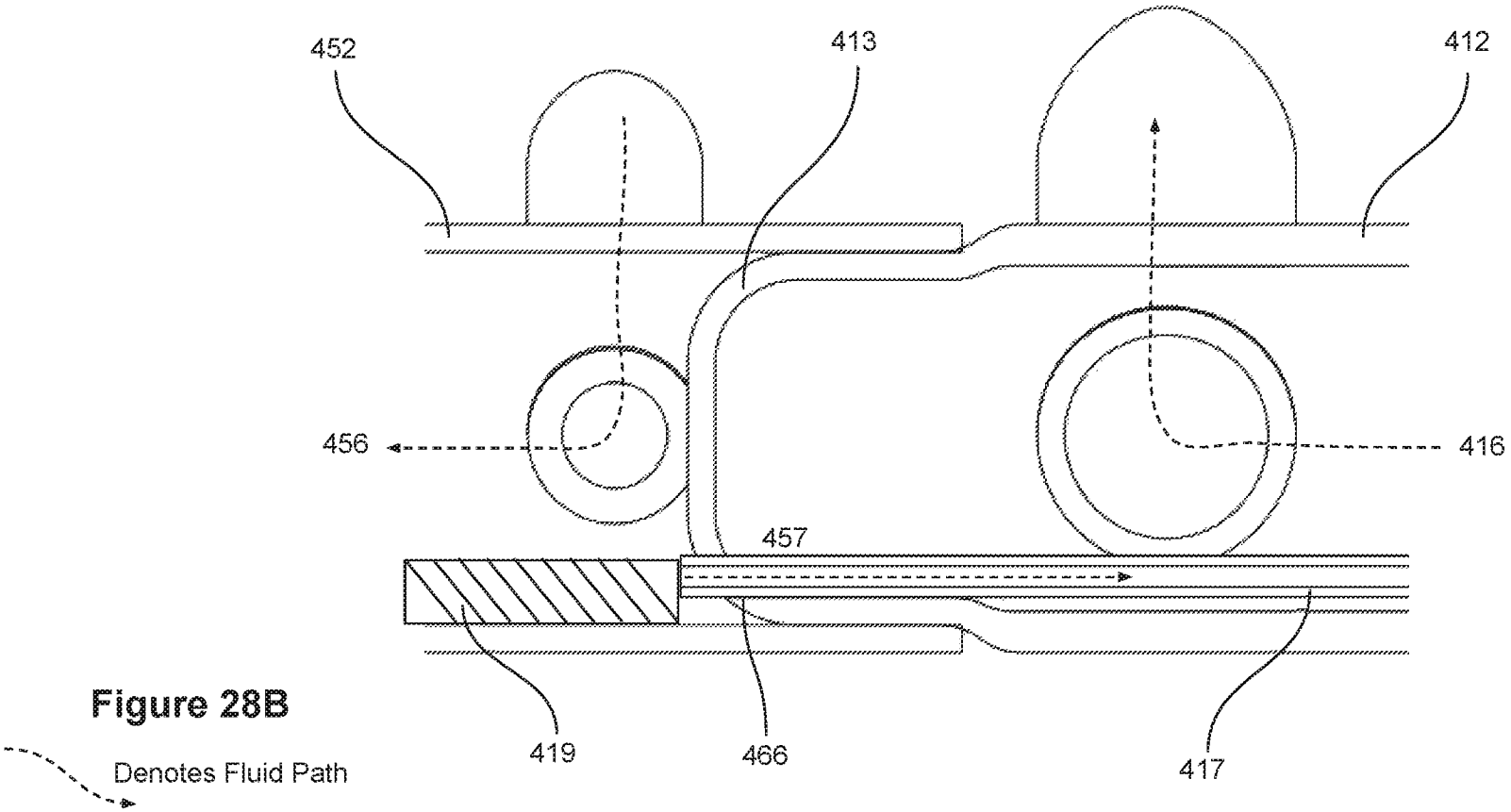
FIG. 28B is a cross-sectional detail view of the working fluid routing system of FIG. 28A, illustrating the fluid passage between the condenser section and the evaporator section.

FIG. 28B is a cross-sectional detail view of the working fluid routing system of FIG. 28A, illustrating the working fluid passage between the condenser section and the evaporator section. Vapor will enter condenser tube 452 via condenser fluid path 456. Heat will be conducted out of the tube and into the heat exchange fins 430 (see FIG. 28C). The loss of thermal energy will cause the vapor to condense to a liquid and be pulled outward radially and form liquid reservoir 419. Due to the pressure differential separated by evaporator cap 413, liquid will travel along liquid flow path 457 into the TXV 417 and be forced through TXV orifice where it will then enter into the evaporator section. The TXV 417 passes through TXV port 466 into the evaporator tube 412.

Figure 28C:
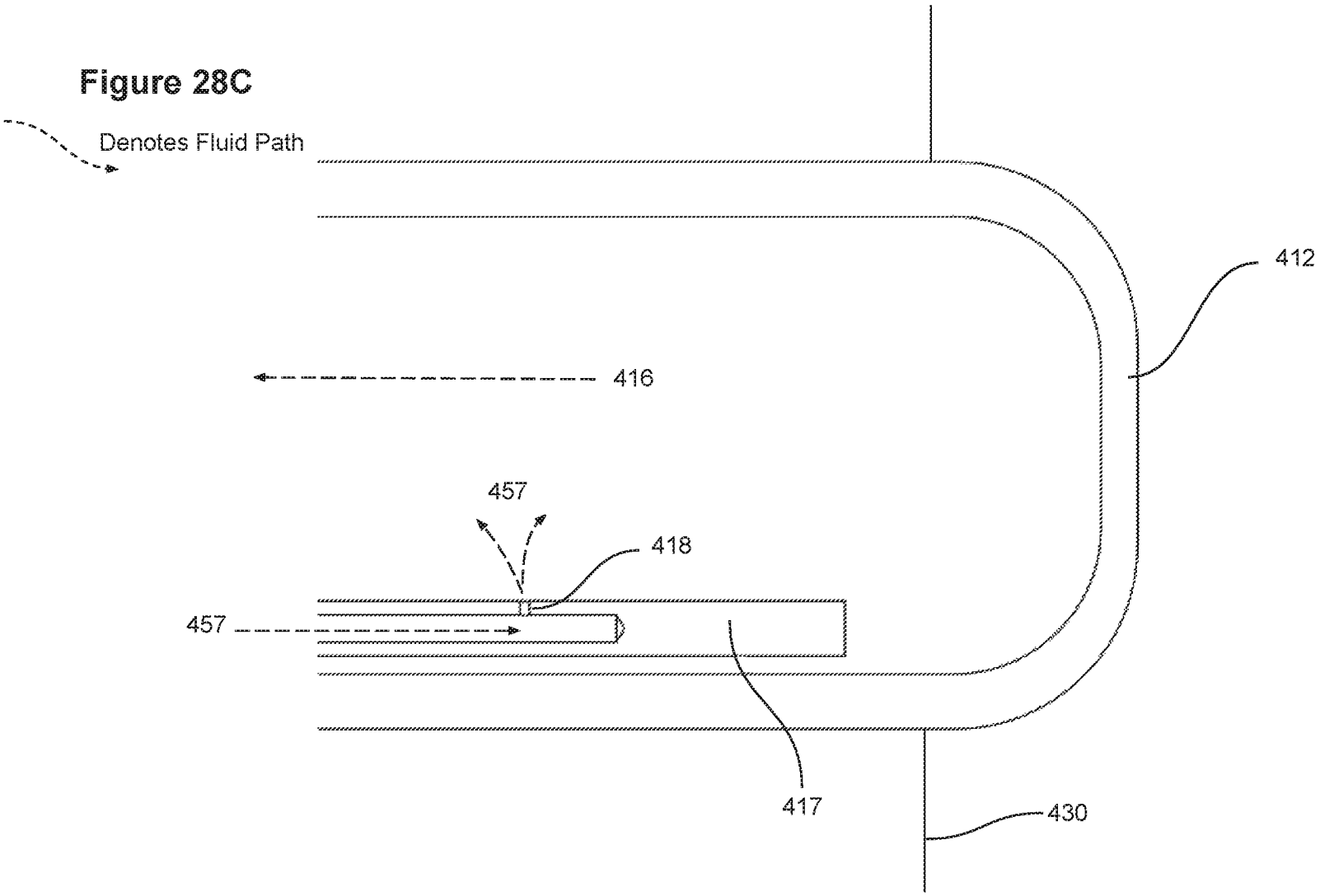
FIG. 28C is a detailed cross-sectional view of the working fluid routing system of FIG. 28A, illustrating the evaporator side of a fluid passage between the condenser section and the evaporator section.

FIG. 28C is a detailed cross-sectional view of the working fluid routing system of FIG. 28A, illustrating the evaporator side of a fluid passage between the condenser section and the evaporator section. Working fluid entering evaporator tubes 412 will boil and exit the tube via evaporator fluid path 416.

Figure 29:
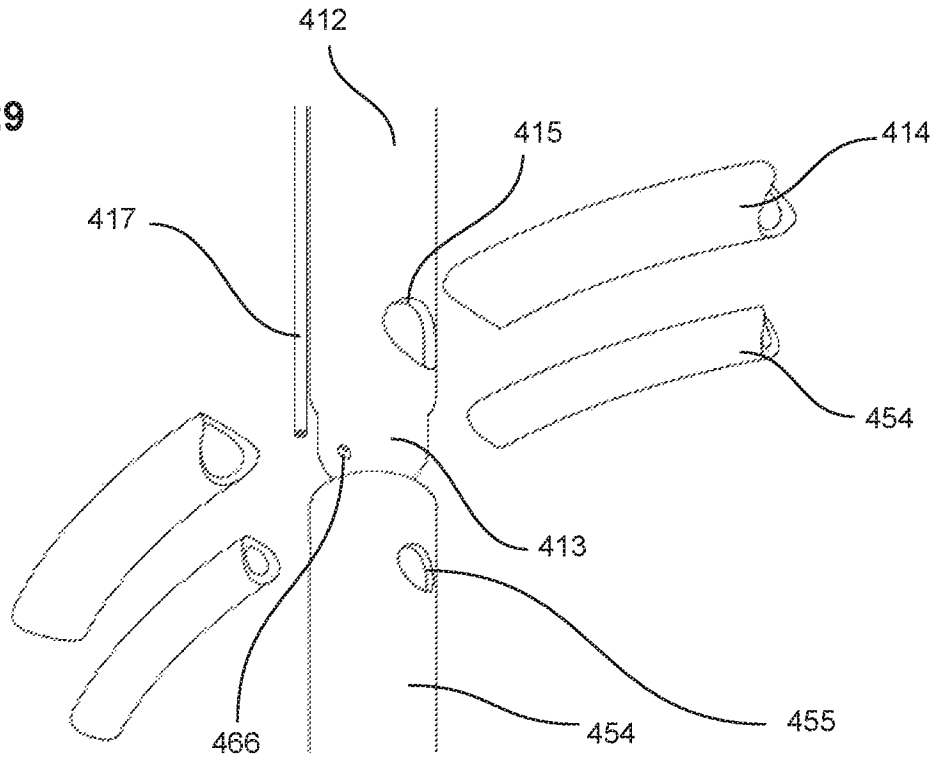
FIG. 29 is an exploded perspective assembly view of various components of the working fluid routing system of FIG. 27A.

FIG. 29 is an exploded perspective assembly view of various components of the working fluid routing system of FIG. 27A. Evaporator tubes 412 are necked to allow for mating of condenser tube 454. Evaporator tube 412 has evaporator holes 415 to allow for mating of evaporator pipe 414. Similarly, condenser tube 454 contains evaporator tube hole 455 to allow for mating of condenser pipes 454. TXV 417 passes through TXV port 466 in evaporator cap 413 to allow for liquid fluid flow into the evaporator.

Figure 30A:
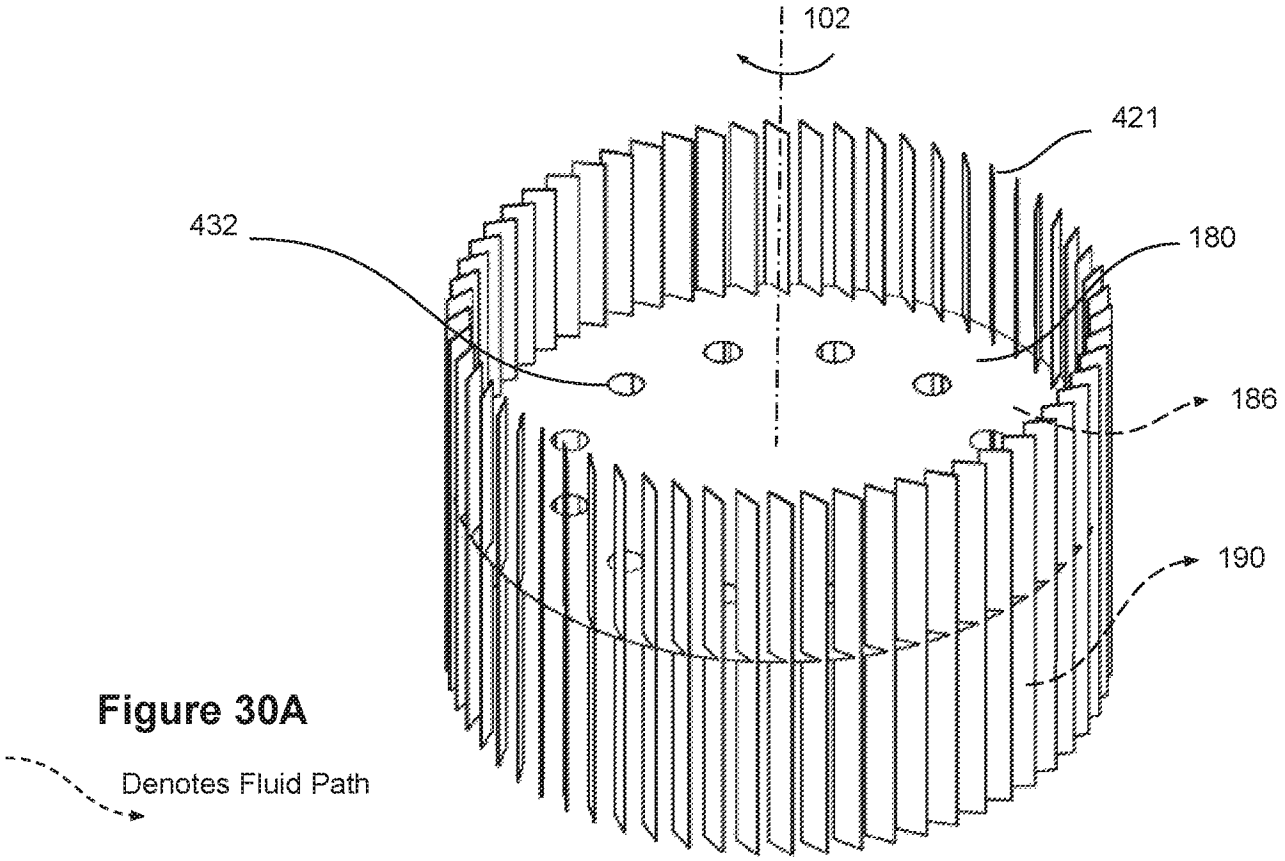
FIG. 30A is a perspective view of the a fan and support assembly configured to incorporate a working fluid routing system, such as the working fluid routing system of FIG. 27A.

FIG. 30A is a perspective view of the a fan and support assembly configured to incorporate a working fluid routing system, such as the working fluid routing system of FIG. 27A. A multitude of fan blades mounted to the baseplate 180 combine to form a dual-sided centrifugal fan flowing at the same time air along evaporator air out fluid path 186 and condenser air out fluid path 190. The baseplate contains base plate holes 432 to allow for the passage of the heat exchanger tubes 412 and 454. The baseplate is rigidly mounted to the compressor 150, and rotates as a single unit.

Figure 30B:
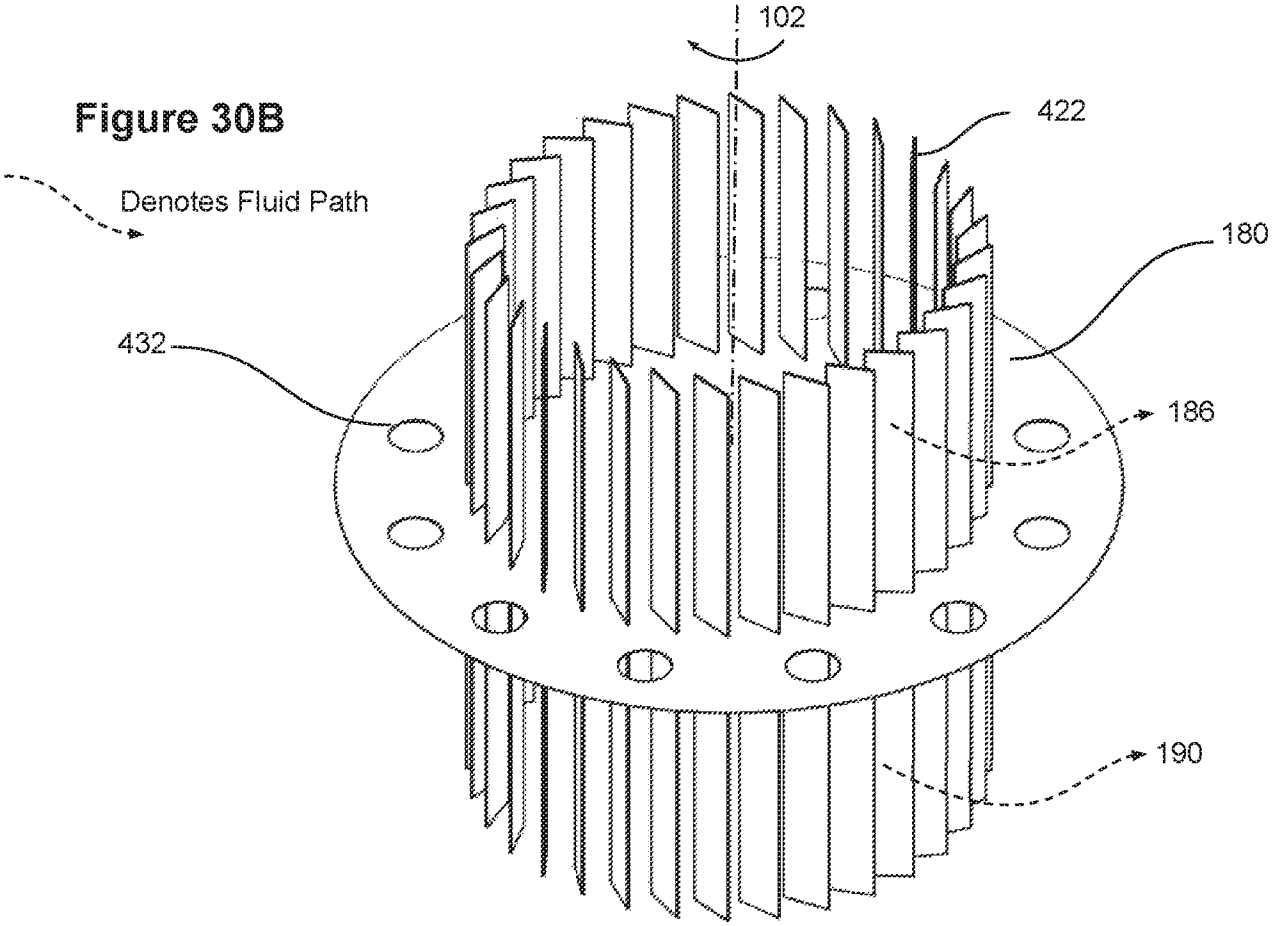
FIG. 30B is a perspective view of a fan and support assembly configured to incorporate a working fluid routing system, such as the working fluid routing system of FIG. 27A.

FIG. 30B is a perspective view of a fan and support assembly configured to incorporate a working fluid routing system, such as the working fluid routing system of FIG. 27A. A multitude of fan blades 422 combine to form a centrifugal fan whose fan blades are located radially closer the axis of rotation than the working fluid routing system that will mount in baseplate hole 432.

Figure 31:
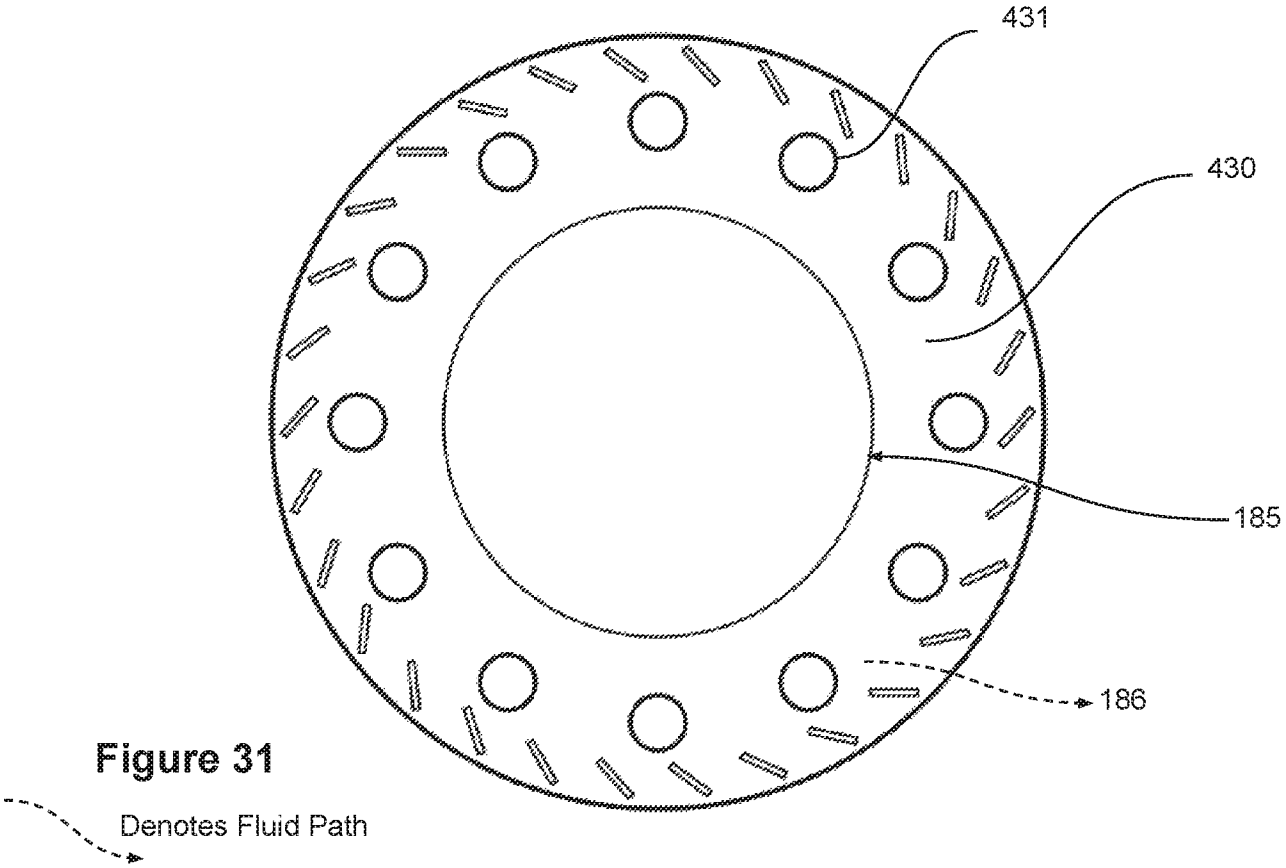
FIG. 31 is a top plan view of a heat exchange fin.
Figure 32:
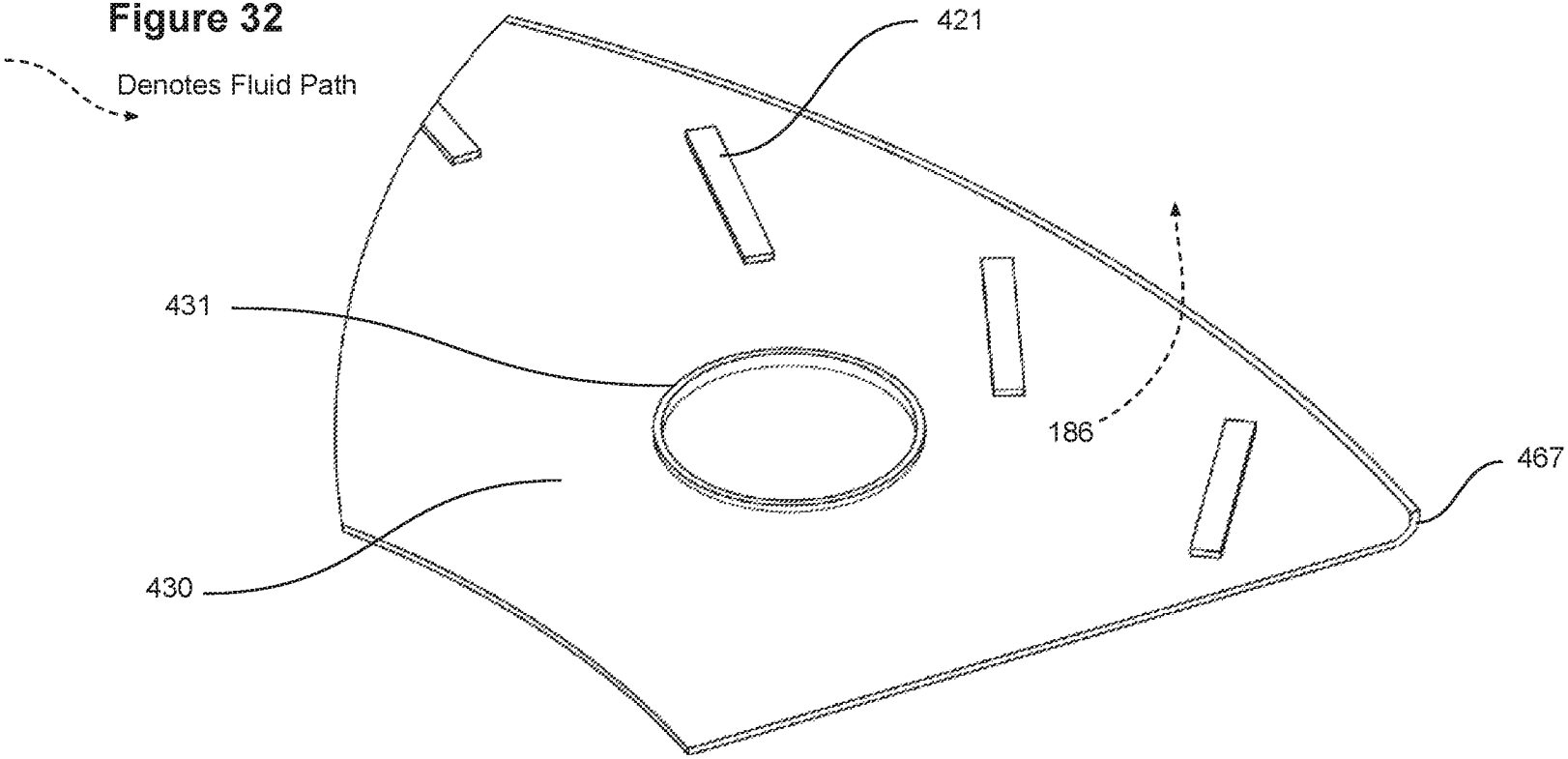
FIG. 32 is a detail of the heat exchange plate in FIG. 31.

FIG. 31 is a top plan view of a heat exchange fin. FIG. 32 is a detail of the heat exchange plate in FIG. 31 where a plurality of fluid carrying pipes would pass through a fin heat exchanger hole 431 in a multitude of heat exchange plates. Hole 431 may be shallow drawn or otherwise formed to increase contact area with heat exchanger tube 412 and 454. A centrifugal fan blade may be added to or formed into the heat exchange fin 430. This would induce airflow without an a separate fan blade. A varying multitude of shapes may be formed into heat exchange fins 430 in order to induce airflow radially and optimize heat exchange. The generation of centrifugal fan blades in this manner may have the added benefit of turning the centrifugal fan blades into a heat exchange surface. Air deflector surface 467 extending around the outer periphery could be used to deflect air flow path 186 axially if desired. In other embodiments, a cowling or other structure located radially outward of the centrifugal fan blades can be used to deflect air flow path 186 axially, in place of or in addition to the curved air deflector surface 467.

Figure 33:
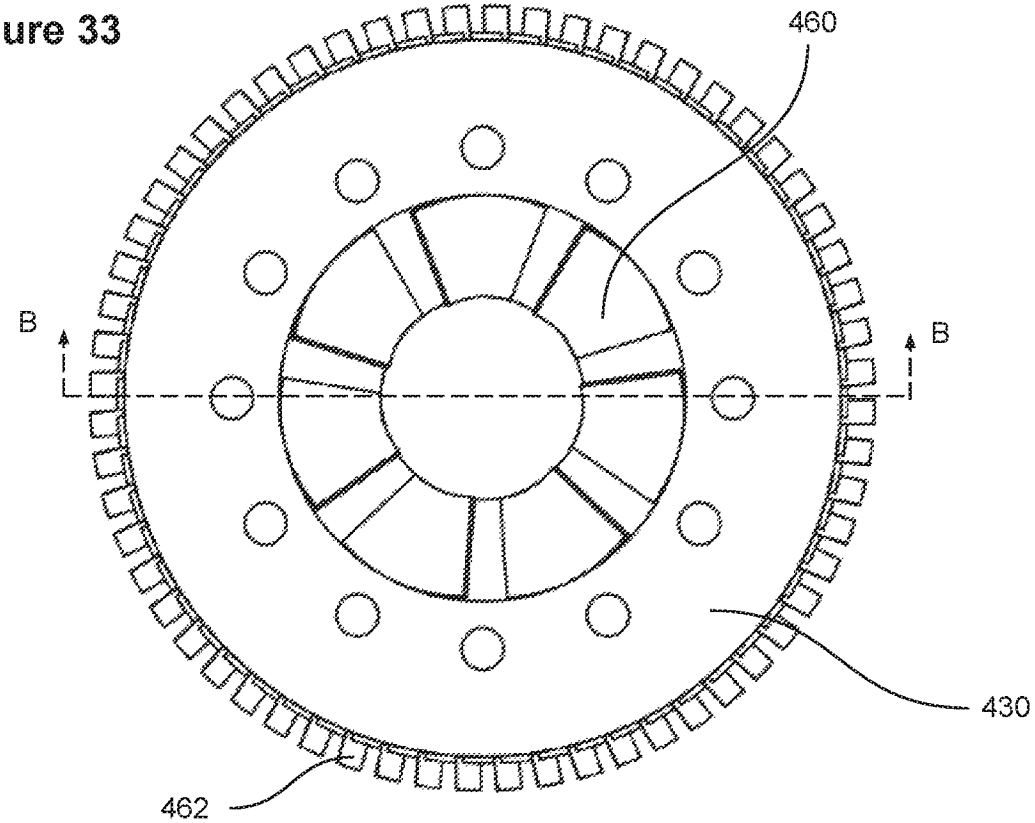
FIG. 33 is a is a top perspective view of an alternative embodiment of a rotary heat exchanger in which the working fluid is routed through a structure containing inlet and outlet axial fan blades.

FIG. 33 is a is a top perspective view of an alternative embodiment of a rotary heat exchanger in which the working fluid is routed through a structure containing inlet and outlet axial fan blades. Inlet axial fan 460 could be used to induce air over the rotating heat exchange fins 430. These could be in addition to, or instead of centrifugal fan blades. The axial inlet fan would be rigidly mounted to the rotating heat exchanger, thus inducing airflow radially.

Figure 33A:
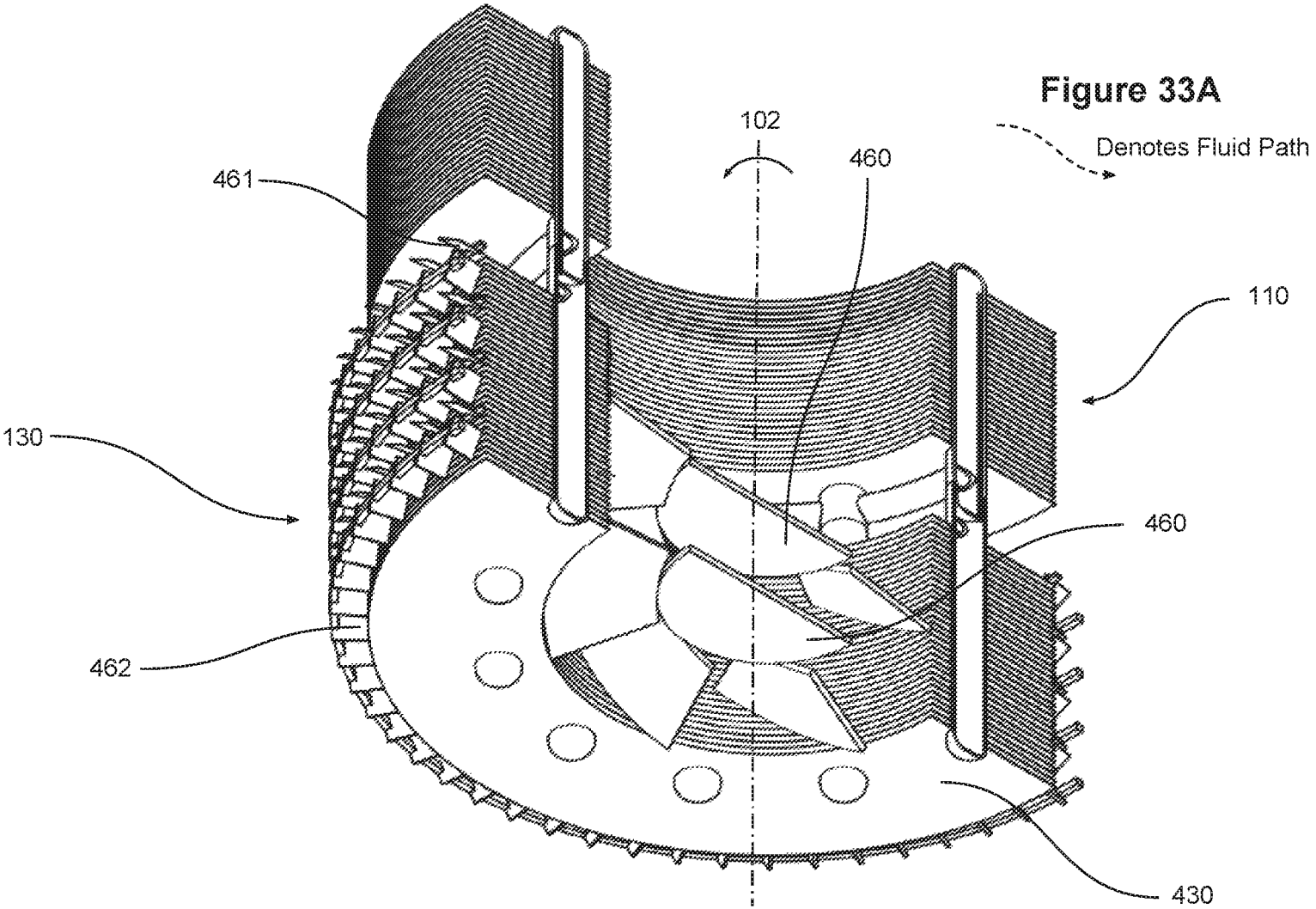
FIG. 33A is a side cross-section view of the rotary heat exchanger of FIG. 33, taken along the line B-B of FIG. 33.

FIG. 33A is a side cross-section view of the rotary heat exchanger of FIG. 33, taken along the line B-B of FIG. 33. Multiple axial fans 460 could be rigidly mounted to the inlet to increase air flow. In addition to, or separate from other axial or centrifugal fan blades, an outlet axial fan 461 could be used to induce airflow over the rotating heat exchanger. These axial fans would induce airflow along axial fan air fluid path 465, seen in FIG. 33B.

Figure 33B:
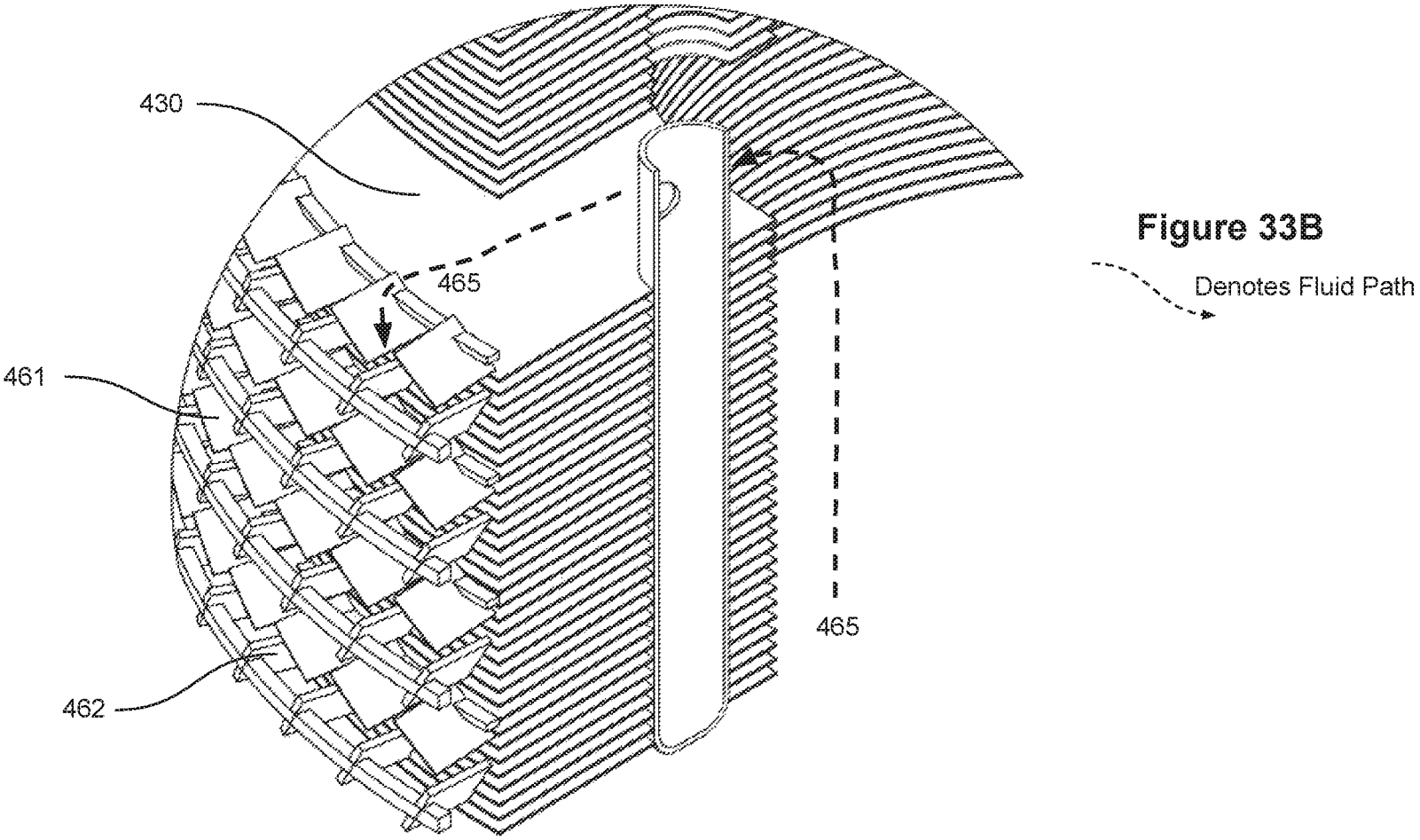
FIG. 33B is a side cross-section detail view of the rotary heat exchanger of FIG. 33, taken along the line B-B of FIG. 33.

FIG. 33B is a side cross-section detail view of the rotary heat exchanger of FIG. 33, taken along the line B-B of FIG. 33. The outlet axial fan 461 could also include a multitude of stages oriented axially to increase the airflow. The fan blades and/or outlet axial fan stages and stator stages could differ in size, shape, orientation, and other attributes. Outlet stator vanes 462 would be rigidly mounted to the stationary and mechanically grounded casing to improve airflow, but are not necessary.

Figure 34:
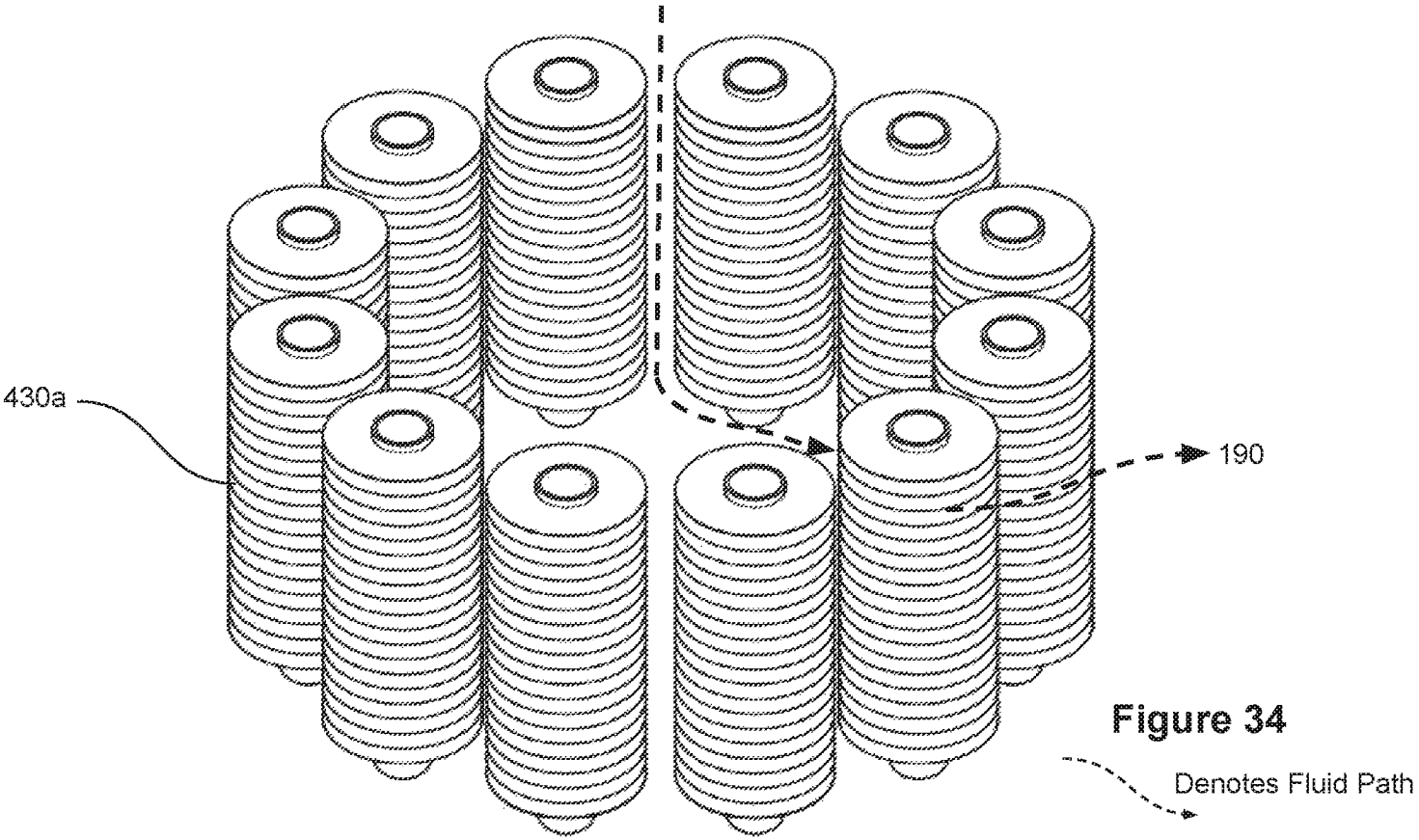
FIG. 34 is a top perspective view of an alternate embodiment of a rotary heat exchanger in which the individual heat exchange fins are attached to each fluid conduit individually.

FIG. 34 is a top perspective view of an alternate embodiment of a rotary heat exchanger in which the individual heat exchange fins are attached to each fluid conduit individually. Rather than providing heat exchange fins or other thermal transfer components which are in contact with multiple exchanger or condenser tubes, each tube may have a series of thermal transfer components such as the heat exchange fins depicted in FIG. 34, which need not be in contact with adjacent heat exchange fins attached to adjacent tubes.

The heat exchangers and similar devices described herein can be used in conjunction with a wide variety of additional components for a wide variety of applications. Various design modifications of the types discussed herein can be made to improve the performance of the devices for specific applications. The size, shape, orientation and number of the various components may be varied to improve performance in different applications. As discussed above, while the above implementations discuss rotary heat exchangers, some or all of the components discussed above in the various implementations may be rotationally fixed relative to the other components of the heat exchanger or similar device.

In addition, features of various embodiments discussed separately herein may nevertheless be combined in any suitable fashion. By way of example, the fins or other heat transfer structures discussed with respect to some embodiments may be used in conjunction with the hollow fan blades of other embodiments which form part of the fluid circuit. In such an embodiment, the finned blades or blades with other thermal exchange structures may be used to enhance heat transfer to and from the blades and the working fluid flowing through them. A wide variety of other combinations of features may also be used in other embodiments.

As used herein, a phrase referring to "at least one of" a list of items refers to any combination of those items, including single members. As an example, "at least one of: a, b, or c" is intended to cover: a, b, c, a-b, a-c, b-c, and a-b-c.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the orientation of a heat exchanger as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, a person having ordinary skill in the art will readily recognize that such operations need not be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In some cases, the actions recited in the claims can be performed in a different order and still achieve desirable results.

What is claimed is:

1. A heat exchanger, comprising:

a first rotary heat exchanger configured to rotate around an axis of rotation;

a second rotary heat exchanger configured to rotate in the same direction as the first rotary heat exchanger;

a fluid circuit configured to permit passage of a working fluid between the first and second rotary heat exchangers, the fluid circuit comprising:

a first plurality of tube sections extending through at least a portion of the first rotary heat exchanger in directions substantially parallel to the axis of rotation at least a portion of each of the first plurality of tube sections radially offset from the axis of rotation by a first radial distance; and a second plurality of tube sections extending through at least a portion of the second rotary heat exchanger in directions substantially parallel to the axis of rotation and radially offset from the axis of rotation, at least a portion of each the second plurality of tube sections being radially offset from the axis of rotation by a second radial distance equal to the first radial distance; and a compressor disposed along the fluid circuit and fixed to the first rotary heat exchanger such that at least a portion of the compressor will rotate along with the first rotary heat exchanger at the same speed and in the same direction as the first rotary heat exchanger, the compressor positioned such that the first plurality of tube sections extend beyond the compressor in a first axial direction parallel to the axis of rotation and the second plurality of tube sections extend beyond the compressor in a second axial direction parallel to the axis of rotation, the second axial direction opposite the first axial direction.

2. The heat exchanger of claim 1, wherein the compressor is a single-screw compressor.

3. The heat exchanger of claim 1, wherein the first rotary heat exchanger and the second rotary heat exchanger are configured to rotate at the same speed.

4. The heat exchanger of claim 1, wherein the compressor comprises:

a compressor casing fixed to the first rotary heat exchanger; and a main screw stator, the compressor casing configured to rotate relative to the main screw stator.

5. The heat exchanger of claim 1, wherein a portion of the fluid circuit includes a channel extending from a first point in one of the first plurality of tube sections axially beyond the compressor in the first axial direction to a second point in one of the second plurality of tube sections axially beyond the compressor in the second axial direction, the channel configured to convey a working fluid in liquid form and comprising an expansion valve.

6. The heat exchanger of claim 1, wherein each of the first plurality of tube sections have a cross-sectional diameter and extend along respective first longitudinal axes substantially parallel to the axis of rotation and the second plurality of tube sections along respective second longitudinal axes substantially parallel to the axis of rotation, the first longitudinal axis of each of the first plurality of fluid circuit sections is offset from the second longitudinal axis of a corresponding fluid section of the second plurality of fluid sections by a distance less than their cross-sectional diameter.

7. The heat exchanger of claim 1, wherein:

the first heat exchanger comprises a first plurality of thermal transfer components in thermal communication with the fluid circuit; and the second heat exchanger comprises a second plurality of thermal transfer components in thermal communication with the fluid circuit.

8. The heat exchanger of claim 7, wherein the first plurality of thermal transfer components comprise planar structures oriented parallel to one another, and the second plurality of thermal transfer components comprise planar structures oriented parallel to one another.

9. The heat exchanger of claim 7, wherein the first and second pluralities of thermal transfer components comprise fins oriented normal to the axis of rotation of the heat exchanger.

10. The heat exchanger of claim 9, wherein the first plurality of tube sections extend through the first plurality of fins and the second plurality of tube sections extend through the second plurality of fins, the first and second pluralities of fins comprising the radially outermost portion of the heat exchanger in the respective planes of the first and second pluralities of fins.

11. The heat exchanger of claim 1, wherein the first rotary heat exchanger comprises a first centrifugal fan and the second rotary heat exchanger comprises a second centrifugal fan axially aligned with the first centrifugal fan and oriented in the opposite direction as the first centrifugal fan.

12. The heat exchanger of claim 11, wherein each of the first and second pluralities of tube sections comprise a plurality of fan blades.

13. The heat exchanger of claim 12, wherein:

each of the plurality of fan blades includes a fan blade cavity, an inlet in fluid communication with the fan blade cavity, and an outlet in fluid communication with the cavity, the fluid circuit includes fan blade cavities, and the plurality of fan blades are configured to induce a state change in a working fluid during operation of the heat exchanger, such that at least a portion of a working fluid entering the cavity through the inlet of a fan blade in a first state will exit the outlet of the fan blade in a second state.

14. The heat exchanger of claim 13, additionally comprising a fluid distribution baseplate disposed between the first centrifugal fan and the second centrifugal fan, the fluid distribution baseplate comprising:

a first plurality of distribution channels, each of the first plurality of distribution channels in fluid communication with the inlet of at least one of the fan blades of the first centrifugal fan; and a second plurality of distribution channels, each of the second plurality of fluid distribution channels in fluid communication with the outlet of at least one the fan blades of the first centrifugal fan, wherein the fluid circuit includes the first and second pluralities of distribution channels.

15. A rotary heat exchanger apparatus, comprising:

a first heat exchanger disposed on a first side of a baseplate;

a second heat exchanger disposed on a second side of the baseplate and configured to rotate with the first heat exchanger about an axis of rotation;

a sealed fluid circuit extending through portions of the first and second heat exchangers, the sealed fluid circuit having a working fluid disposed within, the sealed fluid circuit comprising:

a first plurality of fluid circuit sections extending along respective first longitudinal axes parallel to the axis of rotation through at least a portion of the first rotary heat exchanger; and a second plurality of fluid circuit sections extending along respective second longitudinal axes parallel to the axis of rotation through at least a portion of the second rotary heat exchanger, the first longitudinal axis of each of the first plurality of fluid circuit sections substantially axially aligned with the second longitudinal axis of one of the second plurality of fluid circuit sections; and a compressor, the compressor disposed along the sealed fluid circuit and fixed to the first rotary heat exchanger such that at least a portion of the compressor will rotate with the first heat exchanger at the same speed and in the same direction as the first heat exchanger, at least a portion of the first plurality of fluid circuit sections extending beyond the compressor in a first axial direction parallel to the axis of rotation, and at least a portion of the second plurality of fluid circuit sections extending beyond the compressor in a second axial direction opposite the first axial direction.

16. The heat exchanger of claim 15, where the first longitudinal axis of each of the first plurality of fluid circuit sections is offset from the second longitudinal axis of the corresponding fluid section of the second plurality of fluid sections with which it is substantially aligned by a distance no greater than a diameter of a fluid circuit section.

17. The heat exchanger of claim 15, where each of the first plurality of fluid circuit sections is in fluid communication with the fluid circuit section of the second plurality of fluid circuit sections with which it is substantially axially aligned via a channel configured to convey a working fluid in liquid form over at least a portion of the length of the channel.

18. The heat exchanger of claim 17, wherein the channel extends between the fluid circuit section of the first plurality of fluid circuit sections and the substantially axially-aligned fluid circuit section of the second plurality of fluid circuit sections in a direction substantially parallel to the fluid circuit section of the first plurality of fluid circuit sections and the axially-aligned fluid circuit section of the second plurality of fluid circuit sections.

19. The apparatus of claim 15, additionally comprising a motor configured to drive the compressor, wherein the first heat exchanger is configured to operate as an evaporator, and wherein the second heat exchanger is configured to operate as a condenser.

20. The apparatus of claim 19, wherein the rotary heat exchanger apparatus includes a support member supporting the first and second rotary heat exchangers and configured to separate a first airstream from a second airstream, the support member exposing the first rotary heat exchanger to a first airstream and exposing the second rotary heat exchanger to a second airstream, wherein the support member comprises a cowling which can be moved to selectively expose the first rotary heat exchanger to one of the first or second airstream.

21. The heat exchanger of claim 19, wherein the rotary heat exchanger apparatus is configured to generate power using an Organic Rankine cycle, the rotary heat exchanger apparatus additionally comprising a turbine in fluid communication with the working fluid circuit, at least a portion of the turbine configured to rotate along with the first heat exchanger and the second heat exchanger.

22. The heat exchanger of claim 19, wherein the rotary heat exchanger apparatus is configured to capture solar power, the rotary heat exchanger apparatus additionally comprising a solar collector configured to concentrate sunlight on the rotary heat exchanger, wherein the compressor is configured to function as a turbine.

23. The heat exchanger of claim 19, wherein the rotary heat exchanger apparatus is configured to function as an atmospheric condensation device, wherein the first heat exchanger includes a first plurality of centrifugal fan blades, the first plurality of centrifugal fan blades including a hydrophobic coating.

24. A rotary heat exchanger, comprising:

a fluid distribution baseplate comprising:

a first baseplate surface;

a second baseplate surface opposite the first baseplate surface;

a plurality of fluid distribution channels disposed within the fluid distribution baseplate; and a central baseplate aperture;

a first plurality of centrifugal fan blades secured relative to the first baseplate surface, each of the first plurality of centrifugal fan blades having a non-circular cross-sectional shape and including at least one fluid conduit extending into the centrifugal fan blade from a side of the centrifugal fan blade adjacent the first baseplate surface;

a second plurality of centrifugal fan blades secured relative to the second baseplate surface, each of the second plurality of centrifugal fan blades having a non-circular cross-sectional shape and including at least one fluid conduit extending into the centrifugal fan blade from a side of the centrifugal fan blade adjacent the second baseplate surface; and a compressor extending through the central baseplate aperture and fixed to the fluid distribution baseplate such that at least a portion of the compressor will rotate along with the fluid distribution baseplate at the same speed and in the same direction as the fluid distribution baseplate around an axis of rotation of the fluid distribution baseplate, the compressor disposed along a fluid circuit passing through the compressor, at least one of the first plurality of centrifugal fan blades, and at least one of the second plurality of centrifugal fan blades, the first plurality of centrifugal fan blades extending axially beyond the compressor in a first axial direction parallel to the axis of rotation and the second plurality of centrifugal fan blades extending axially beyond the compressor in a second axial direction opposite the first axial direction, each of the second plurality of centrifugal fan blades arranged in a position at least partially axially overlapping one of the first plurality of centrifugal fan blades.

* * * * *